US008286401B2

(12) United States Patent
Little, Jr.

(10) Patent No.: US 8,286,401 B2
(45) **Date of Patent: *Oct. 16, 2012**

(54) DEMOUNTABLE PANELING SYSTEM

(76) Inventor: W. Frank Little, Jr., Magnolia, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/271,706

(22) Filed: Nov. 14, 2008

(65) Prior Publication Data

US 2009/0064621 A1 Mar. 12, 2009

Related U.S. Application Data

(60) Division of application No. 11/533,253, filed on Sep. 19, 2006, now Pat. No. 7,451,577, which is a continuation of application No. 09/652,648, filed on Aug. 31, 2000, now Pat. No. 7,197,853.

(51) Int. Cl.
*E04C 2/34* (2006.01)
*E02D 37/00* (2006.01)

(52) U.S. Cl. ..... 52/481.2; 52/514.5; 52/515; 52/742.16

(58) Field of Classification Search ..... 52/238.1, 52/481.1, 481.2, 515, 516, 514.5
See application file for complete search history.

(56) References Cited

U.S. PATENT DOCUMENTS

| | | | |
|---|---|---|---|
| 1,039,363 | A | 9/1912 | Chapin |
| 1,467,127 | A | 9/1923 | Walper |
| 1,751,327 | A | 3/1930 | Haire et al. |
| 2,047,982 | A | 7/1936 | Page |
| 2,064,785 | A | 12/1936 | Crandell |
| 2,313,990 | A | 3/1943 | Crandell |
| 3,109,207 | A | 11/1963 | Cooper |
| 3,305,993 | A | 2/1967 | Nelsson |
| 3,391,037 | A | 7/1968 | McNulty |
| 3,488,904 | A | 1/1970 | Schneller et al. |

(Continued)

FOREIGN PATENT DOCUMENTS

DE 7306581 6/1973

(Continued)

OTHER PUBLICATIONS

PCT International Preliminary Report on Patentability dated Dec. 16, 2008, International Application No. PCT/US07/62845.

(Continued)

*Primary Examiner* — Jessica Laux
(74) *Attorney, Agent, or Firm* — Patterson & Sheridan, LLP

(57) ABSTRACT

A demountable and remountable wall assembly for partitioning room space between an overhead and a floor, the major elements of which are reusable. The assembly provides one or two walls, at lease one of which has an outer fastener-free surface. Additionally, the fastener-free surface may be made substantially smooth and seamless. The walls are arranged in planar congruence, separated by internal spacers or studs, and vertically positioned between the overhead and floor of the room space to be partitioned. Removable tracks or spacers at the top and bottom of the wall assembly serves to interface the wall assembly with the floor and ceiling of the space. The walls are constructed of either finished or unfinished wall panels (e.g., fabric covered or sheet rock panels) which are incorporated into the assembly using a combination of removable fasteners and releasable adhesives. The finished or exposed area of a wall surface includes no fasteners. Any fasteners used to fix a wall panel in place is covered by a removable trim or other removable feature, which make the fasteners readily exposable and easy to remove.

34 Claims, 39 Drawing Sheets

U.S. PATENT DOCUMENTS

| | | | | |
|---|---|---|---|---|
| 3,576,091 | A | | 4/1971 | Shull, Jr. et al. |
| 3,579,409 | A | | 5/1971 | Shannon |
| 3,778,939 | A | | 12/1973 | Nelsson |
| 3,810,340 | A | | 5/1974 | Nelsson |
| 3,852,935 | A | | 12/1974 | Jones |
| 3,859,765 | A | | 1/1975 | Nelsson |
| 3,986,312 | A | | 10/1976 | Calhoun et al. |
| 4,042,739 | A | | 8/1977 | Emal et al. |
| 4,069,639 | A | | 1/1978 | Lindner et al. |
| 4,069,640 | A | * | 1/1978 | Dawdy ..... 52/746.1 |
| 4,157,271 | A | | 6/1979 | Moore |
| 4,267,228 | A | | 5/1981 | Stone et al. |
| 4,313,991 | A | | 2/1982 | Lamb |
| 4,425,175 | A | | 1/1984 | Moore |
| 4,792,473 | A | | 12/1988 | Vitale |
| 4,934,119 | A | | 6/1990 | Ybarra |
| 5,060,434 | A | | 10/1991 | Allison |
| 5,087,310 | A | * | 2/1992 | Robinette ..... 156/202 |
| 5,162,150 | A | | 11/1992 | Buis et al. |
| 5,216,859 | A | | 6/1993 | Moreno et al. |
| 5,246,775 | A | | 9/1993 | Loscuito |
| 5,283,091 | A | | 2/1994 | Darvell et al. |
| 5,333,433 | A | | 8/1994 | Porambo et al. |
| 5,390,458 | A | * | 2/1995 | Menchetti ..... 52/417 |
| 5,442,886 | A | | 8/1995 | Iacobelli |
| 5,486,394 | A | | 1/1996 | Stough |
| 5,487,250 | A | | 1/1996 | Yount et al. |
| 5,604,001 | A | | 2/1997 | Schold |
| 5,628,159 | A | | 5/1997 | Younts |
| 5,651,225 | A | * | 7/1997 | Leeks ..... 52/461 |
| 5,687,523 | A | | 11/1997 | Stough |
| 5,711,124 | A | | 1/1998 | Stough et al. |
| 5,729,945 | A | | 3/1998 | Menchetti et al. |
| 5,843,542 | A | | 12/1998 | Brushafer et al. |
| 5,891,282 | A | | 4/1999 | Stough et al. |
| 5,895,301 | A | | 4/1999 | Porter et al. |
| 5,924,256 | A | | 7/1999 | Ito |
| 6,165,304 | A | | 12/2000 | Otruba |
| 6,176,054 | B1 | | 1/2001 | Allen et al. |
| 6,231,962 | B1 | | 5/2001 | Bries et al. |
| 6,302,375 | B1 | | 10/2001 | Heil et al. |
| 6,413,606 | B1 | | 7/2002 | Calderon |
| 6,576,048 | B1 | | 6/2003 | Podlas et al. |
| 7,451,577 | B2 | | 11/2008 | Little, Jr. |
| 2003/0181114 | A1 | | 9/2003 | Newton et al. |
| 2005/0051278 | A1 | | 3/2005 | Dobson |
| 2006/0061278 | A1 | | 3/2006 | Jung et al. |

FOREIGN PATENT DOCUMENTS

| | | |
|---|---|---|
| DE | 19525689 | 11/1996 |
| FR | 2123259 | 9/1972 |

OTHER PUBLICATIONS

Extended European Search Report dated Apr. 8, 2010, EPO Patent Application No. 07757516.5.5.
Canadian Office Action dated Apr. 16, 2010, Canadian Patent Application No. 2,643,293.
U.S. Prosecution History for U.S. Appl. No. 09/652,648.
U.S. Prosecution History for U.S. Appl. No. 11/533,253.
U.S. Prosecution History for U.S. Appl. No. 12/271,720.
U.S. Prosecution History for U.S. Appl. No. 11/679,069.
U.S. Prosecution History for U.S. Appl. No. 12/834,762.

* cited by examiner

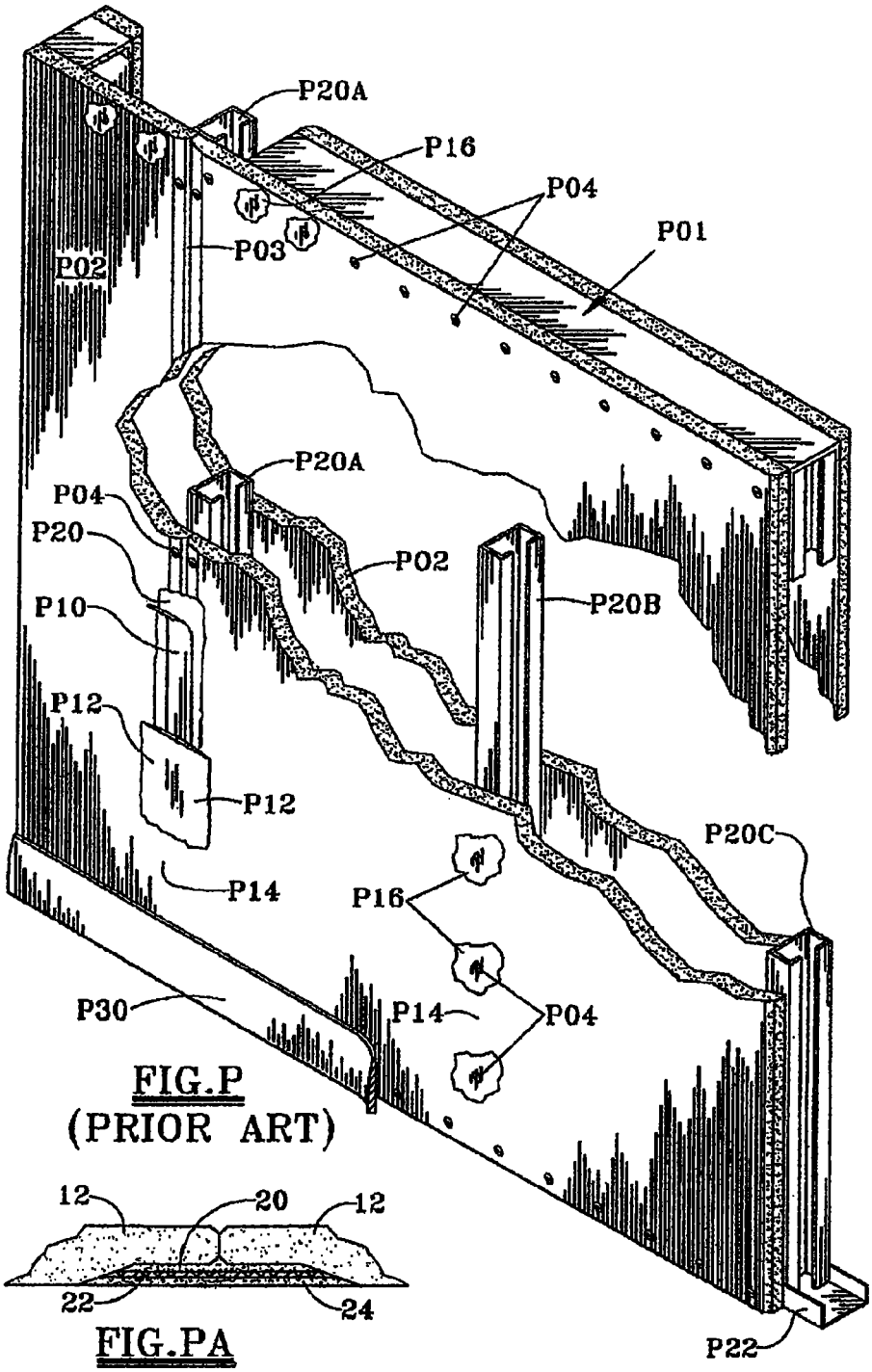
FIG.P
(PRIOR ART)
FIG.PA

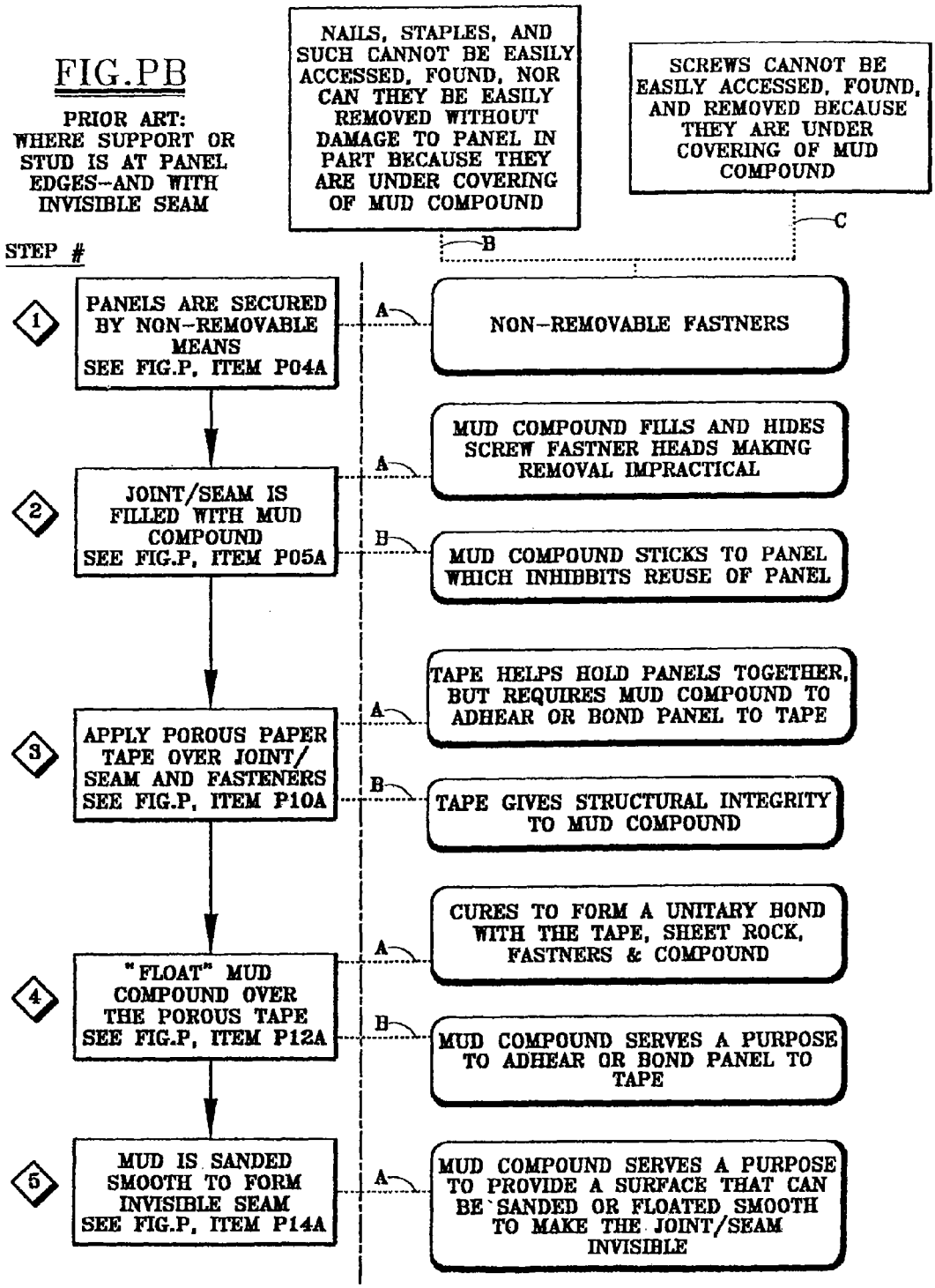
FIG.PB
PRIOR ART: WHERE SUPPORT OR STUD IS AT PANEL EDGES--AND WITH INVISIBLE SEAM
NAILS, STAPLES, AND SUCH CANNOT BE EASILY ACCESSED, FOUND, NOR CAN THEY BE EASILY REMOVED WITHOUT DAMAGE TO PANEL IN PART BECAUSE THEY ARE UNDER COVERING OF MUD COMPOUND
SCREWS CANNOT BE EASILY ACCESSED, FOUND, AND REMOVED BECAUSE THEY ARE UNDER COVERING OF MUD COMPOUND
C
B
STEP #
1
PANELS ARE SECURED BY NON-REMOVABLE MEANS SEE FIG.P, ITEM P04A
A
NON-REMOVABLE FASTNERS
2
JOINT/SEAM IS FILLED WITH MUD COMPOUND SEE FIG.P, ITEM P05A
A
MUD COMPOUND FILLS AND HIDES SCREW FASTNER HEADS MAKING REMOVAL IMPRACTICAL
B
MUD COMPOUND STICKS TO PANEL WHICH INHIBBITS REUSE OF PANEL
3
APPLY POROUS PAPER TAPE OVER JOINT/ SEAM AND FASTENERS SEE FIG.P, ITEM P10A
A
TAPE HELPS HOLD PANELS TOGETHER, BUT REQUIRES MUD COMPOUND TO ADHEAR OR BOND PANEL TO TAPE
B
TAPE GIVES STRUCTURAL INTEGRITY TO MUD COMPOUND
4
"FLOAT" MUD COMPOUND OVER THE POROUS TAPE SEE FIG.P, ITEM P12A
A
CURES TO FORM A UNITARY BOND WITH THE TAPE, SHEET ROCK, FASTNERS & COMPOUND
B
MUD COMPOUND SERVES A PURPOSE TO ADHEAR OR BOND PANEL TO TAPE
5
MUD IS SANDED SMOOTH TO FORM INVISIBLE SEAM SEE FIG.P, ITEM P14A
A
MUD COMPOUND SERVES A PURPOSE TO PROVIDE A SURFACE THAT CAN BE SANDED OR FLOATED SMOOTH TO MAKE THE JOINT/SEAM INVISIBLE

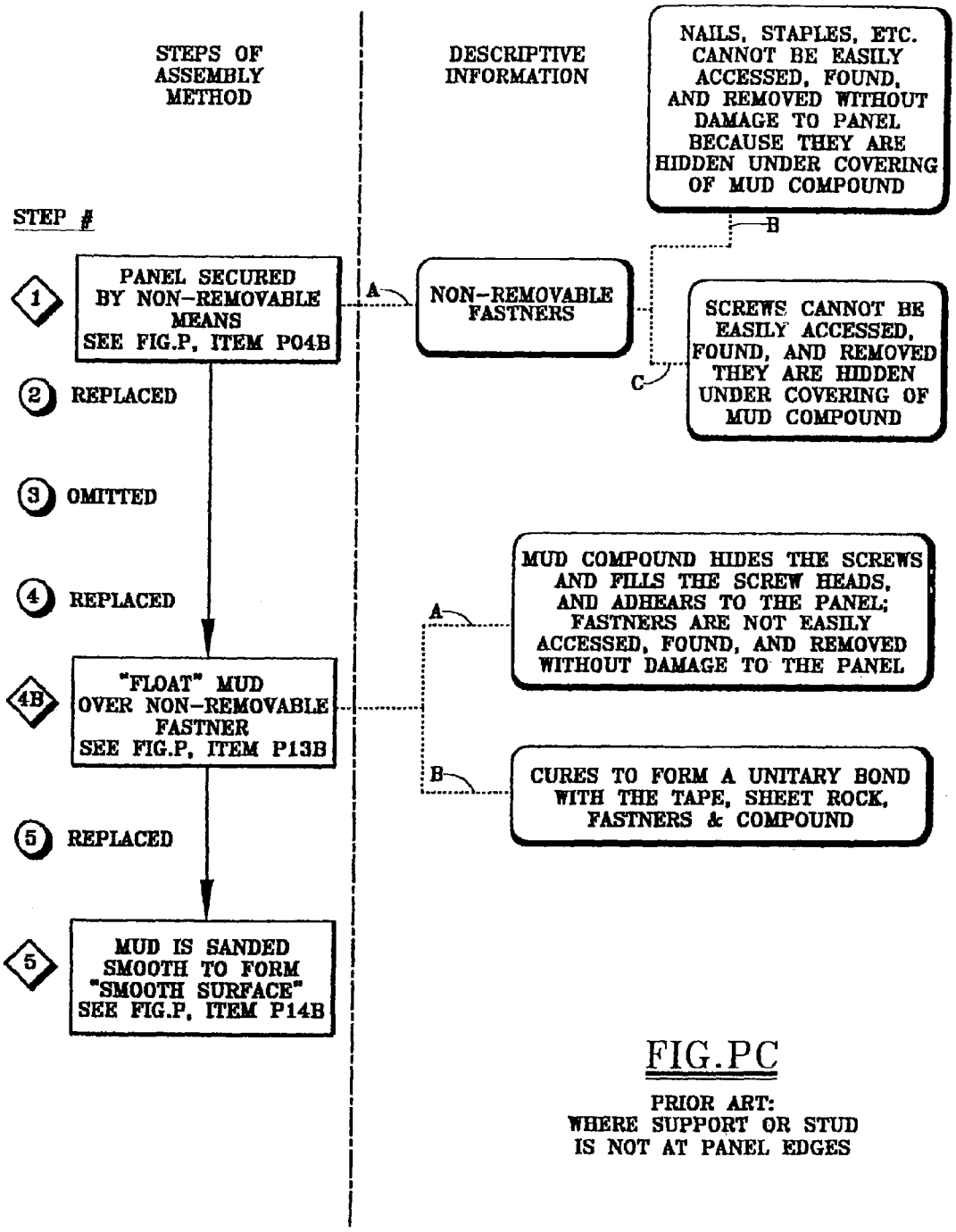
FIG.PC
PRIOR ART:
WHERE SUPPORT OR STUD
IS NOT AT PANEL EDGES

WHERE SUPPORT OR STUD IS AT PANEL EDGES AND WITH INVISIBLE SEAM

WHERE SUPPORT OR STUD IS NOT AT PANEL EDGES

WHERE SUPPORT OR STUD IS NOT AT PANEL EDGES; FIRE RATED

WHERE SUPPORT OR STUD IS AT PANEL EDGES AND WITH INVISIBLE SEAM

WHERE SUPPORT OR STUD IS NOT AT PANEL EDGES

WHERE SUPPORT OR STUD IS AT PANEL EDGES-- AND WITH VISIBLE SEAM

WHERE SUPPORT OR STUD IS NOT AT PANEL EDGES

FIG.21AAA

DEMOUNTABLE PANELING SYSTEM

CROSS-REFERENCE TO RELATED APPLICATIONS

This application is a divisional of U.S. patent application Ser. No. 11/533,253, filed Sep. 19, 2006, now U.S. Pat. No. 7,451,577 which is a continuation of U.S. patent application Ser. No. 09/652,648, filed Aug. 31, 2000, now U.S. Pat. No. 7,197,853, which are herein incorporated by reference in their entirety.

BACKGROUND OF THE INVENTION

1. Field of the Invention

This invention is in the field of building and facility walls and ceiling systems and associated architectural elements. More particularly, the present invention is in the field of wall and ceiling partitions having architectural elements which are demountable and reusable, and that have a seamless surface between the architectural elements when the wall and ceiling partitions are in place.

2. Description of the Related Art

A variety of removable and reusable wall systems are available for use in partitioning a building's interior space. The prior known wall systems each attempt to embody a subset of the overall objects and advantages that the industry seeks in such assemblies, often for a specific building application. The structure of such assemblies range from floor-to-ceiling full height wall partitions to modular-office-cubical-type panel assemblies having partial height walls.

Removable, full height wall partition assemblies are often referred to as "demountable" wall systems. Examples of such systems include the demountable wall systems of Allison (U.S. Pat. No. 5,060,434) and Moreno et al. (U.S. Pat. No. 5,216,859). Current demountable wall systems are designed separately from the buildings they are used in, and are incorporated separately into the interior space of the building as an accessory, after the building is completed.

Many limitations may be found in prior art demountable wall systems. The component parts of which are inherently sophisticated, complex, and intricate. They require custom prefabrication of processed-raw-material-stock. They require elaborate warehousing, stocking, inventorying of numerous parts many of which become obsolete over time. Each manufacturer must train and then maintain specialty crews in every major city in order to site assemble, disassemble, and reassemble their particular and unique demountable wall and system. Prior art demountable walls must create specialized custom doors, windows, door and window hardware, electrical, voice and data, plumbing, and the like which together dictate a complex problem prone system. All of the prior art systems have dimensional limitations of height and restricted flexibility in length due to prefabrication. Once a height is selected to fit a certain building it is often not usable in another building because of seemingly minor differences in height or most often in the degree of slope of the floors which the naked eye perceives as level but the demountable wall panels can not tolerate. Prior art wall system manufacturers attempt to overcome this limitation by adding more variety of product sizes which actually magnifies the above limitations because it magnifies the problems associated with complexity, inventorying, obsolesce, assembly crew training, and ever increasing costs associated with these limitations. The cost of prior art demountable wall systems is very high ($80 to $200 per lineal foot plus accessories compared to standard fixed wall cost of about $22 per lineal foot) and therefore the use of prior art demountable walls is not wide spread. If there were a wide spread use of demountable walls the impact on our environment and non-renewal resources would be very positive because the standard fixed walls do not accommodate reconfiguration. Therefore the standard fixed walls must be demolished and sent to special toxic waste landfills (decomposing gypsum releases a toxic gas) and new walls must be constructed using more of our non-renewal natural resources.

Another limitation of prior art demountable wall and ceiling systems is the resulting seams and gaps that occur between the component panels that make up the walls and ceiling. Architects and designers object strongly to these aesthetically unacceptable and often imbalanced sectioning of the architecture. Prior art demountable walls are limited to interior use, few, if any, are fire rated nor are they load bearing.

Since commercial buildings, particularly office buildings are often remodeled to accommodate changing space requirements, tenancy, and design tastes, it would be advantageous to have an interior and exterior space partitioning system which allows disassembly and ready reassembly and thus permits the general reuse of the elements of the system. This permits savings in material and downtime. It would be beneficial to have a demountable wall system that allowed the removal, reuse, and relocation of wall system elements, including not only wall panels and studs but also electrical and plumbing elements and door and window elements. The availability of a wall system embodying such recyclable elements would reduce waste and the cost of altering a building's space.

SUMMARY OF THE INVENTION

It is a feature of the present invention that it provides a wall and ceiling system which permits the general reuse of the elements of the system, thereby reducing material wastes and the cost of altering a building's space. The present invention overcomes most if not all of the aforementioned limitations to the prior art. Additional features and advantages of the invention will be set forth in part in the description which follows, and in part will become apparent from the description, or may be learned by practice of the invention. The features and advantages of the invention may be realized by practicing the combinations and steps described herein and particularly pointed out in the appended claims.

To achieve the foregoing features and advantages and in accordance with the purpose of the present invention as embodied and broadly described herein, the present invention is a non-load bearing wall partition system, the elements of which are demountable and reusable, and which may be assembled or reassembled using recyclable elements to provide a fastener-free surface, and may be finished to further provide a seamless as well as fastener-free surface.

More specifically, the present invention is a demountable wall assembly for partitioning room space between an overhead and a floor comprising wall surfaces that are fastener-free and which may be smooth and seamless when erected, and the structural elements of which are reusable after demounting. The wall assembly has two walls arranged in planar congruence and separated by spacers, which defines an inner wall space enclosed between the interior surfaces of the walls. This configuration also provides at least one exterior wall surface, which is a fastener-free wall surface, and may provide a second exterior wall surface which may or may not be fastener free. The surfaces are vertically positioned between and interface with the overhead (ceiling) and floor of the space to be partitioned. The fastener-free wall surface wall is made up of at least one removable wall panel. A wall panel may be sheet rock or some other type of panel suitable for use as a wall. The interior space formed between the two exterior walls may provide a space for the drop of modularized electrical, phone, and data lines at appropriate places throughout the interior space serviced by the demountable wall system.

A top spacer (variously called a header track, top plate, top sill, etc.) at the top of the wall assembly provides an interface between the overhead and other wall elements, e.g., internal spacers and wall panels. Similarly, a bottom spacer at the bottom of the wall assembly (variously called a bottom plate, bottom sill, etc.) provides an interface between the floor and other wall elements. The top spacer and bottom spacer are removably fixed to the overhead and floor respectively using any of a number of removable fasteners and releasable adhesives known to the ordinarily skilled artisan. Therefore, in the practice of the present invention, after being fixed in place, the top bottom spacers are removable and reusable. Similarly, top spacers and bottom spacers are removably fixed to the other wall elements using any of a number of removable fasteners and releasable adhesives known to the ordinarily skilled artisan. In those applications where removable fasteners are not to be used to long-term mount the other wall elements to the top or bottom spacer, or to each other, releasable adhesives may be substituted. As may be readily apparent, the mounting and demounting of the wall's various elements, (including top and bottom spacers, internal spacers, wall panels, trim, junction boxes, wiring, etc.) does not substantially impact their suitability for reuse.

A feature of the wall assembly of the present invention is an interior spacer which interfaces with the interior surfaces of the two walls and provides rigidity and support to the expanse of the wall, or an attachment interface at the perimeter edge of adjacent wall elements (panels). Interior wall spacers may run vertically, horizontally, or in any orientation required to accomplish their purpose. Internal spacers suitable for use in the wall assembly of the present invention includes any of the variety of wall studs typical of the building trades, and typically having a width of about 2.5 inches, and including a wooden 27W, or a removable head track and similar lumber and hardware.

A further feature of the present wall assembly is that the exterior surface of at least one of the walls is a fastener-free wall surface. A fastener-free wall surface is an exterior wall surface that has no fasteners in the exposed (i.e., not covered by trim or molding) surface of the wall. The second wall of the present invention may be a wall with a fastener-free exterior surface, an unfinished structural (bearing) wall or the like. In the typical practice of the present invention. a wall having a fastener-free surface comprises a plurality of removable wall panels juxtapositioned at a perimeter edge to form a planar surface. An aspect of the fastener-free wall surface feature of the present invention is that the joint between the juxtapositioned panel edges may be treated as described herein to render the fastener-free surface also substantially smooth and seamless. Specifically, the joints may be filled with a releasable caulk or covered with a removable tape to provide a fastener-free surface that is substantially smooth when finished, and the caulk or tape being removable without substantial damage to the integrity of the wall panel. This permits the wall panels to be reused.

Unused wall panels may be inventoried and stored between redesigned wall systems providing further sound-deadening between the partitions and further structural support to the top and bottom spacers and the wall system generally. Alternatively, previously used wall panels may be moved to other sites for reinstallation.

BRIEF DESCRIPTION OF THE DRAWINGS

The accompanying drawings which are incorporated in and constitute a part of the instant specification, illustrate various preferred embodiments of the invention and together with the general description of the invention given above and the detailed description of the preferred embodiments given below, serve to explain the principles of the invention.

FIG. P illustrates a prior art wall assembly.

FIG. PA is a plan view cross section of the seam illustrating the prior art methodology in concealing and securing the seam between the panels in a conventional wall.

FIG. PB is a flow chart describing a prior art wall as illustrated in FIG. P and FIG. PA.

FIG. PC is a flow chart describing a prior art wall as illustrated in FIG. P.

Figure 1:
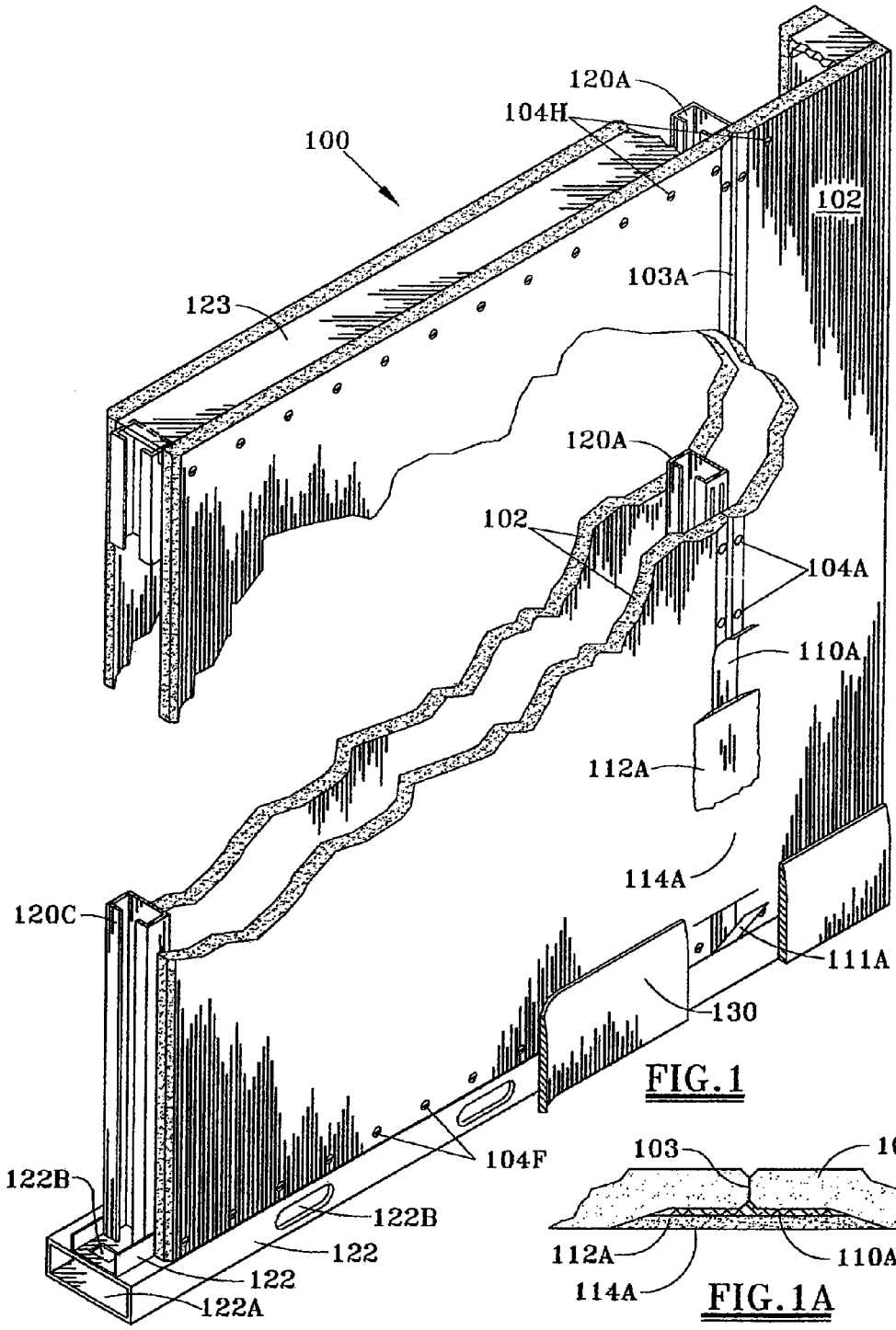

FIG. 1 is an illustration of a preferred embodiment of the wall system of the present invention with the supports or studs at the panel edge including an invisible seam and bottom track.

Figure 1A:
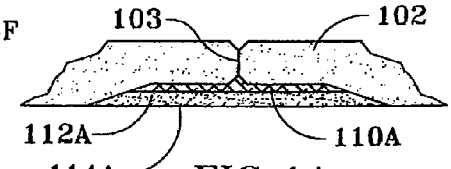

FIG. 1A is a plan view cross section of the seam in FIG. 1 illustrating a methodology of the present invention in concealing and securing the seams between panels in the wall system.

Figure 1B:
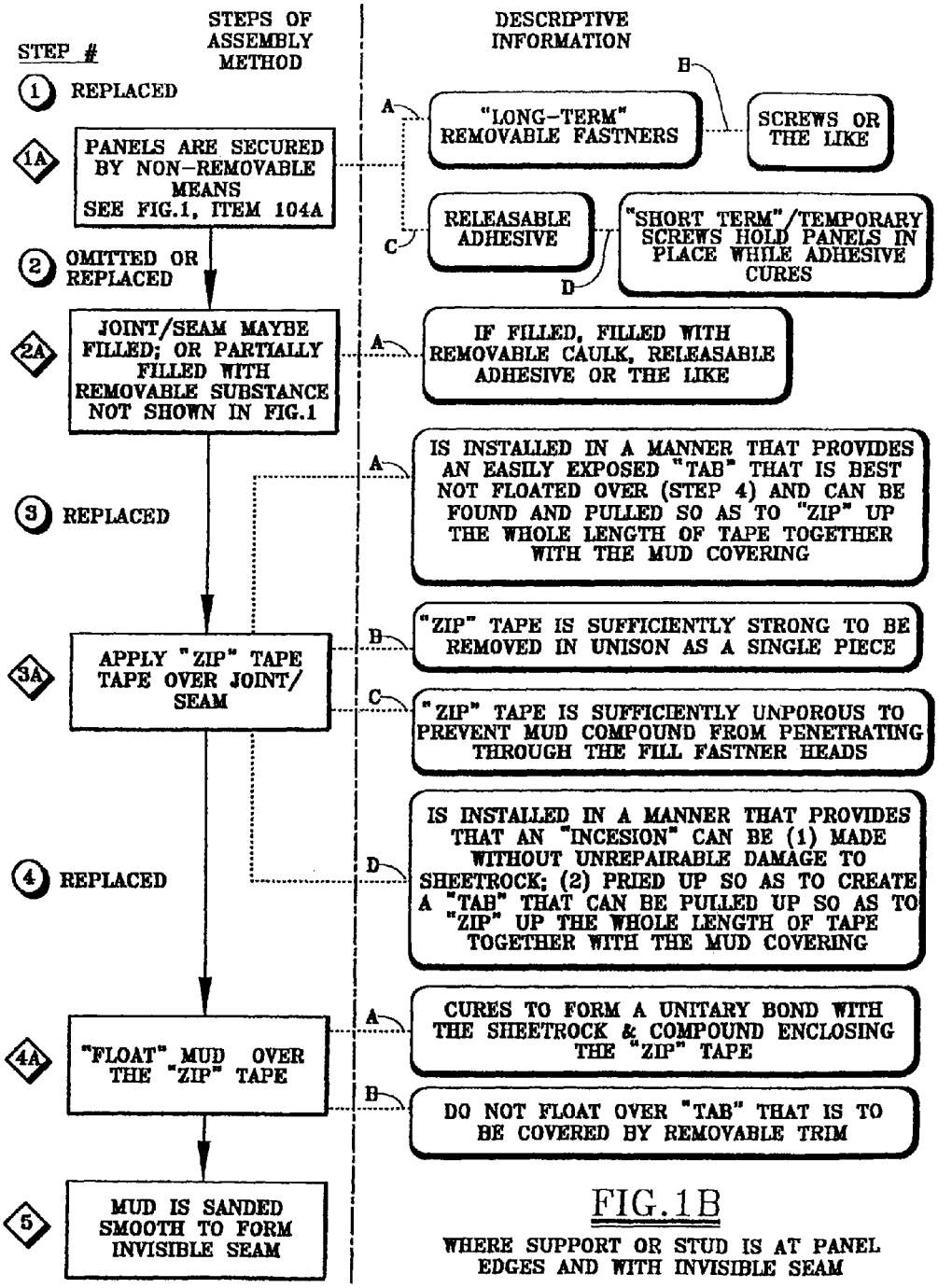

FIG. 1B is a flow chart describing the wall of the present invention as illustrated in FIG. 1.

Figure 1C:
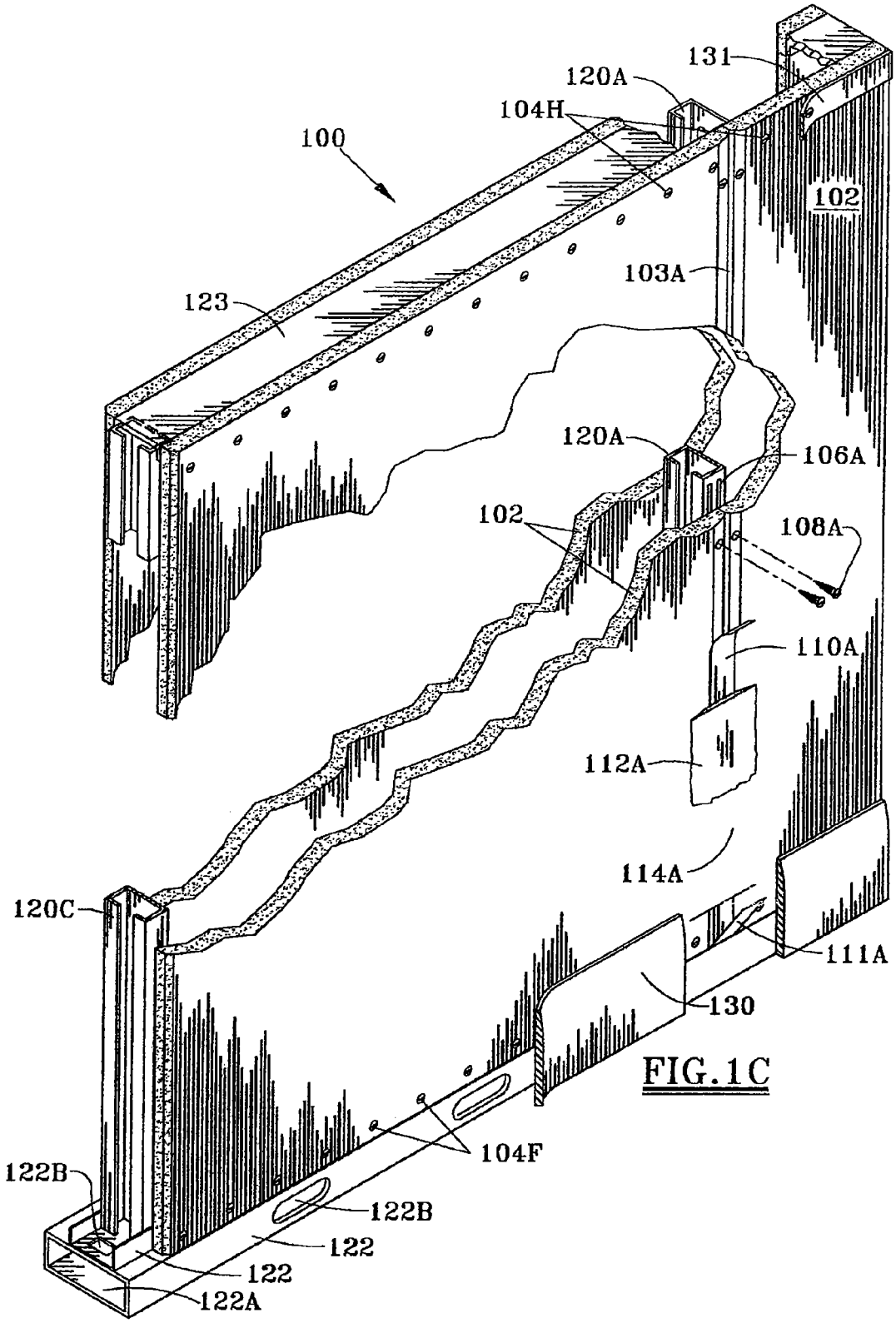

FIG. 1C is an illustration of a preferred embodiment of the wall system of the present invention using releasable adhesive with the supports or studs at the panel edge including an invisible seam and bottom track.

Figure 1D:
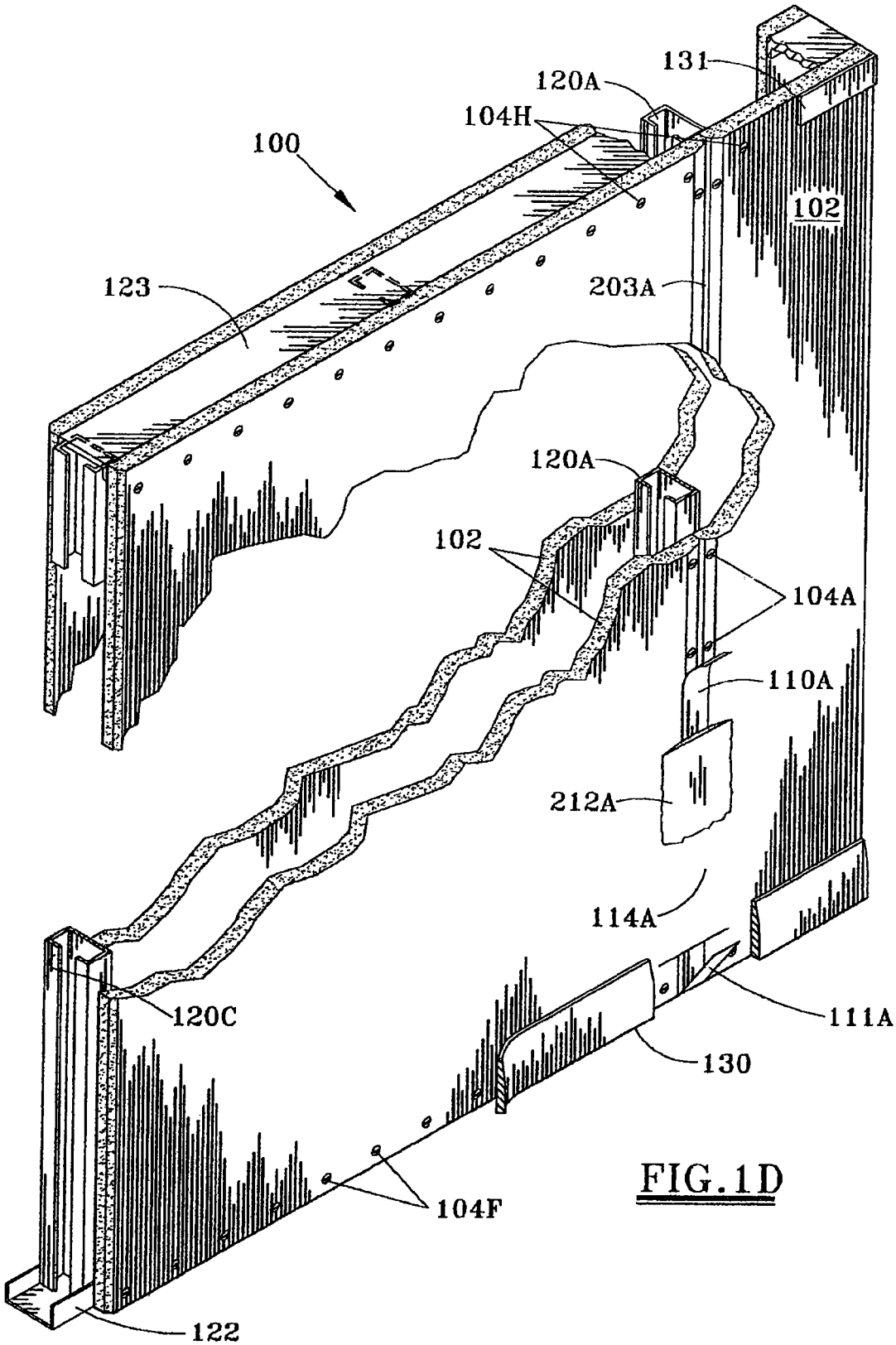

FIG. 1D is an illustration of a preferred embodiment of the wall system of the present invention with the supports or studs at the panel edge including an invisible seam.

Figures 2, 2A:
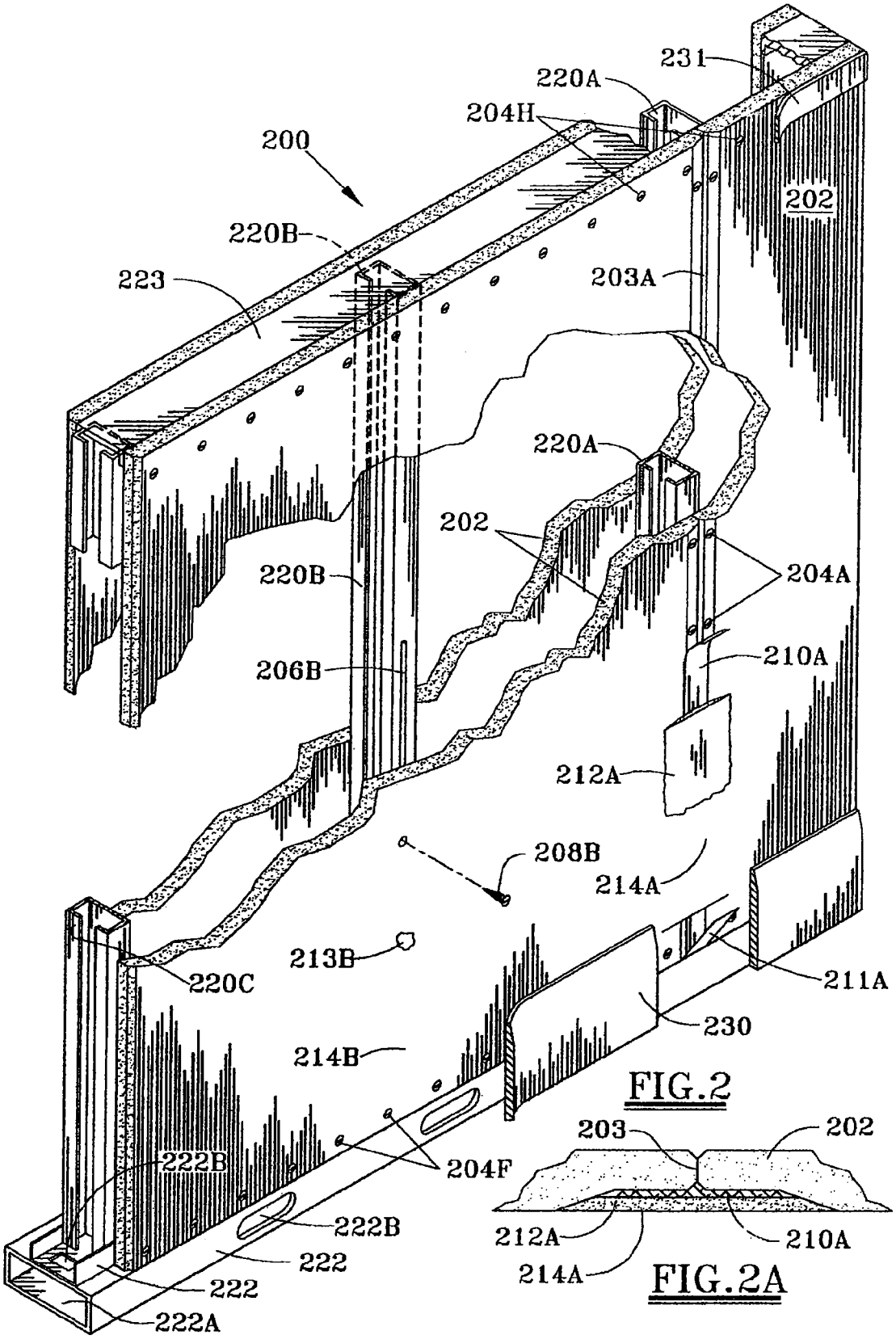

FIG. 2 is another embodiment of the wall system of the present invention where the releasable adhesive is used at the intermediate supports or studs.

FIG. 2A is a plan view cross section of the seam illustrated in FIG. 2 showing the methodology of securing the seams between panels in a wall system.

Figure 2B:
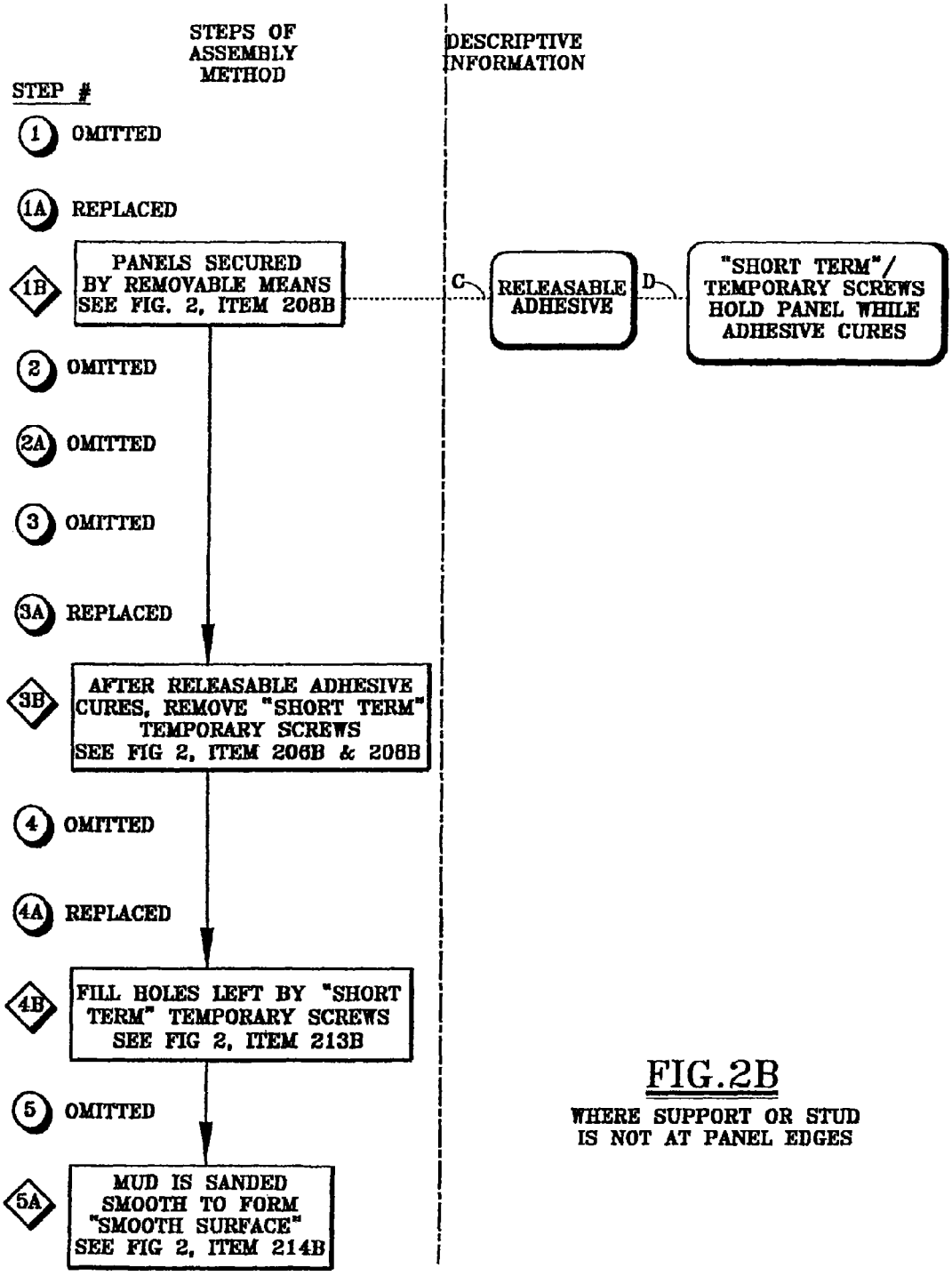

FIG. 2B is a flow chart describing the wall of the present invention as illustrated in FIG. 2.

Figure 2C:
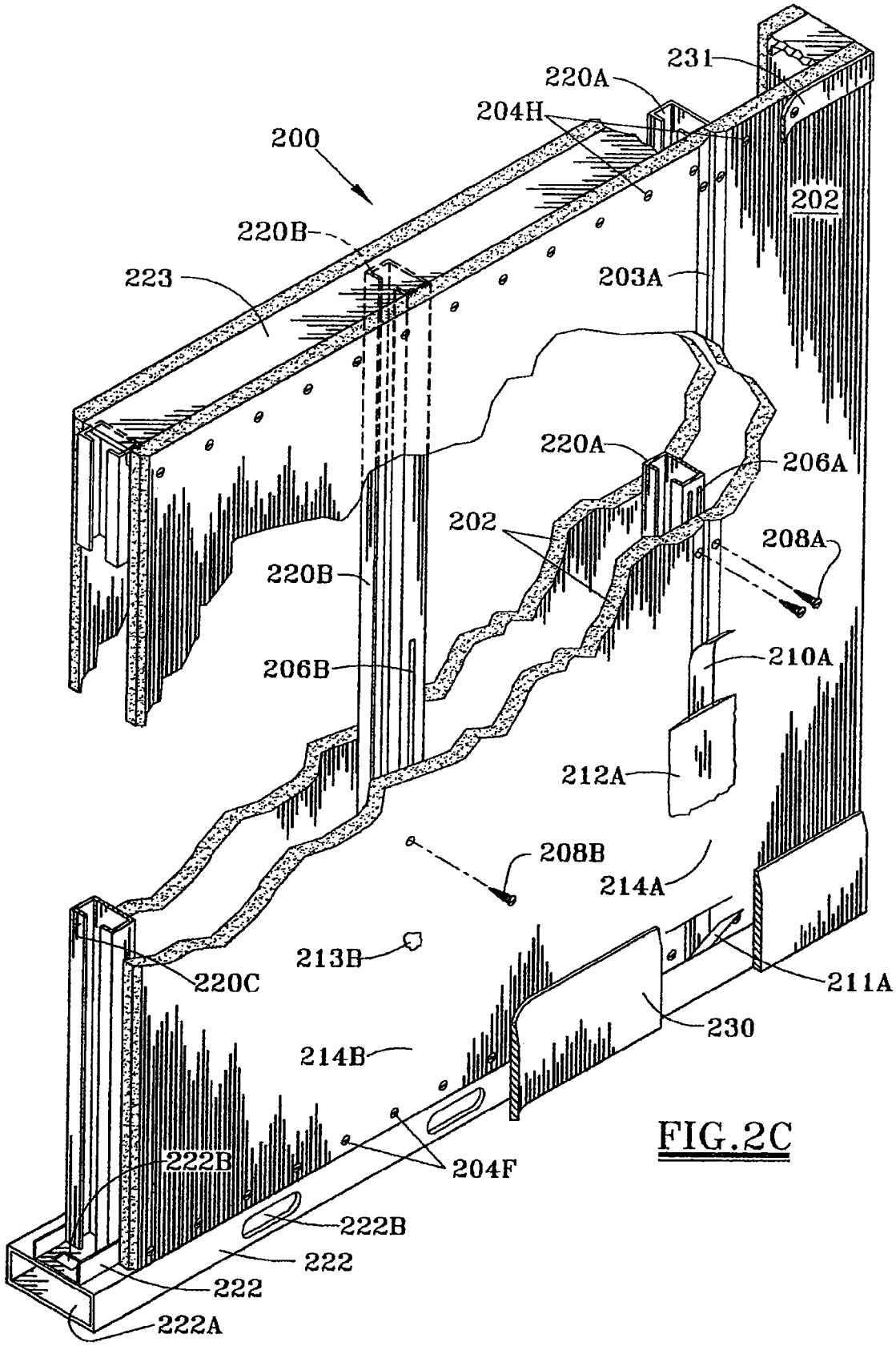

FIG. 2C is an illustration of a preferred embodiment of the wall system of the present invention using releasable adhesive with the supports or studs at the panel edge including an invisible seam and bottom track.

Figure 2D:
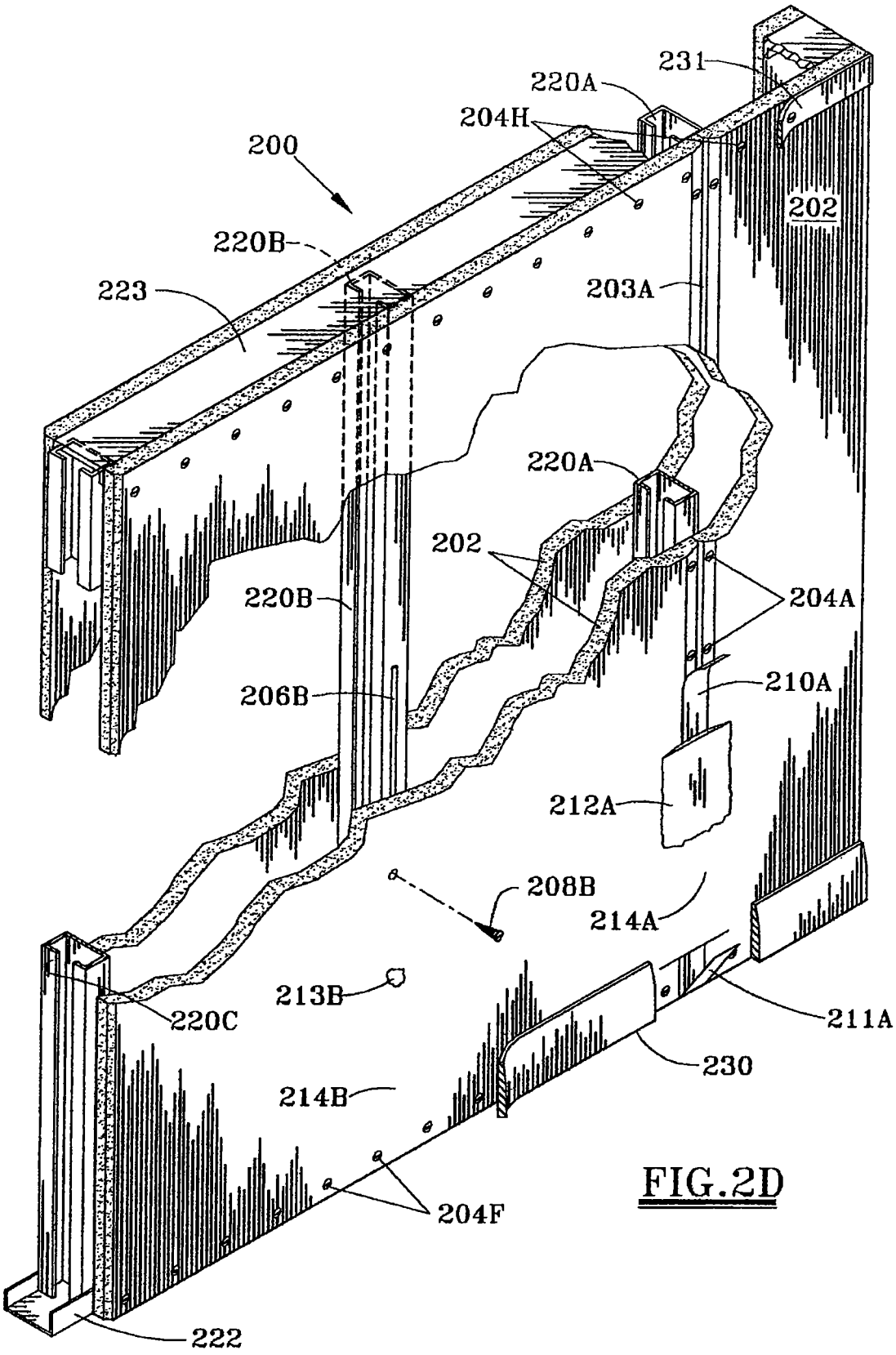

FIG. 2D is an illustration of a preferred embodiment of the wall system of the present invention with the supports or studs at the panel edge including an invisible seam.

Figures 3, 3A:
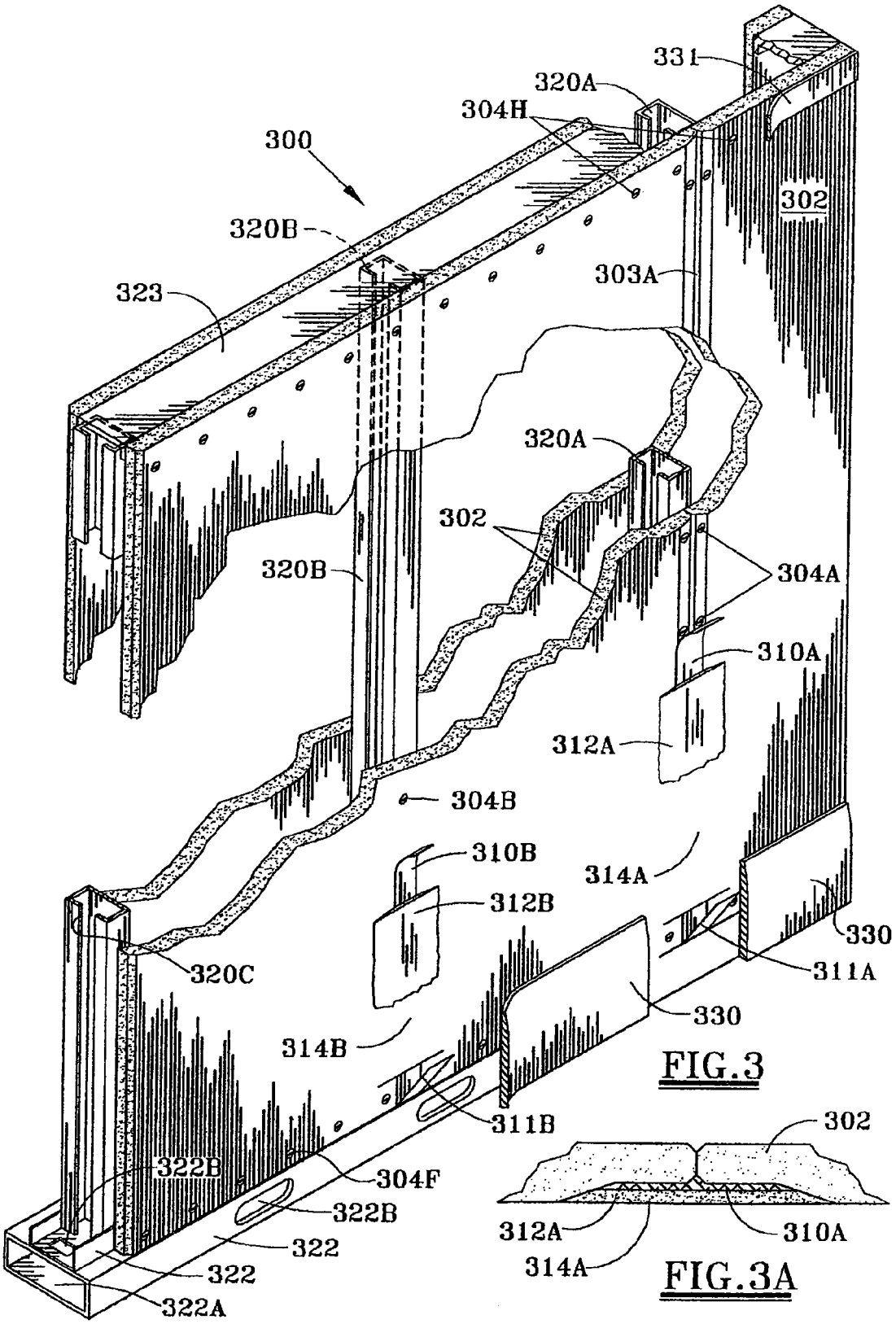

FIG. 3 illustrates yet another preferred embodiment of the wall system of the present invention where zip tape is used at intermediate supports or studs.

FIG. 3A is a plan view cross section of the seam illustrated in FIG. 3 showing the methodology of securing the seams between panels in a wall system.

Figure 3B:
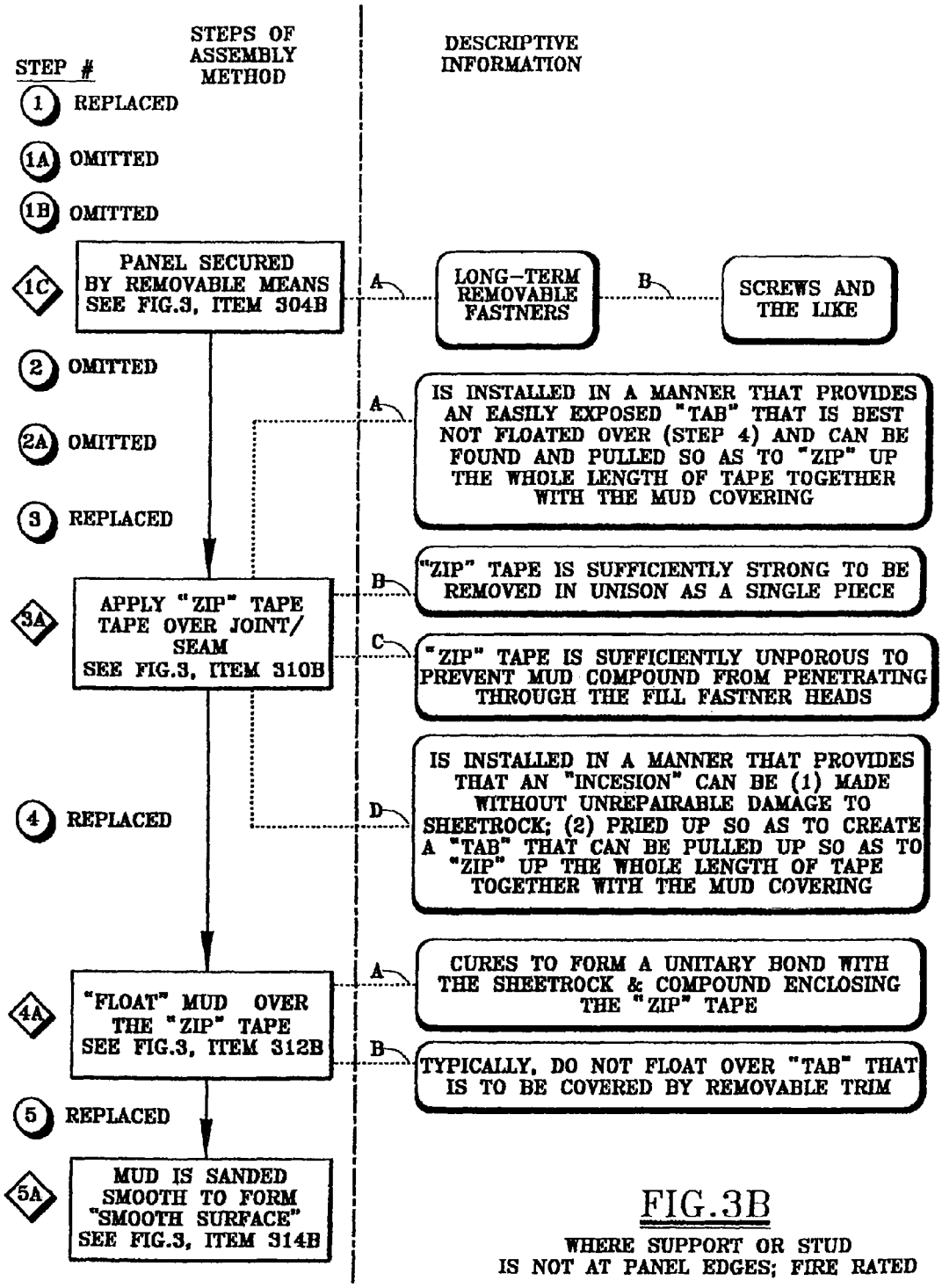

FIG. 3B is a flow chart describing the wall system illustrated in FIG. 3 where the support or stud is not at the panel edges and the panel is secured at the extremities by long term fasteners.

Figure 3C:
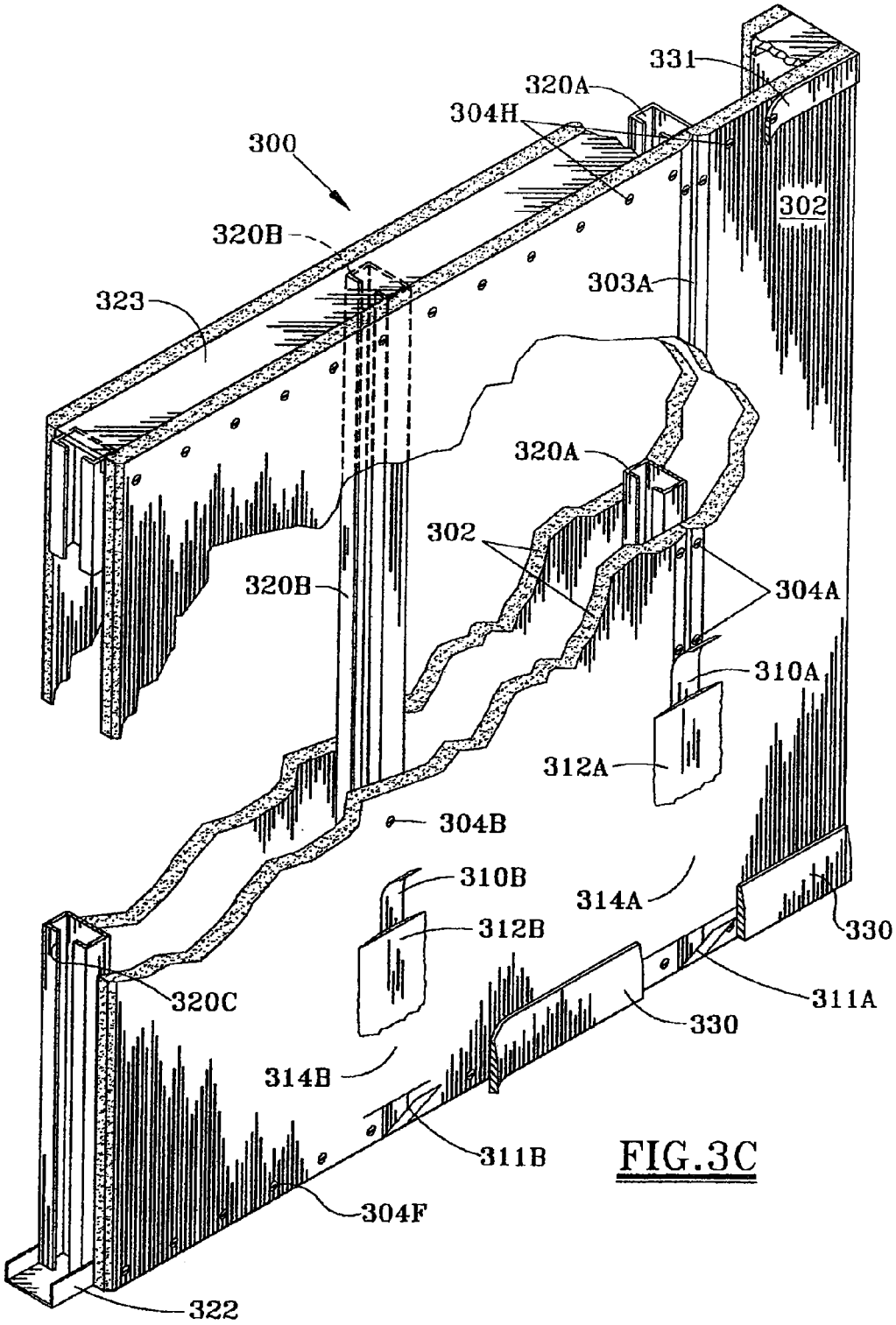

FIG. 3C is an illustration of a preferred embodiment of the wall system of the present invention using releasable adhesive with the supports or studs at the panel edge including an invisible seam and bottom track.

Figures 4, 4A:
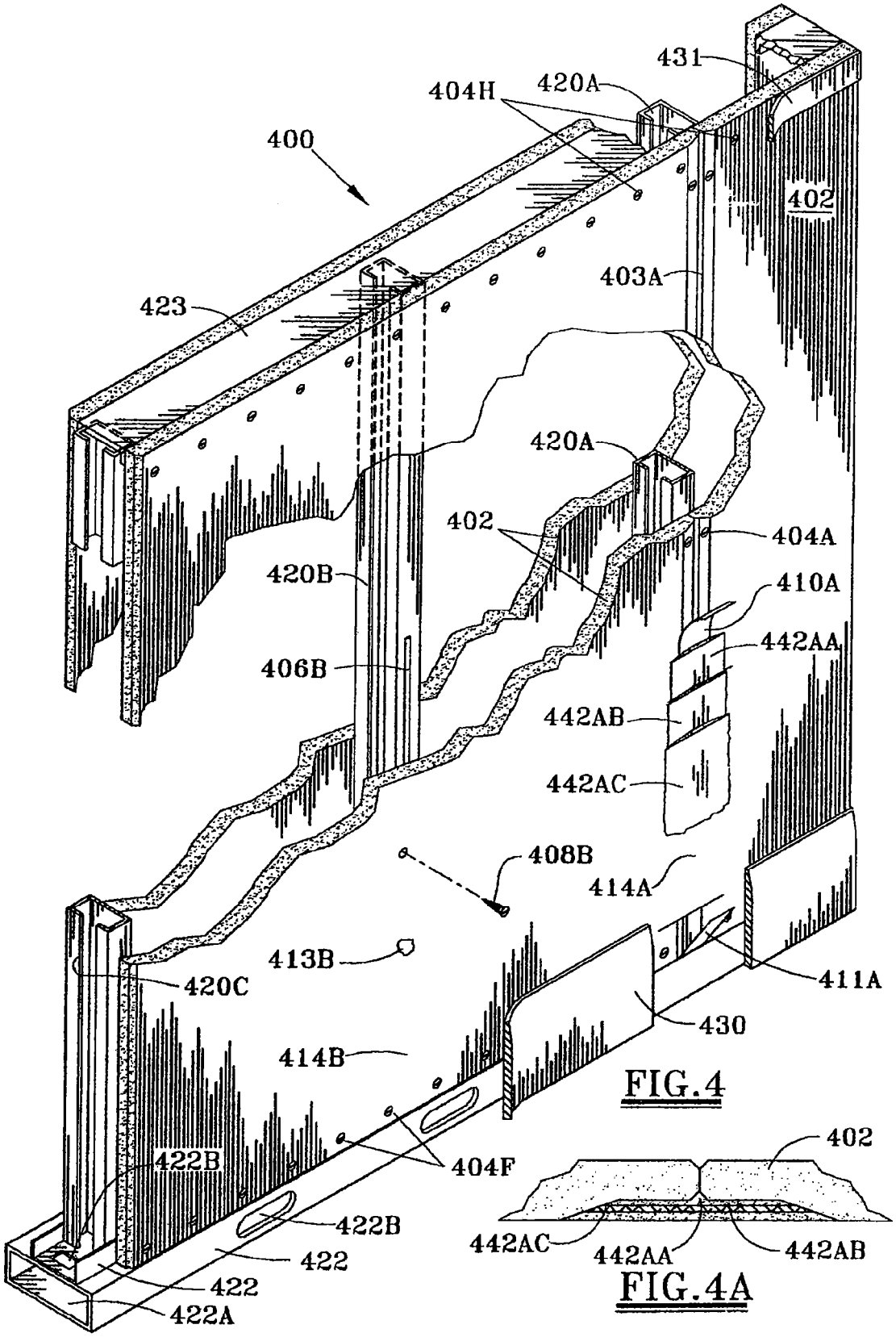

FIG. 4 is an illustration of yet another preferred wall system of the present invention where a removable substance is at the panel edge supports or studs to form an invisible seam.

FIG. 4A is a plan view cross-section illustration of the seam between two panels as illustrated in FIG. 4.

Figure 4B:
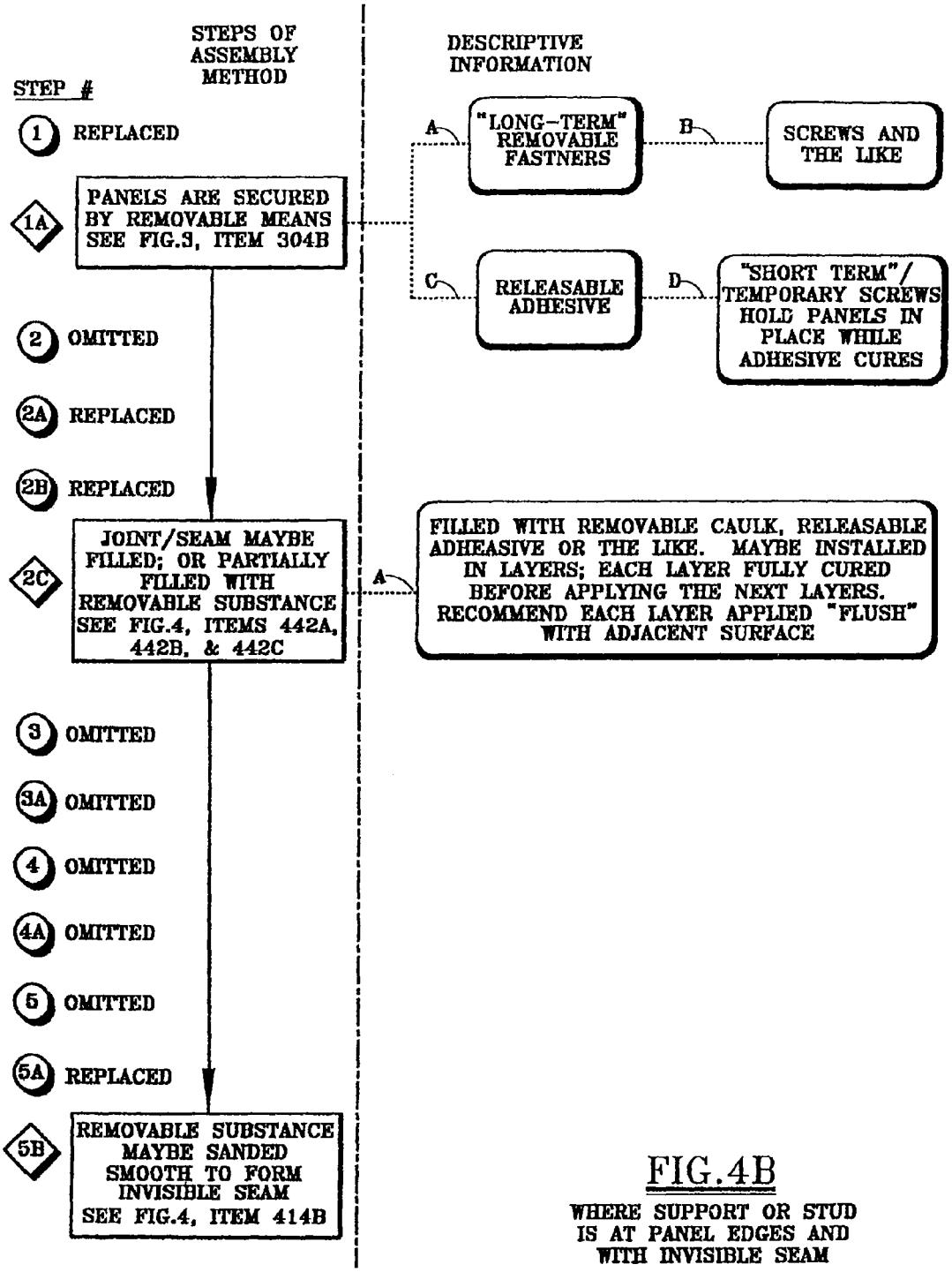

FIG. 4B is a flow chart of the wall system of the present invention as illustrated in FIG. 4 where the support or stud is at the panel edges and the seam is made invisible by the removable substance.

Figure 4C:
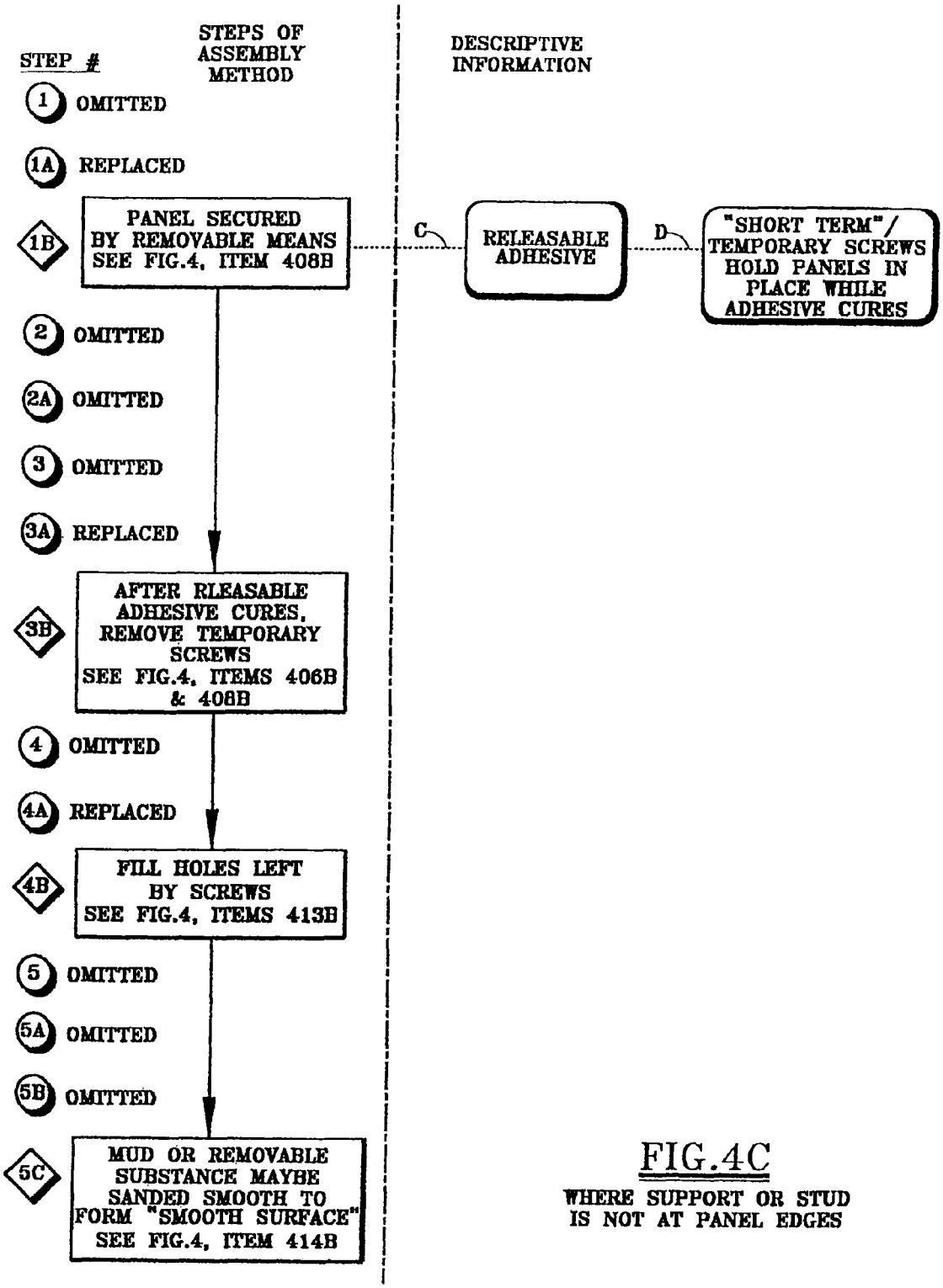

FIG. 4C is a flow chart of the wall system of the present invention as illustrated in FIG. 4 where the support or stud is not at the panel edges.

Figure 4D:
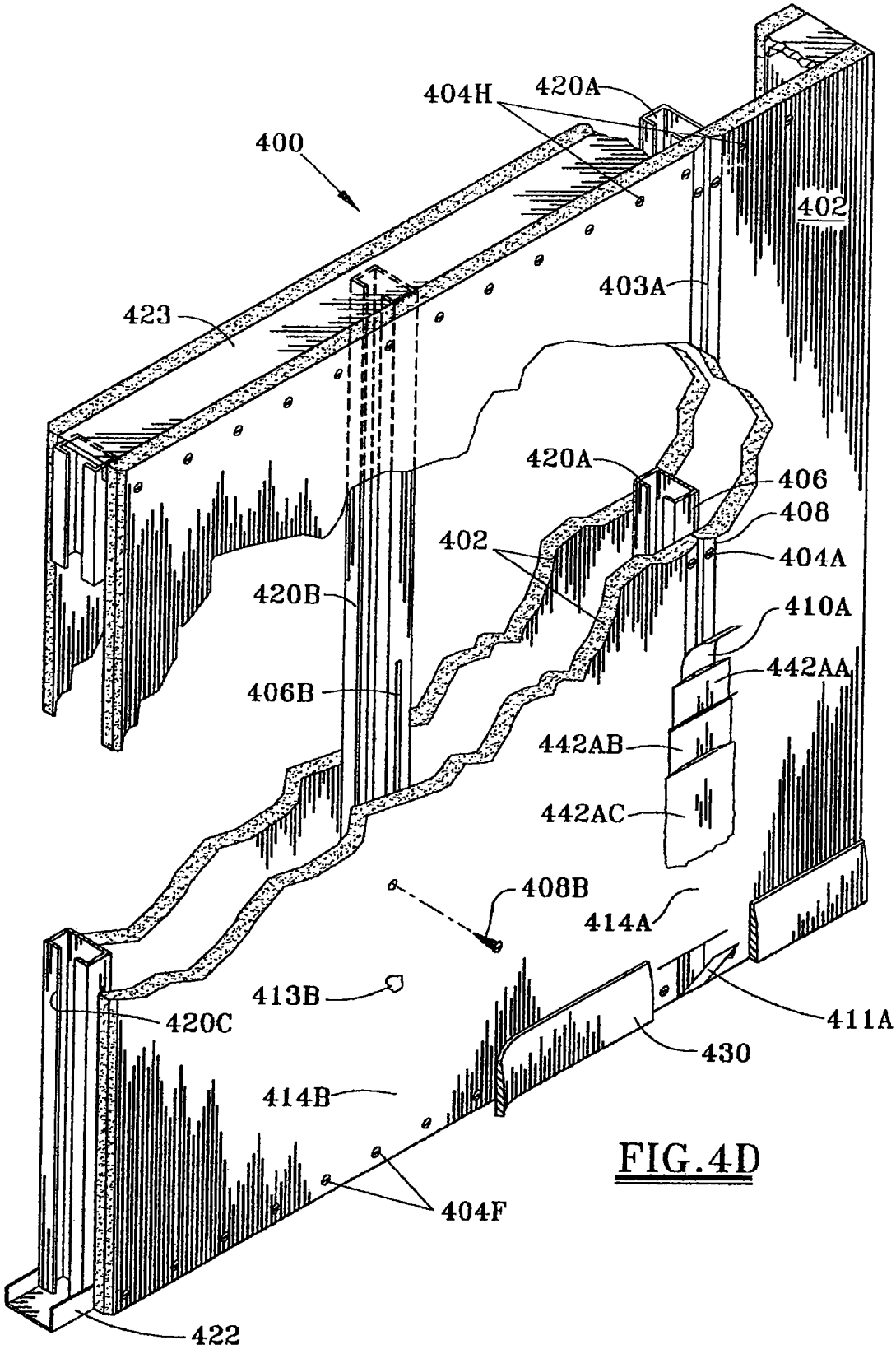

FIG. 4D is an illustration of a preferred embodiment of the wall system of the present invention using releasable adhesive with the supports or studs at the panel edge including an invisible seam and a bottom track.

Figures 5, 5A:
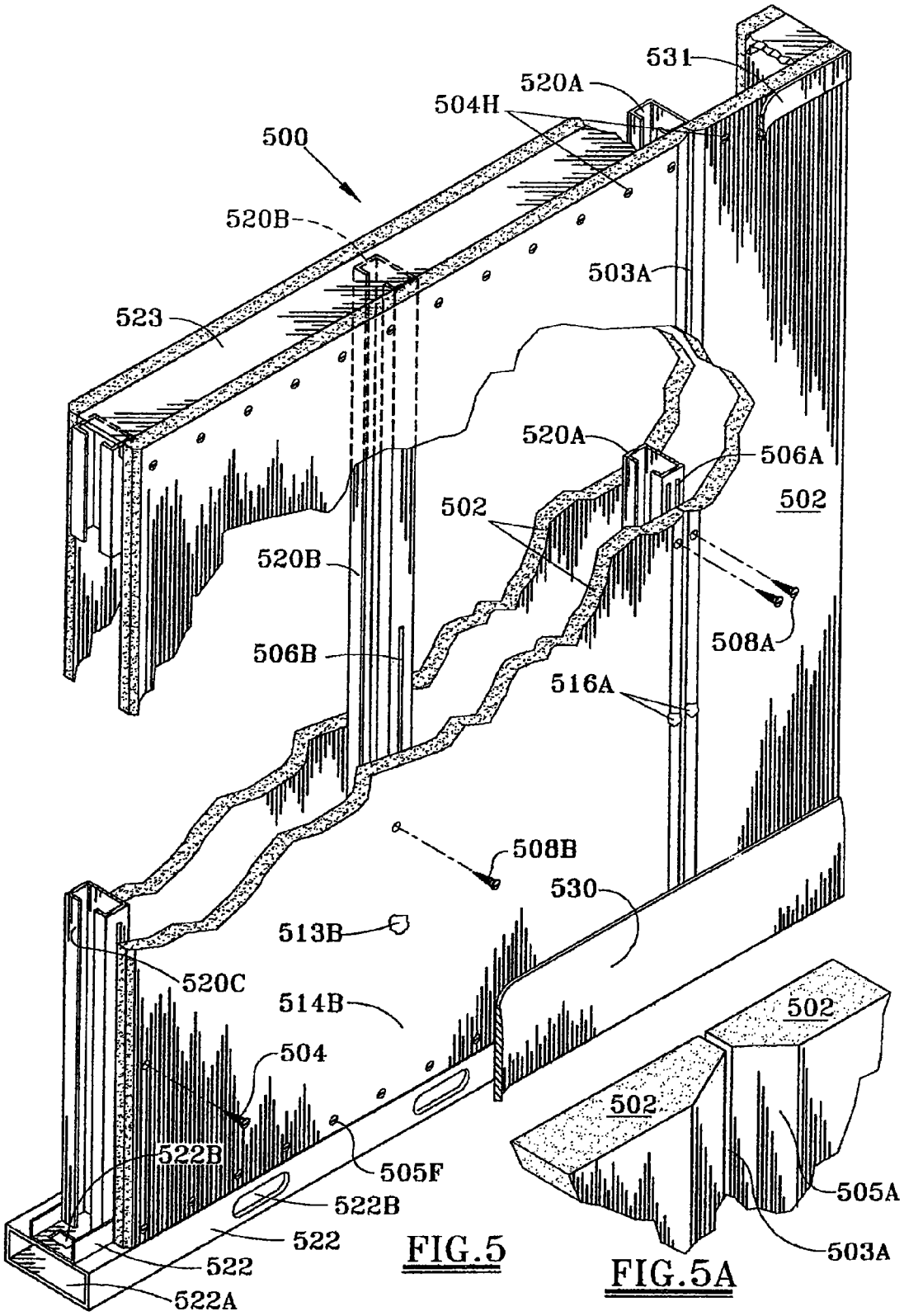

FIG. 5 is yet another preferred embodiment of a wall system of the present invention where releasable adhesive is used at the panel edge supports or studs.

FIG. 5A is a perspective, cross section of the seam associated with the two abutting panels as illustrated in FIG. 5.

Figure 5B:
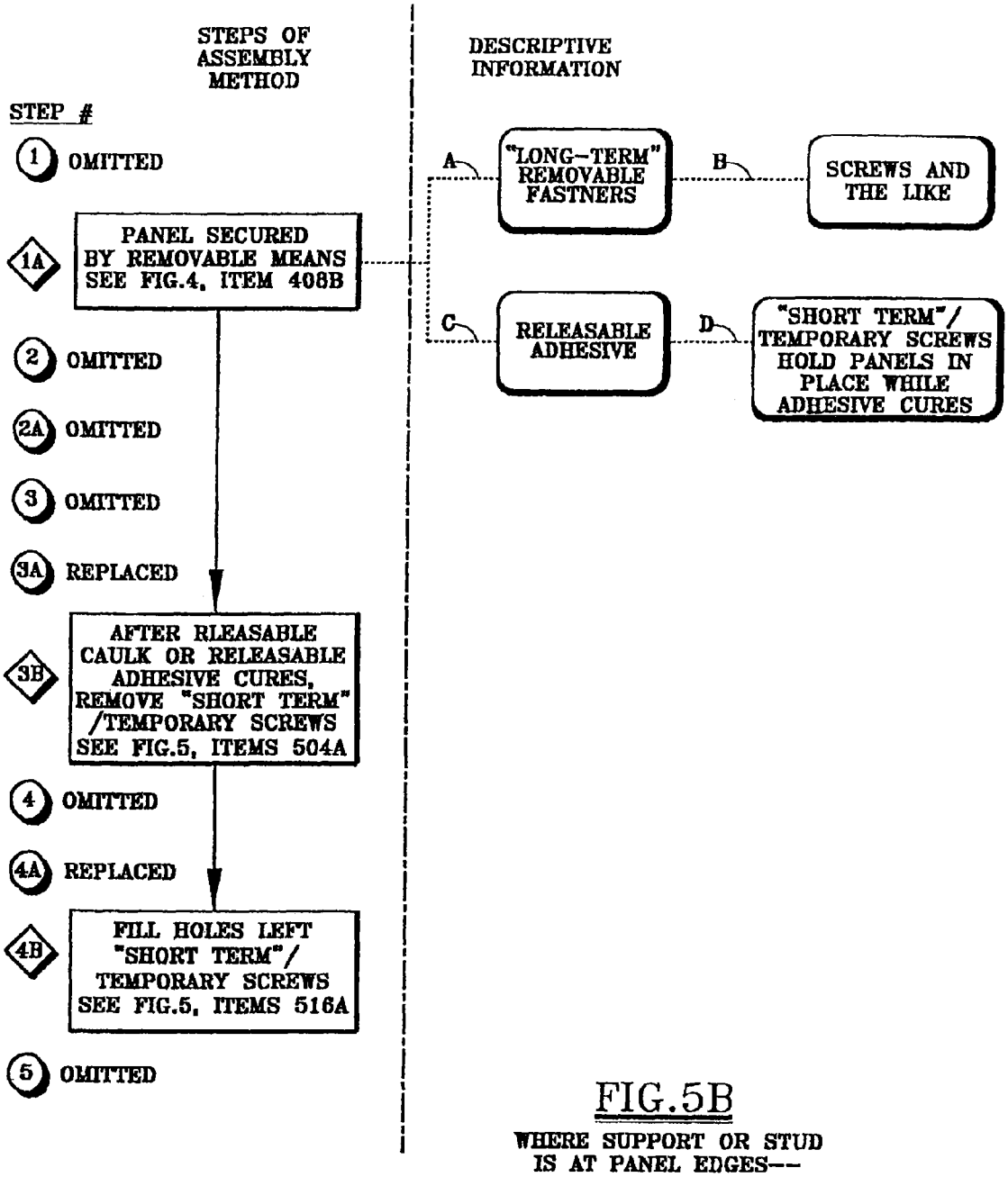

FIG. 5B is a flow chart of the wall system of the present invention as illustrated in FIG. 5 where the support or stud is at the panel edges and the seam is visible.

Figure 5C:
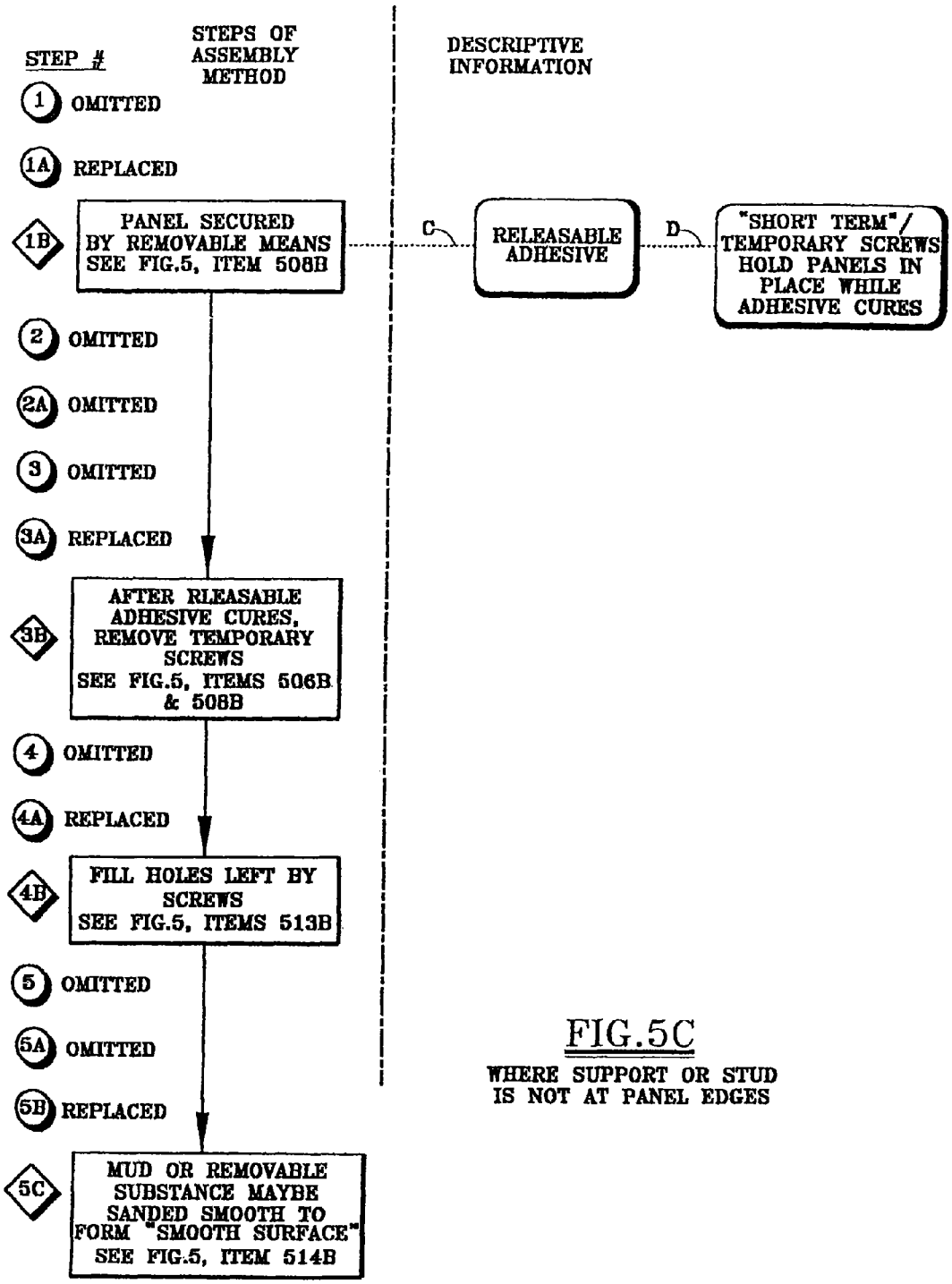

FIG. 5C is a flow chart of the wall system of the present invention as illustrated in FIG. 5 where the support or stud is not at the panel edges.

Figure 5D:
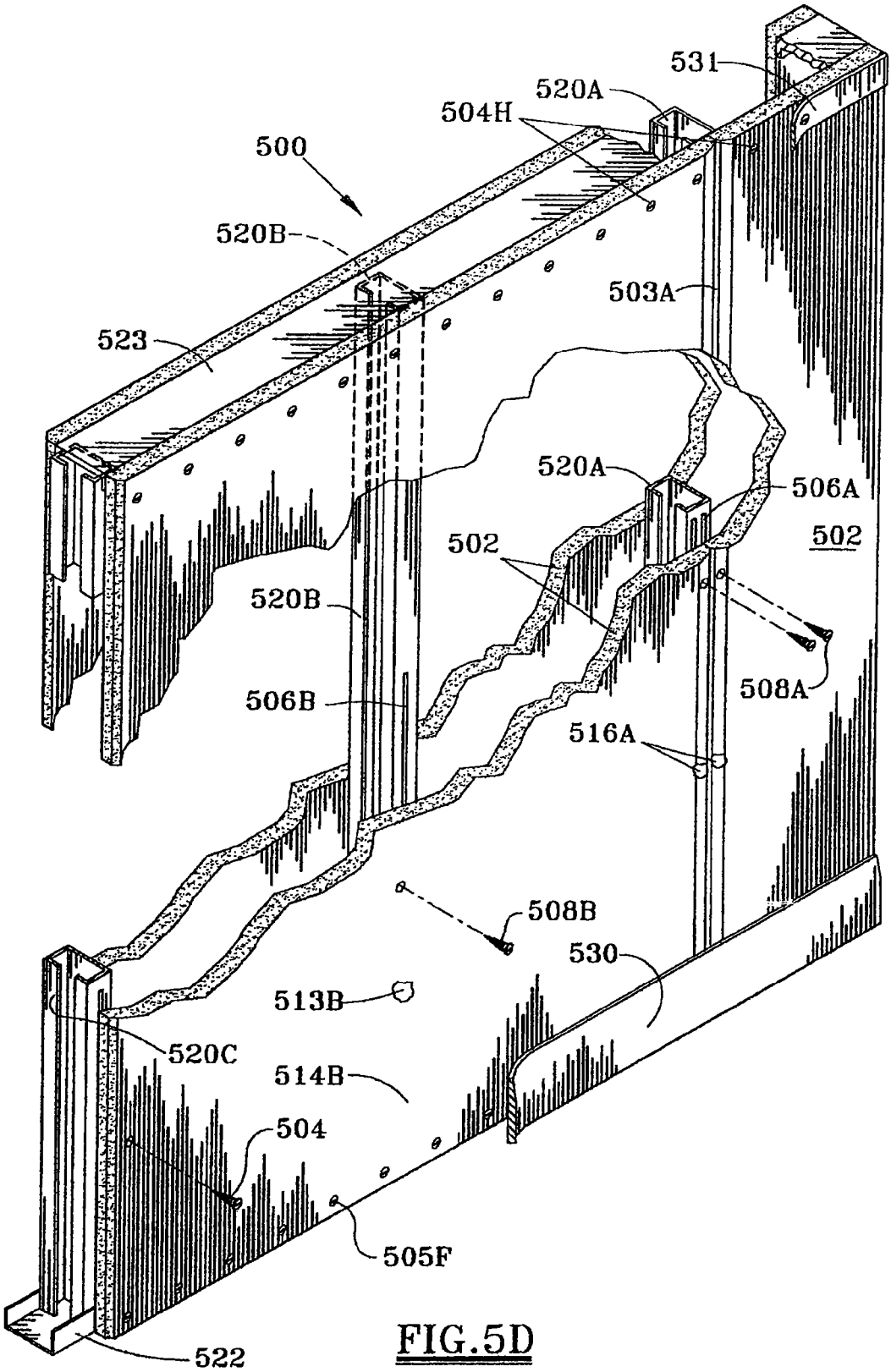

FIG. 5D is an illustration of a preferred embodiment of the wall system of the present invention using releasable adhesive with the supports or studs at the panel edge including an invisible seam and bottom track.

Figure 6:
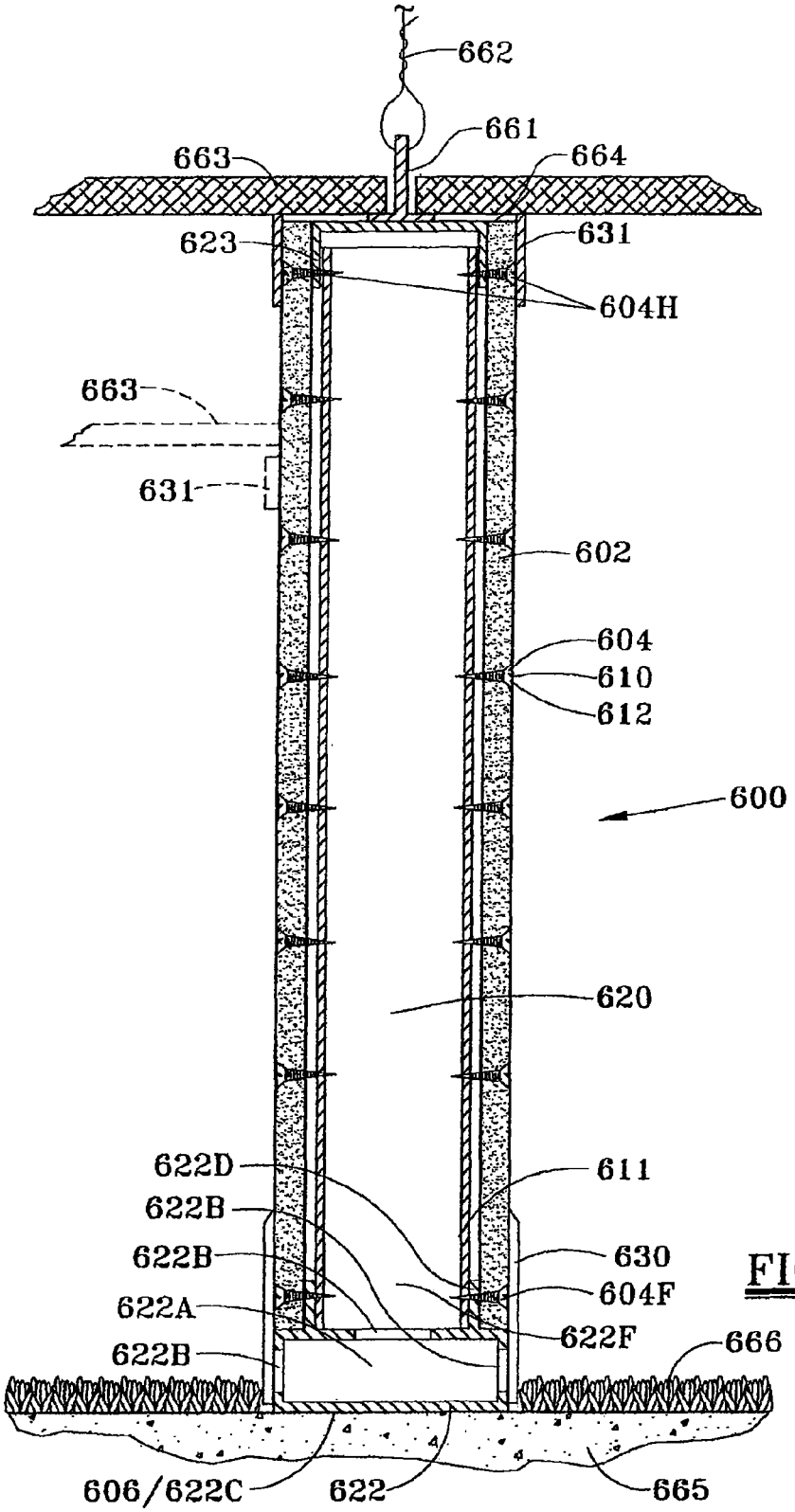

FIG. 6 illustrates a cross section of a wall system of the present invention with a wall panel removably engaged with a removable floor or bottom track and a removable head track.

Figure 7:
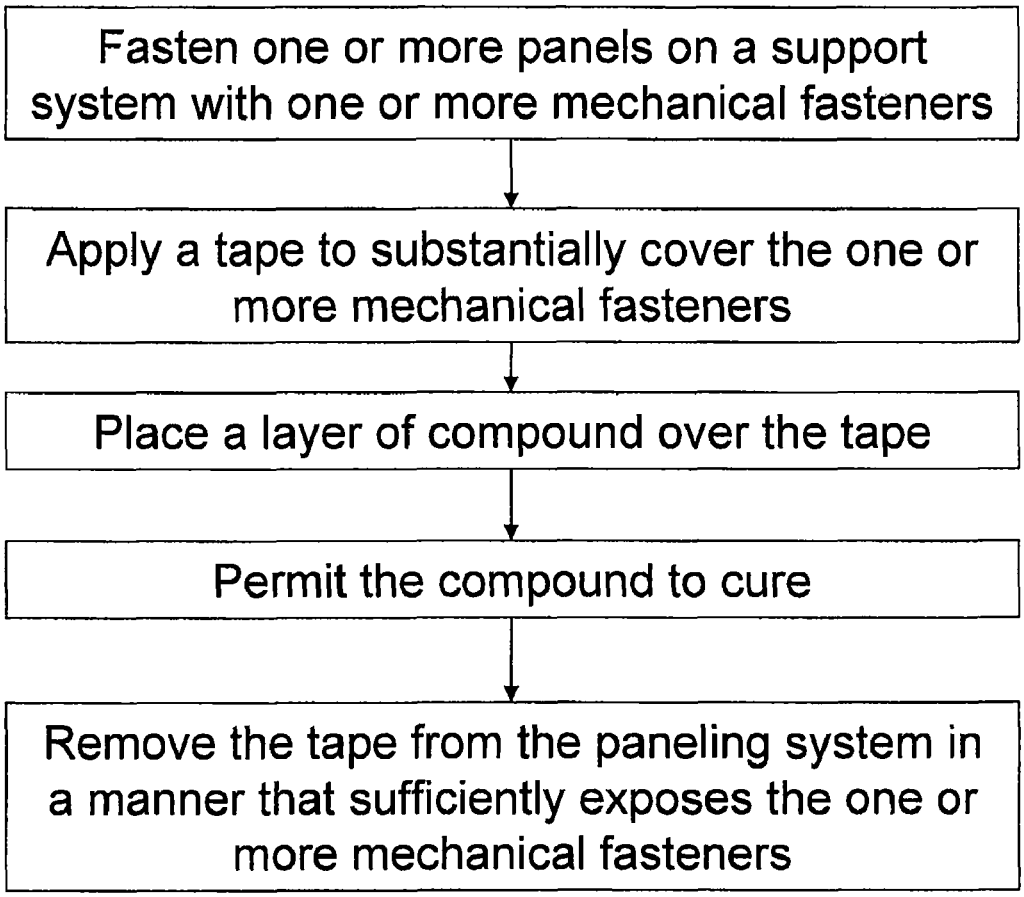

FIG. 7 is a flow chart for a method of assembling a paneling system.

Figure 8:
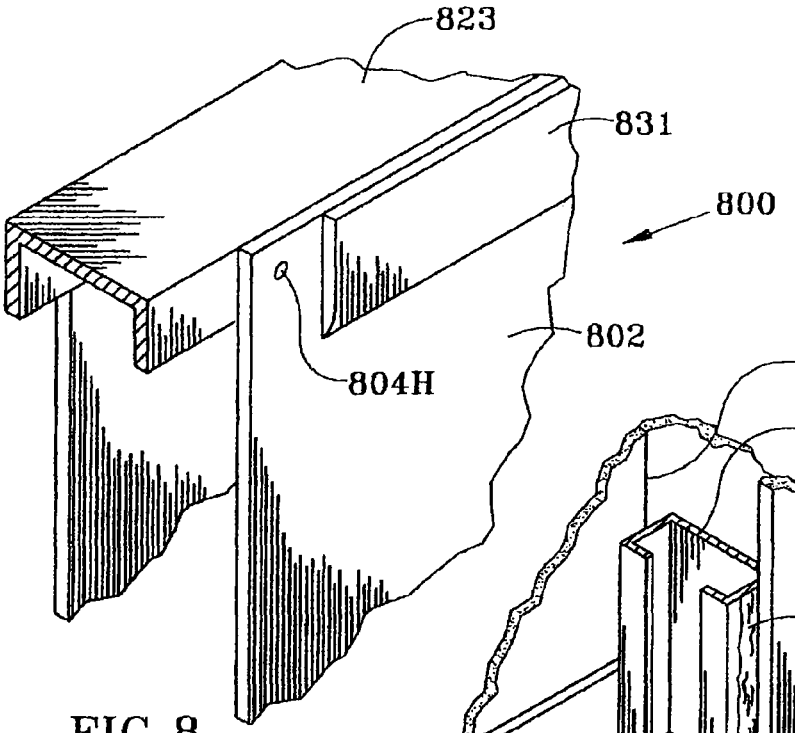

FIG. 8 is a partial cutaway of an upper proportion of the wall system of the present invention illustrating a head track in association with the wall panels.

Figure 9:
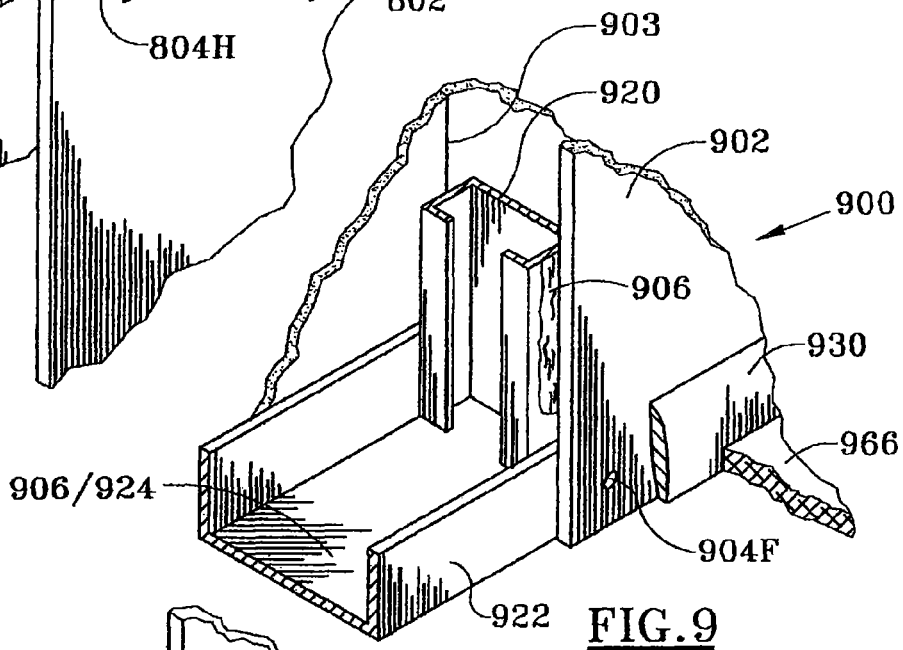

FIG. 9 illustrates a partial section of a lower portion of the wall system of the present invention with a removable bottom track in association with the wall panels.

Figure 10:
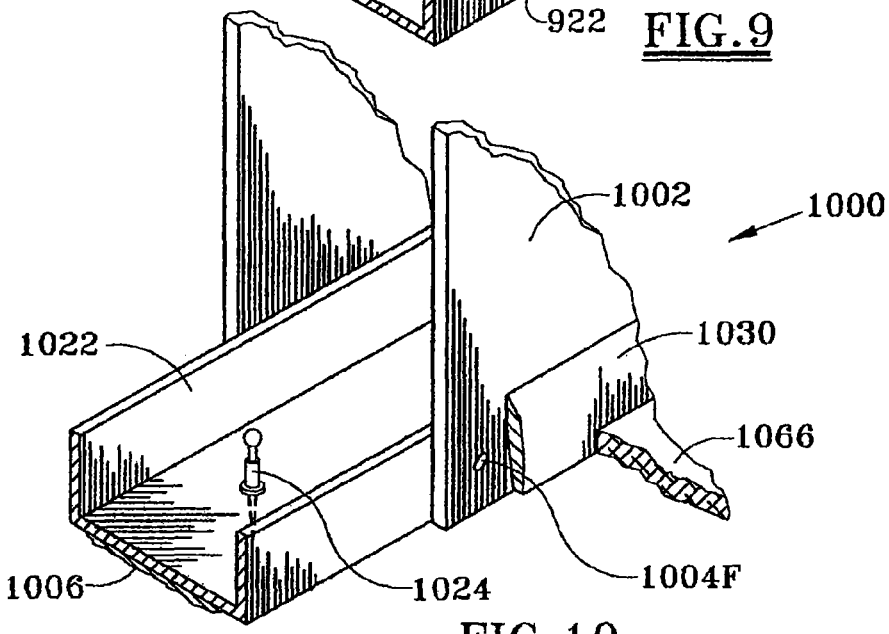

FIG. 10 illustrates yet another embodiment of a wall system of the present invention showing a partial cross-section of a wall panel in association with a removable bottom track.

Figure 11:
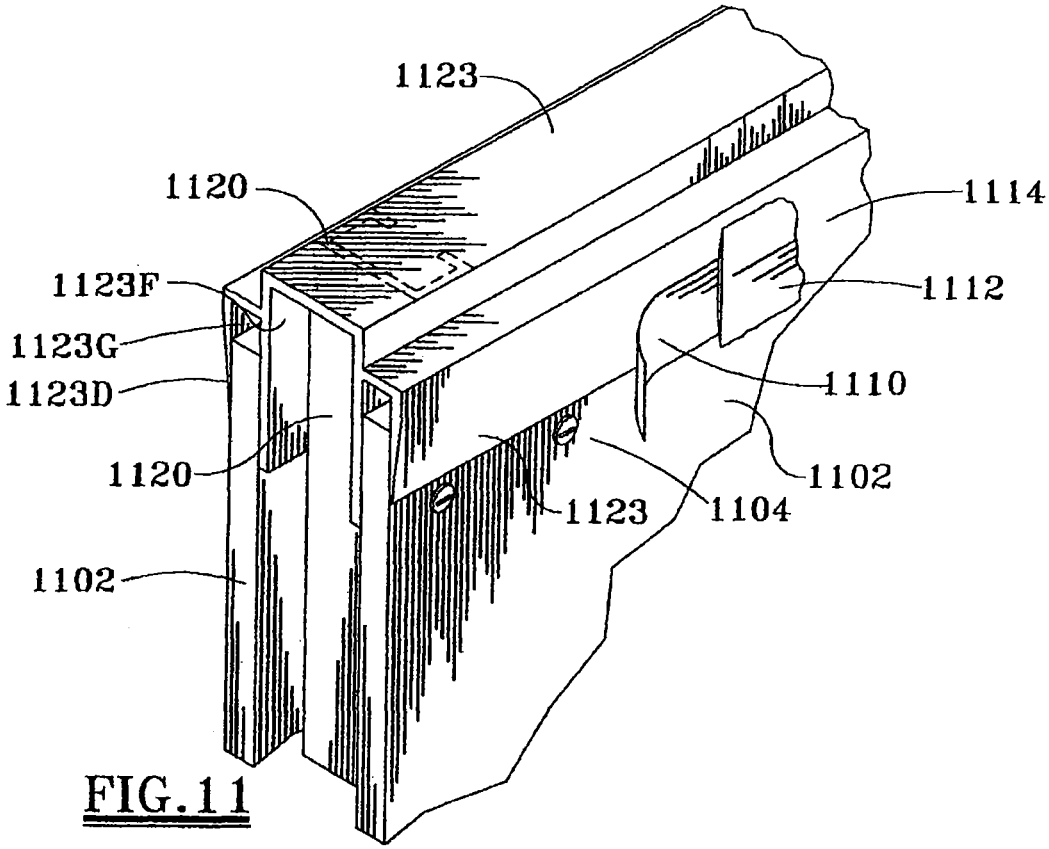

FIG. 11 is an illustration of a tri-channel head track for use in association with the wall system of the present invention.

Figure 11A:
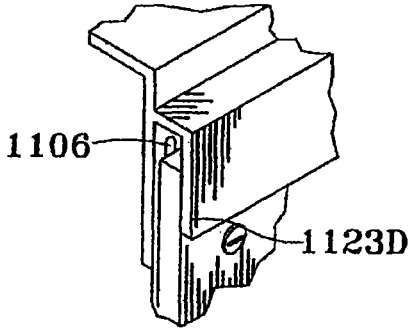

FIG. 11A is an illustration of the tri-channel head track for use in association with the wall system of the present invention as illustrated in FIG. 11 having an unfeathered extension and releasable adhesive.

Figure 11B:
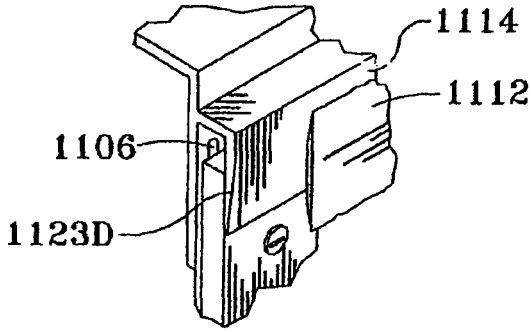

FIG. 11B is an illustration of the tri-channel head track for use in association with the wall system of the present invention as illustrated in FIG. 11 having a feathered extension and releasable adhesive.

Figure 12:
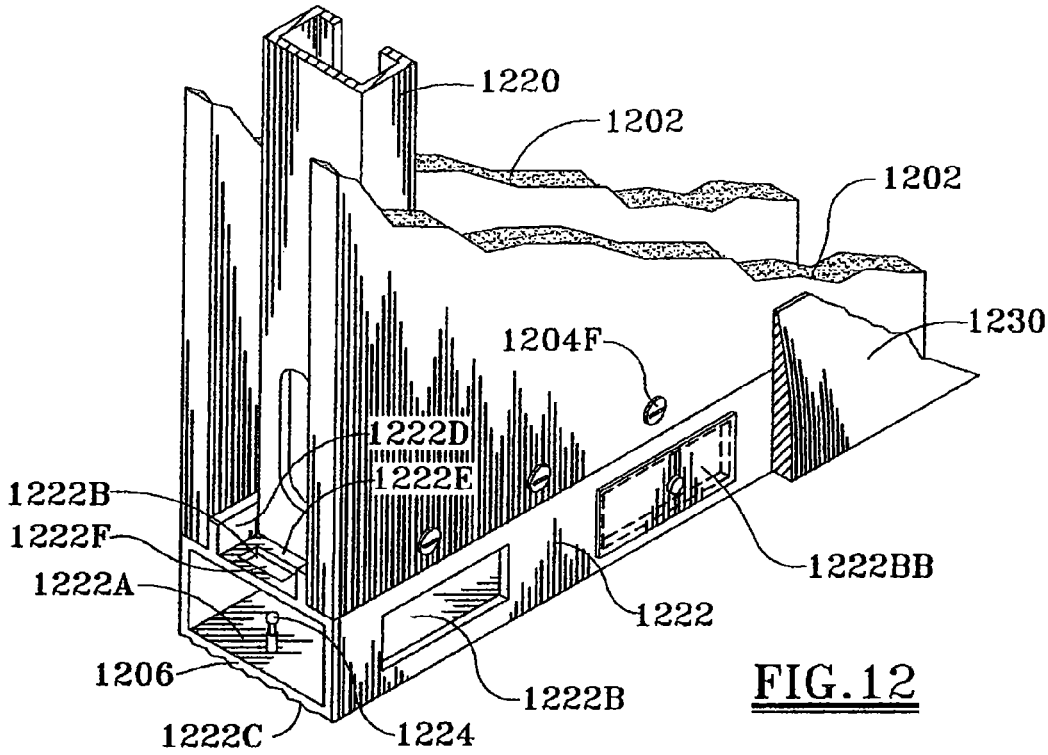

FIG. 12 is a sectional illustration of a tri-channel bottom track used in association with the wall system of the present invention having an enclosed data channel.

Figure 12A:
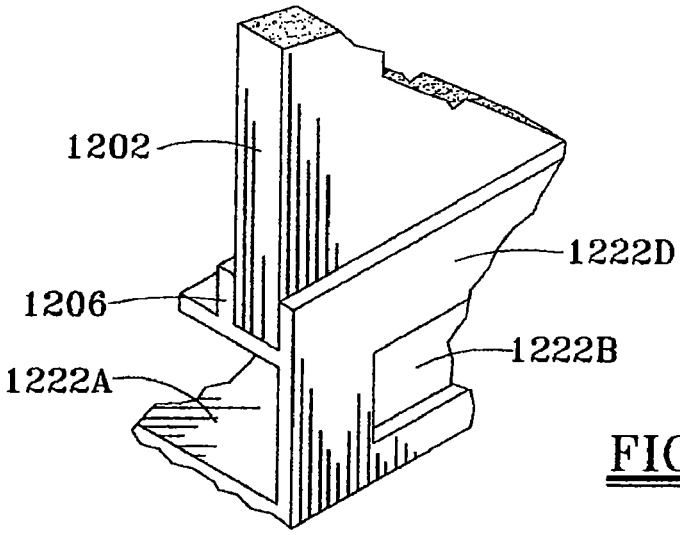

FIG. 12A is a sectional illustration of a tri-channel bottom track used in association with the wall system of the present invention having an enclosed data channel and using removable adhesive.

Figure 13:
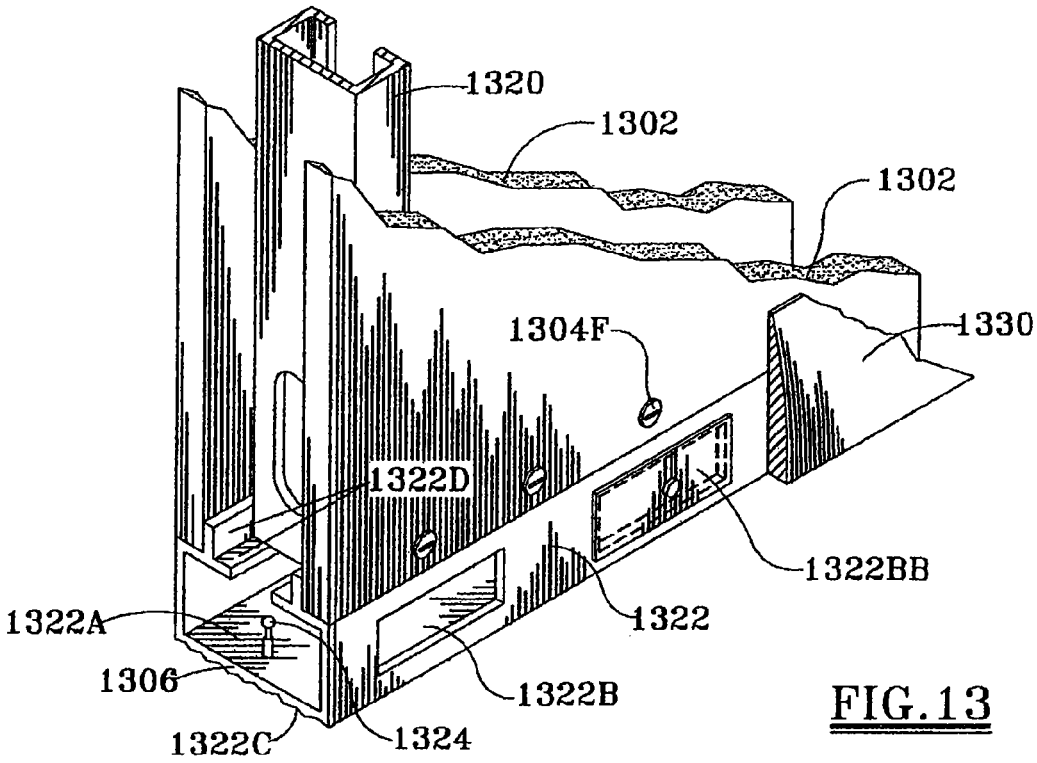

FIG. 13 is sectional view of a quad-channel bottom track used with the wall system of the present invention having a slotted data channel.

Figure 13A:
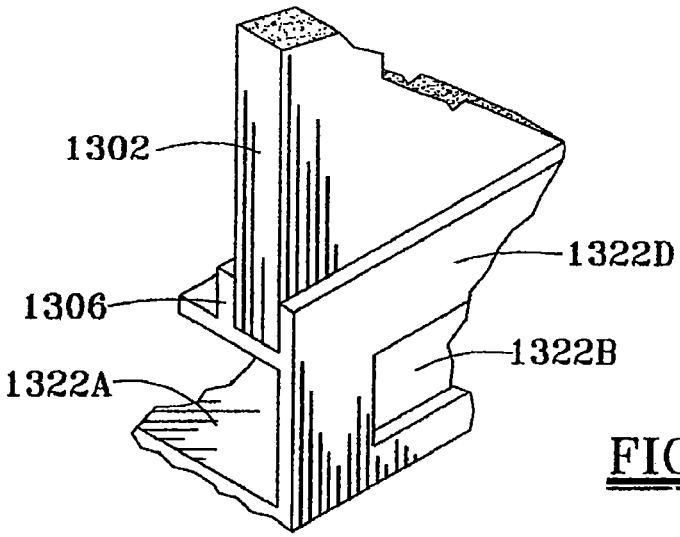

FIG. 13A is a sectional illustration of a tri-channel bottom track used in association with the wall system of the present invention having an enclosed data channel and using removable adhesive.

Figure 14:
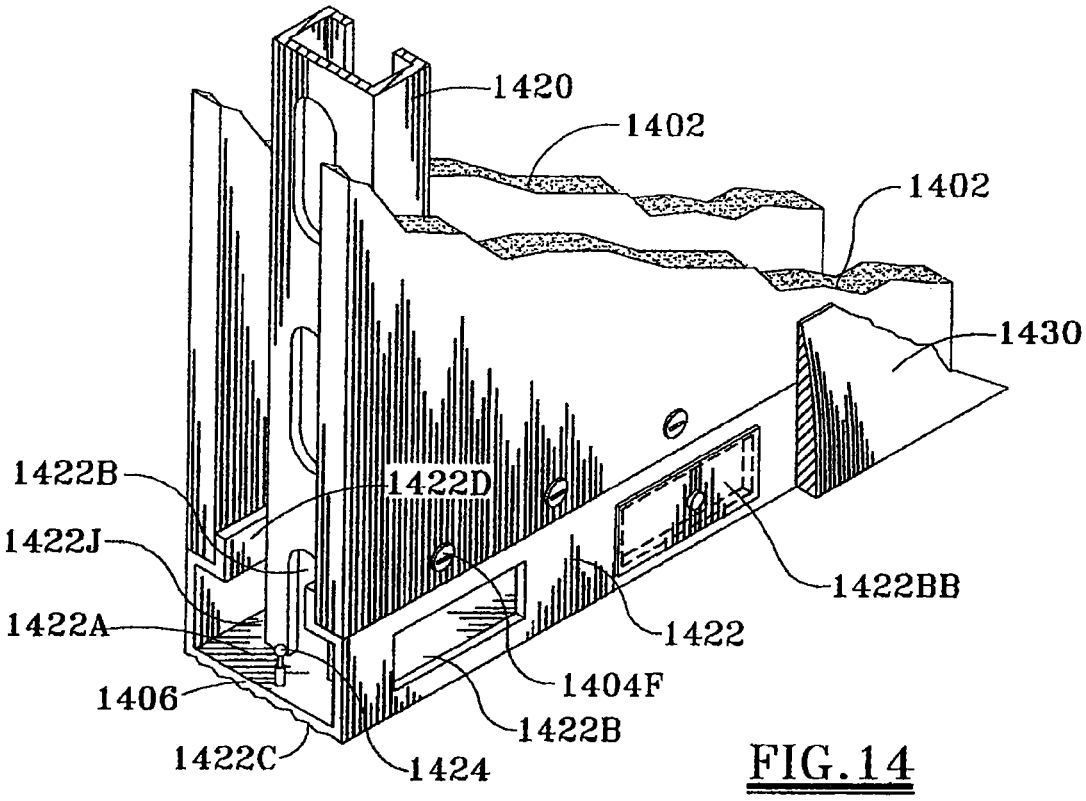

FIG. 14 is yet another embodiment of the tri-channel bottom track for use with the wall system of the present invention having a slotted data channel for receiving the studs.

Figure 14A:
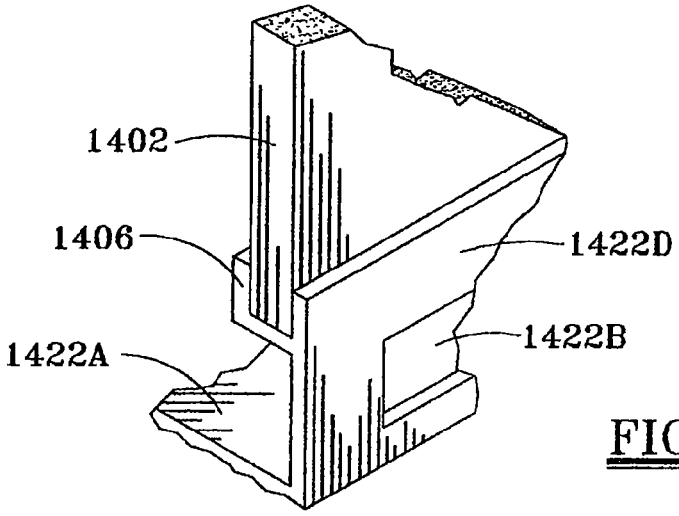

FIG. 14A is a sectional illustration of a tri-channel bottom track used in association with the wall system of the present invention having an enclosed data channel and using removable adhesive.

Figure 15:
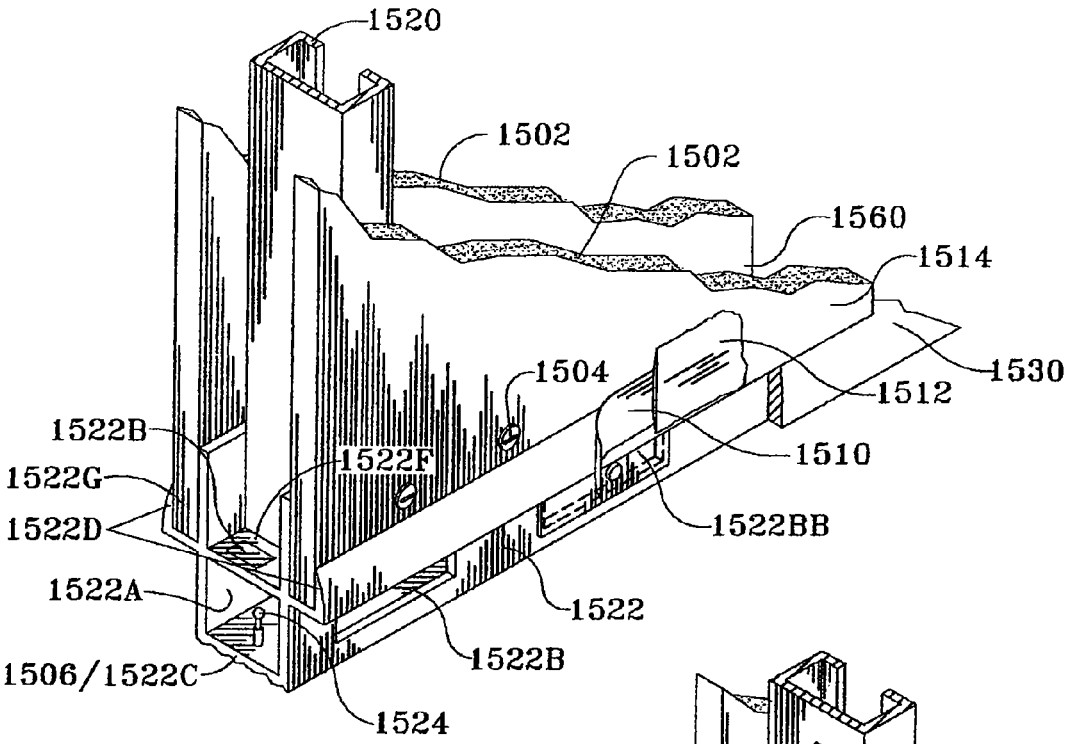

FIG. 15 is a sectional illustration of another tri-channel bottom track used in association with the wall system of the present invention having an enclosed data channel.

Figure 15A:
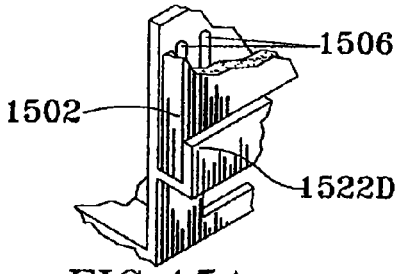

FIG. 15A is a sectional illustration of another tri-channel bottom track used in association with the wall system of the present invention having an enclosed data channel as illustrated in FIG. 15 and having an unfeathered extension and releasable adhesive.

Figure 15B:
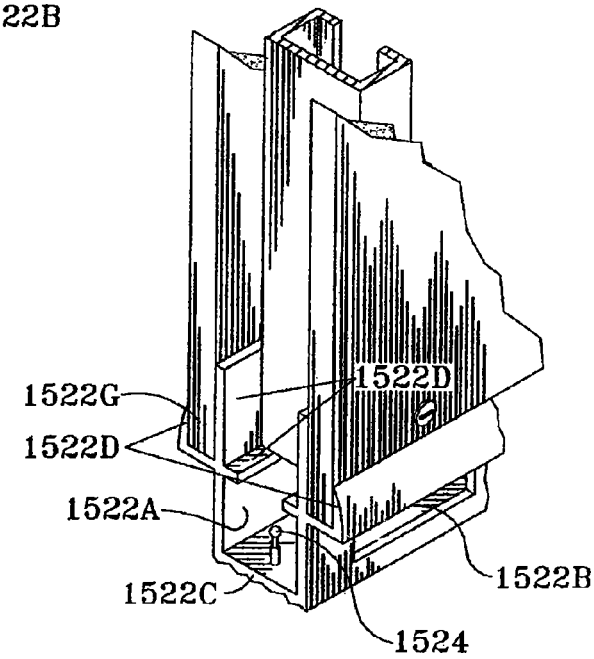

FIG. 15B is a sectional illustration of another tri-channel bottom track used in association with the wall system of the present invention having an enclosed data channel as illustrated in FIG. 15 and having a feathered extension and releasable adhesive.

Figure 16:
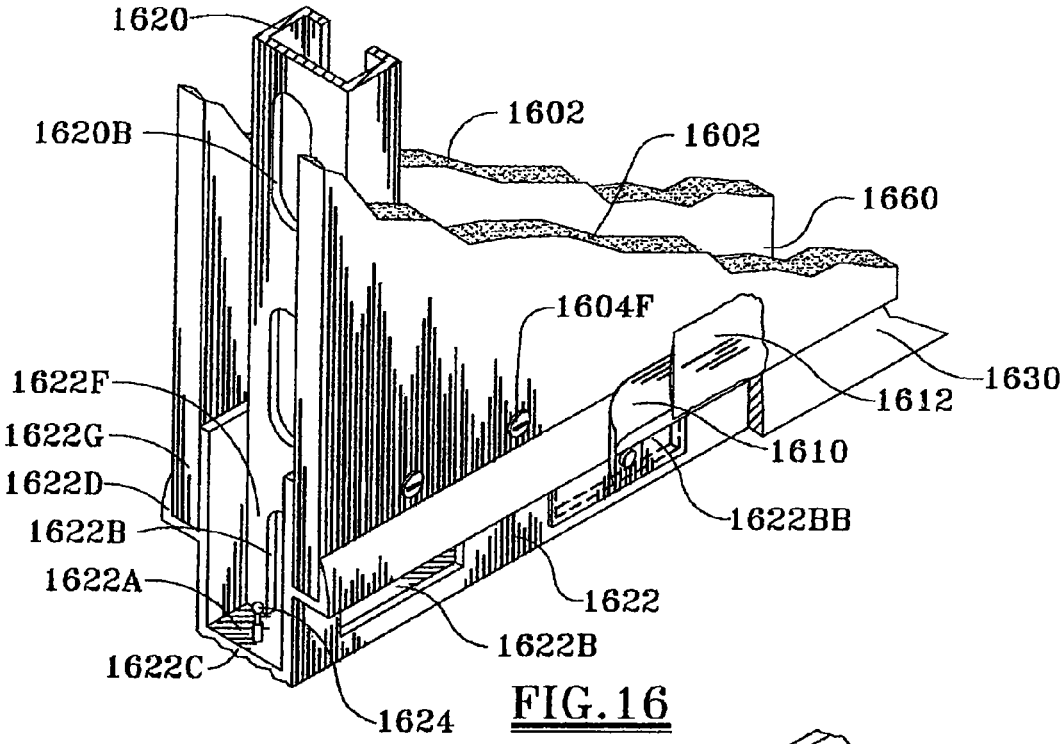

FIG. 16 is yet another embodiment of the tri-channel bottom track for use with the wall system of the present invention having a slotted data channel for receiving the studs.

Figure 16A:
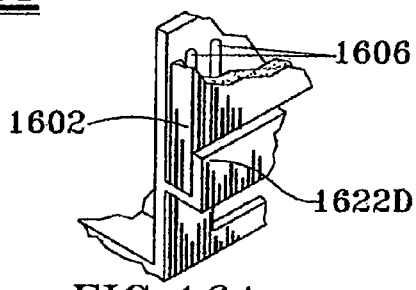

FIG. 16A is a sectional illustration of another tri-channel bottom track used in association with the wall system of the present invention having an enclosed data channel as illustrated in FIG. 16 and having an unfeathered extension and releasable adhesive.

Figure 17:
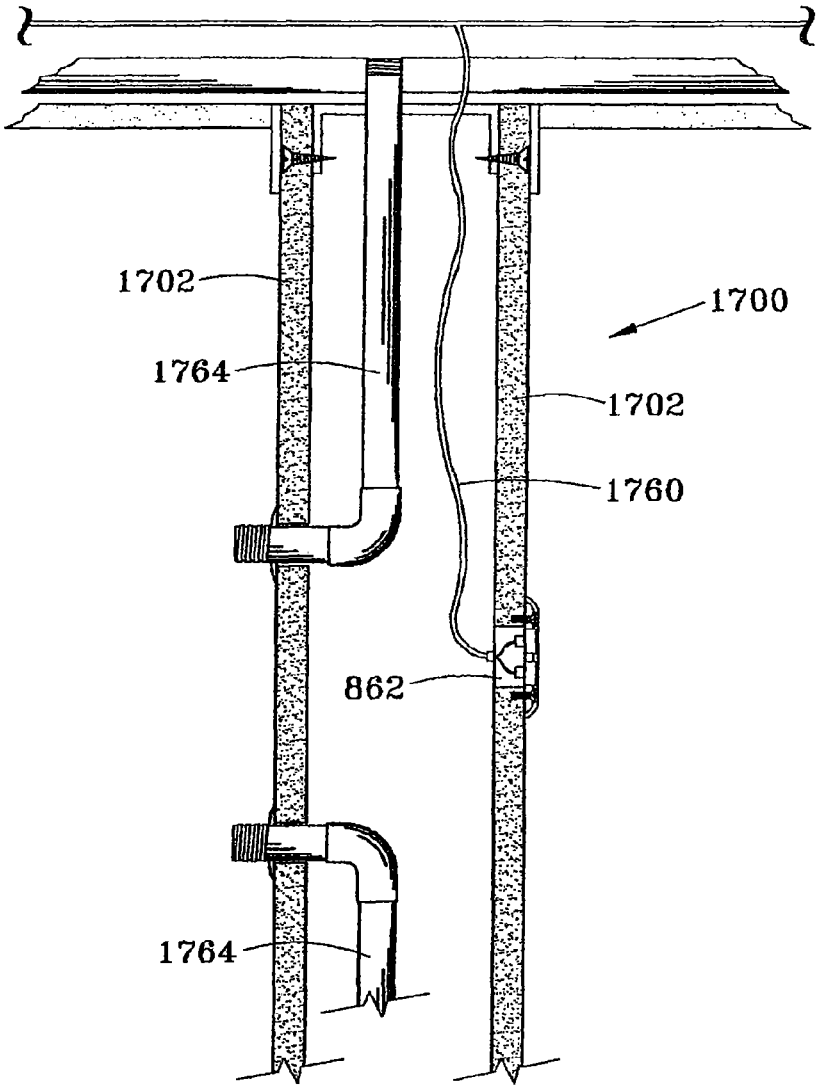

FIG. 17 illustrates a cross section of a wall system of the present invention with a wall panel removably engaged with removable electrical and plumbing fixtures.

Figure 18:
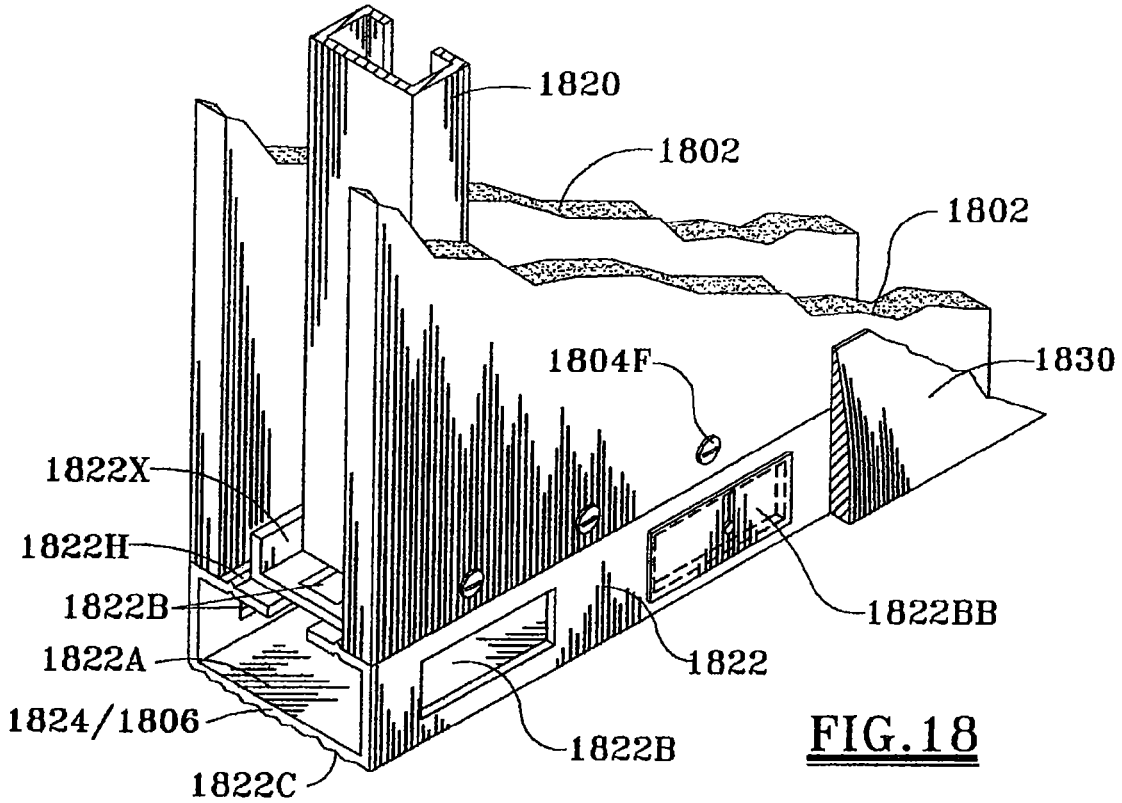

FIG. 18 is a sectional illustration of a tri-channel bottom track used in association with the wall system of the present invention having elements that are bendable metal.

Figure 19:
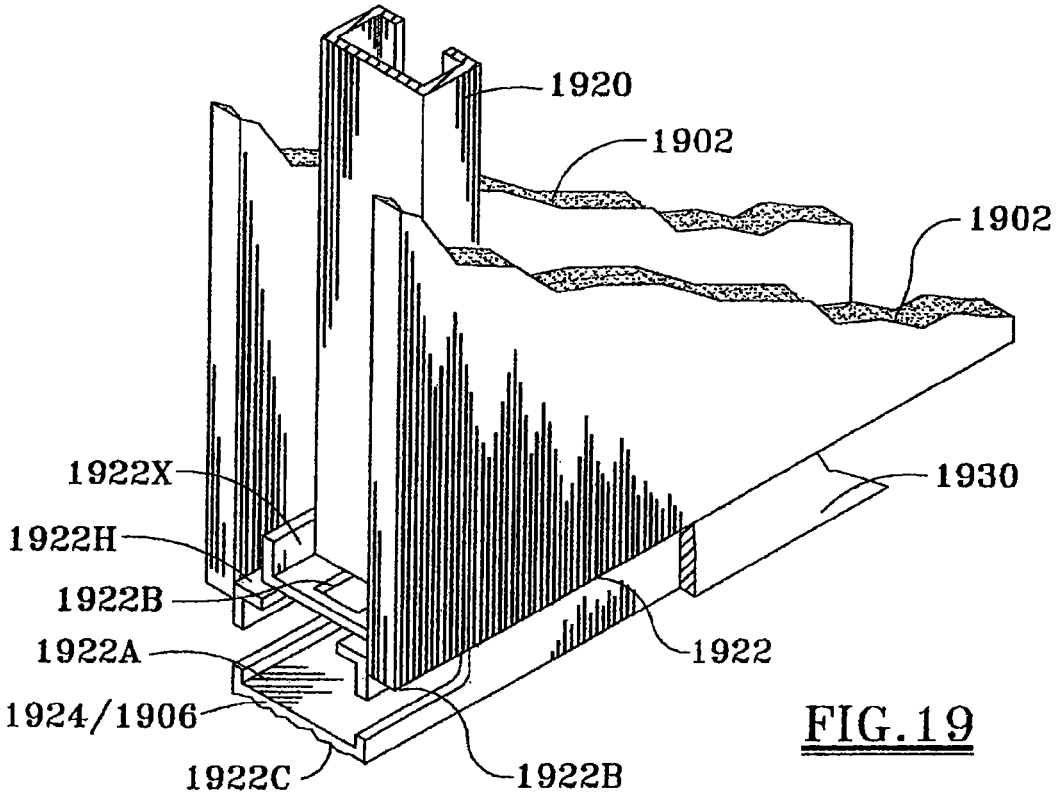

FIG. 19 is a sectional illustration of another embodiment of a tri-channel bottom track used in association with the wall system of the present invention having elements that are bendable metal.

Figure 20:
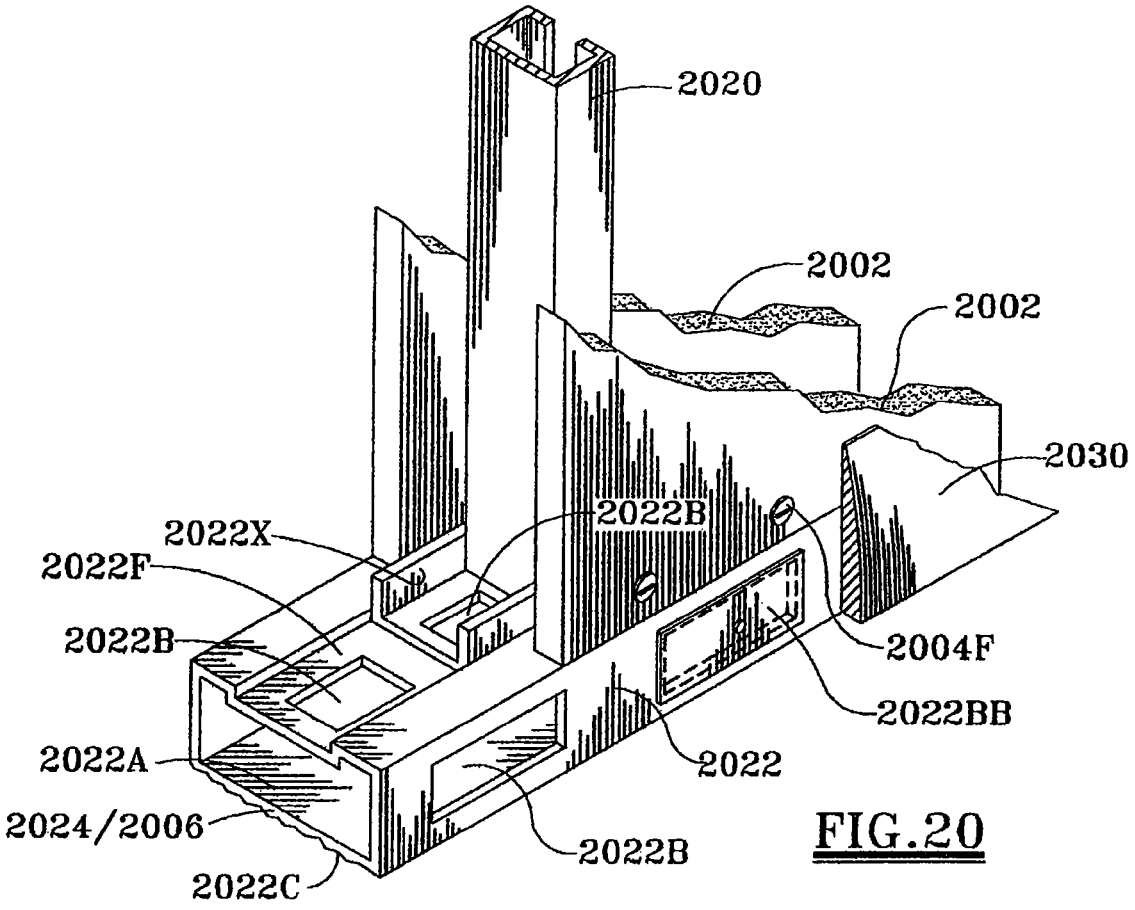

FIG. 20 is a sectional illustration of yet another embodiment of a tri-channel bottom track used in association with the wall system of the present invention having elements that are bendable metal.

Figure 21A:
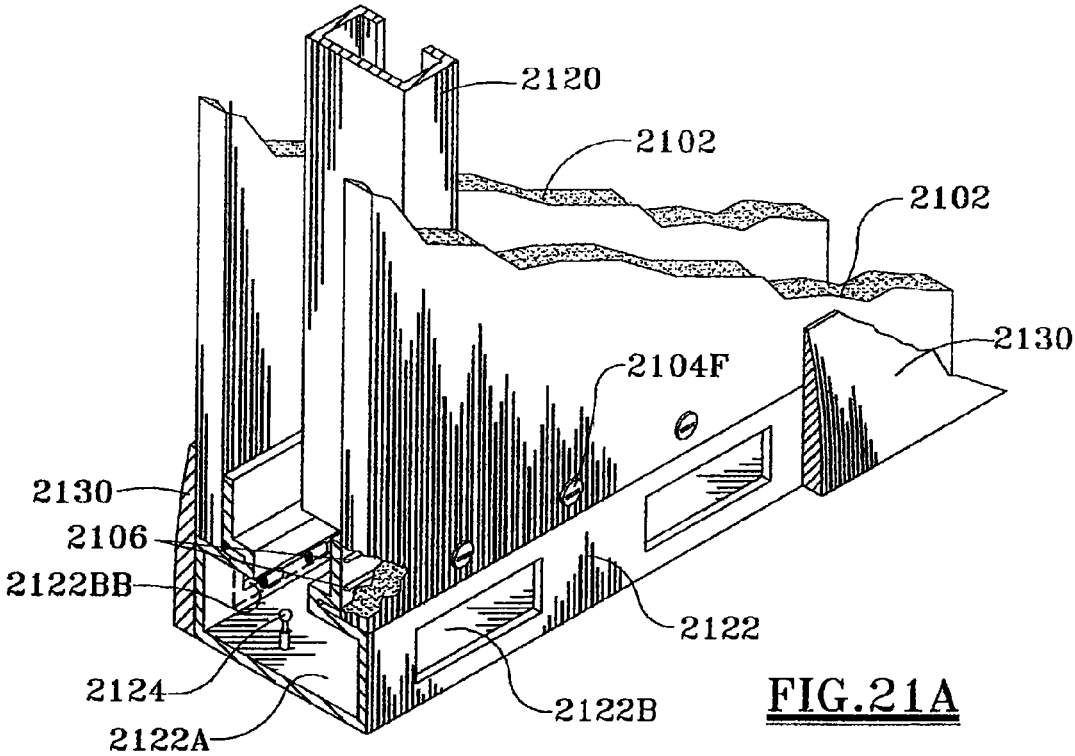
Figure 21A:
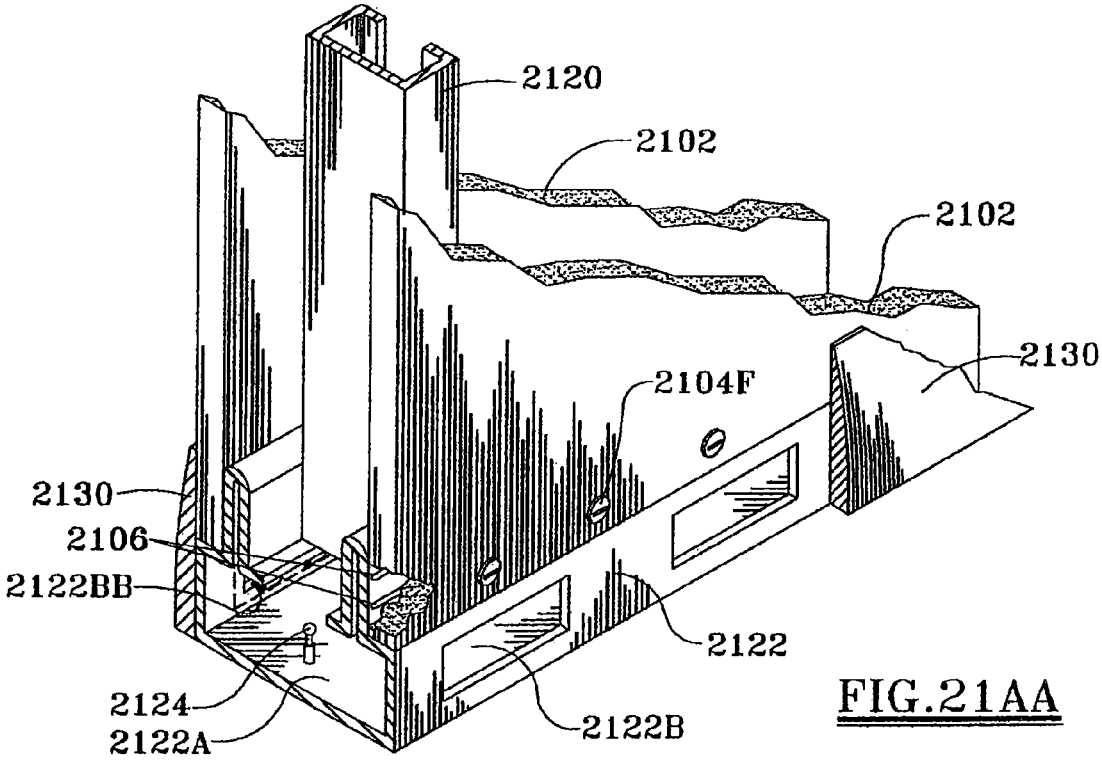

FIG. 21A is a sectional illustration of a channeled bottom track used in association with the wall system of the present invention having a data channel.

FIG. 21AA is a sectional illustration of another channeled bottom track used in association with the wall system of the present invention having a data channel.

FIG. 21AAA is a sectional illustration of yet another channeled bottom track used in association with the wall system of the present invention having a data channel.

Figure 21B:
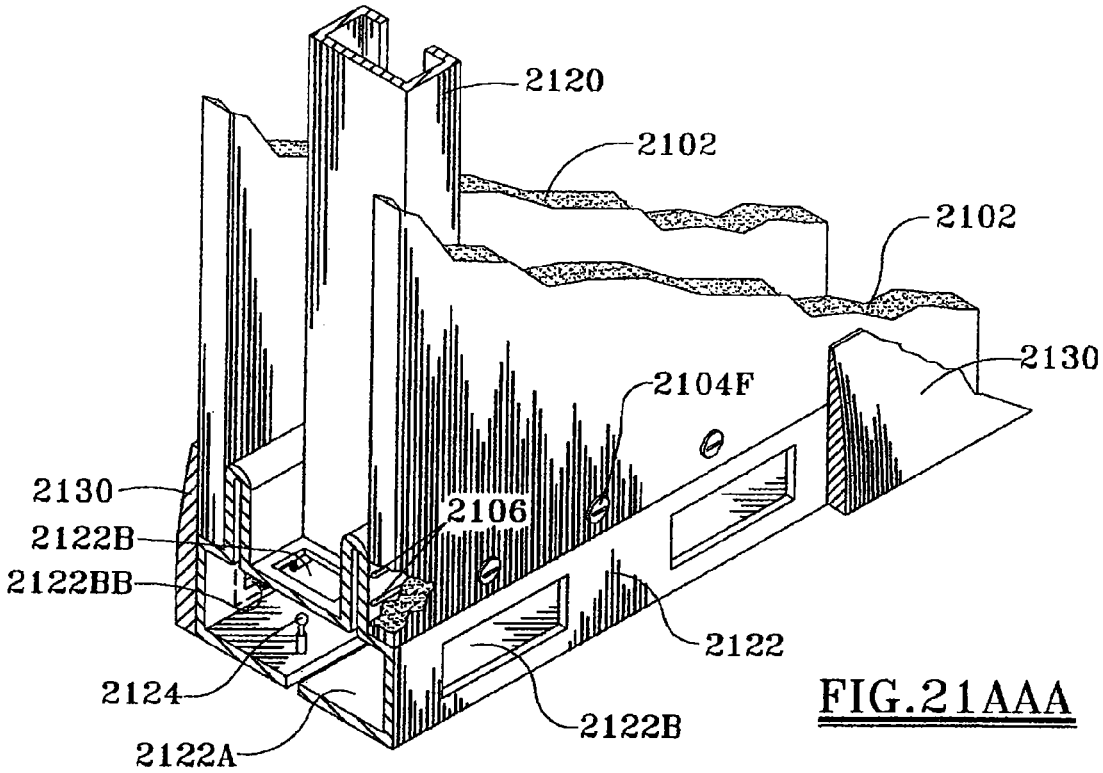
Figure 21B:
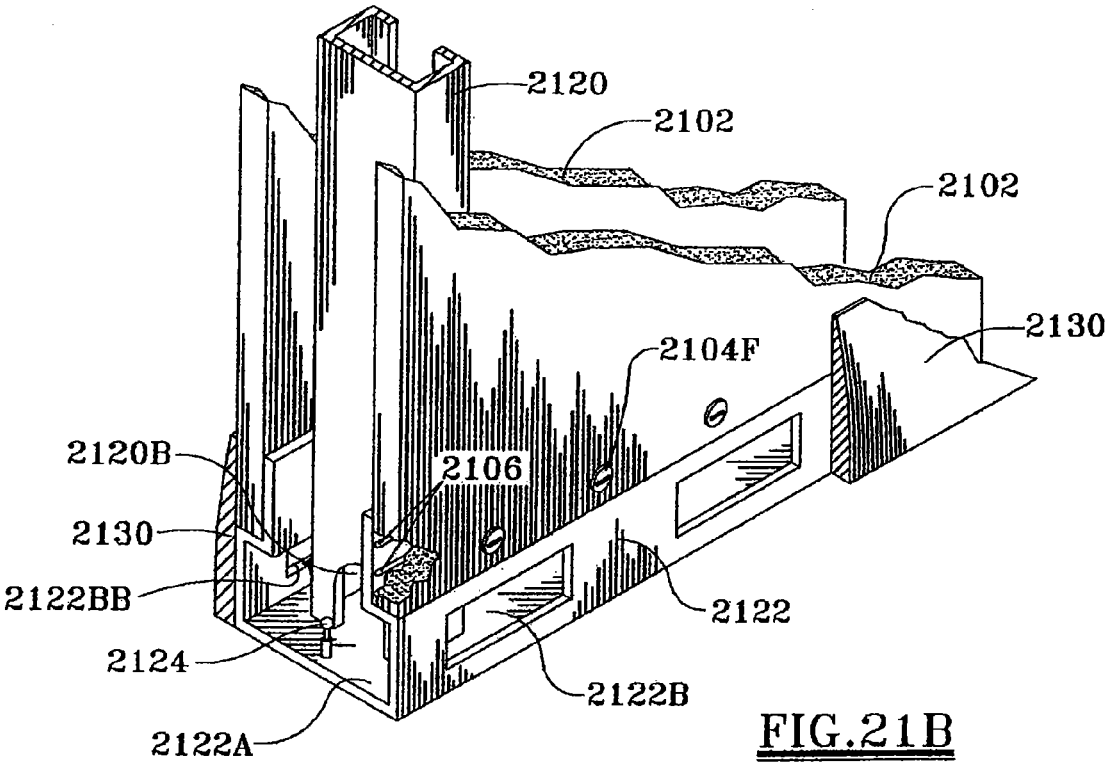

FIG. 21B is a sectional illustration of another channeled bottom track used in association with a load-bearing wall system of the present invention having a data channel.

Figure 22A:
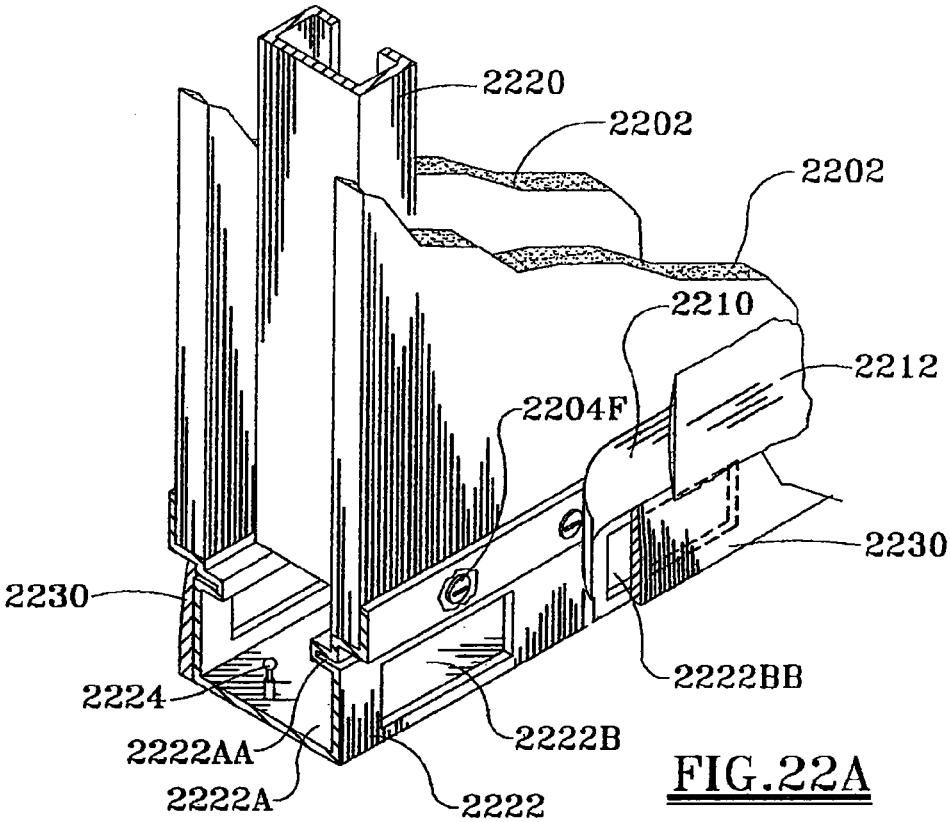
Figure 22A:
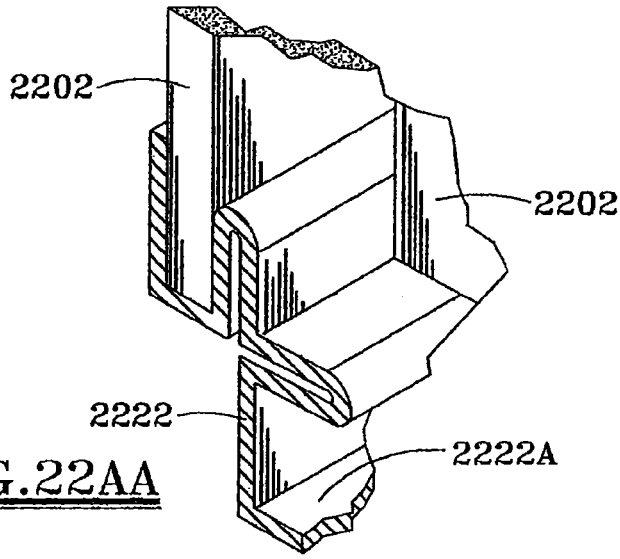

FIG. 22A is a sectional illustration of another channeled bottom track used in association with a wall system of the present invention having a data channel.

FIG. 22AA is a sectional illustration of an alternate embodiment of the one piece base track with a raised channel-seat for the stud.

Figure 22B:
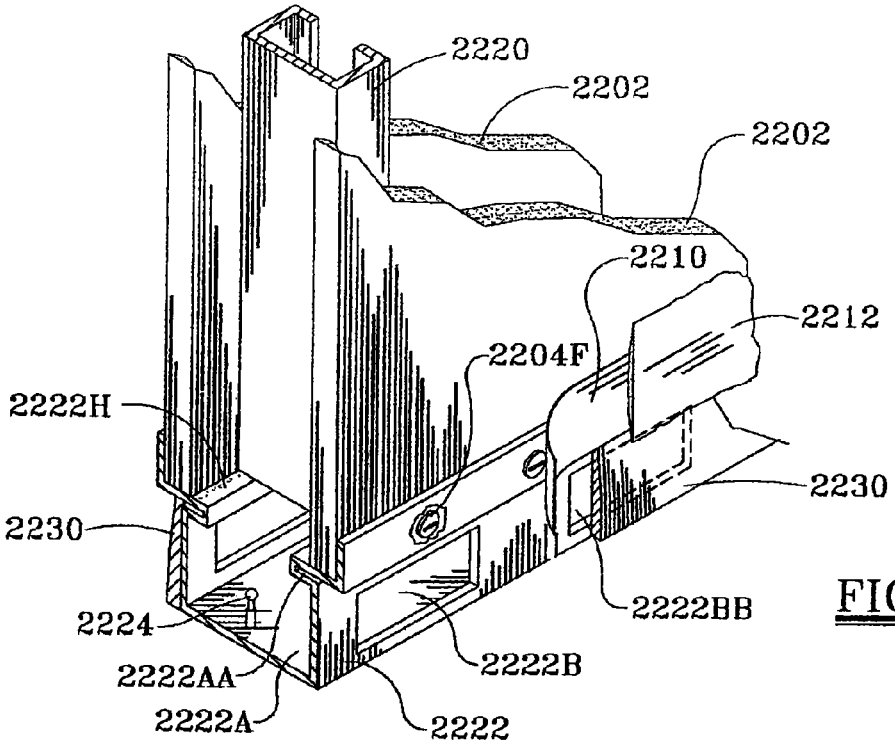

FIG. 22B is a sectional illustration of another channeled bottom track used in association with a wall system of the present invention having a data channel.

Figure 22C:
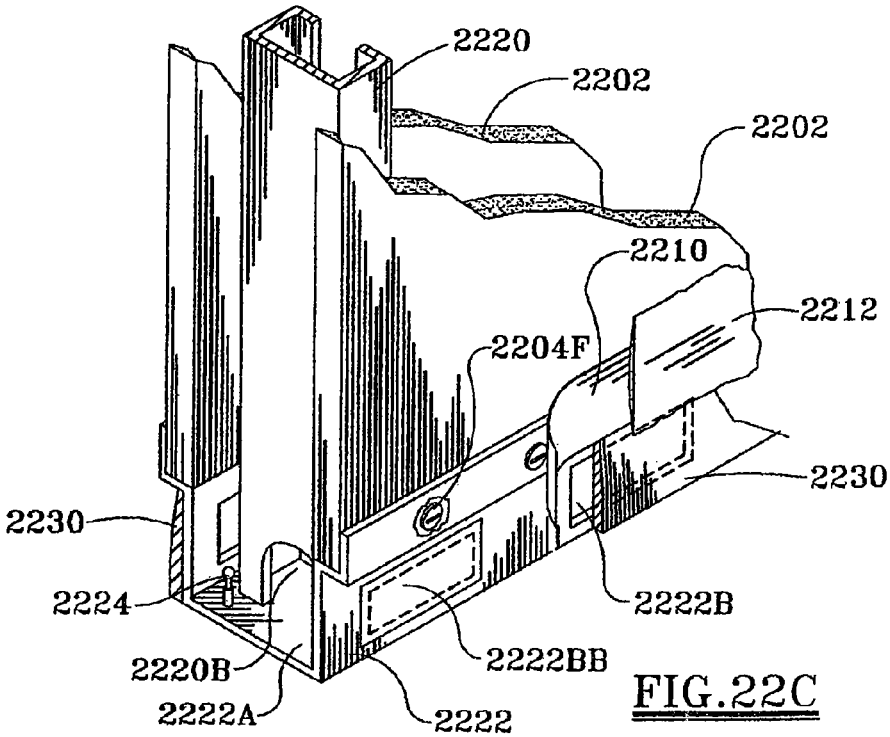

FIG. 22C is a sectional illustration of another channeled bottom track used in association with a load-bearing wall system of the present invention having a data channel.

Figure 23:
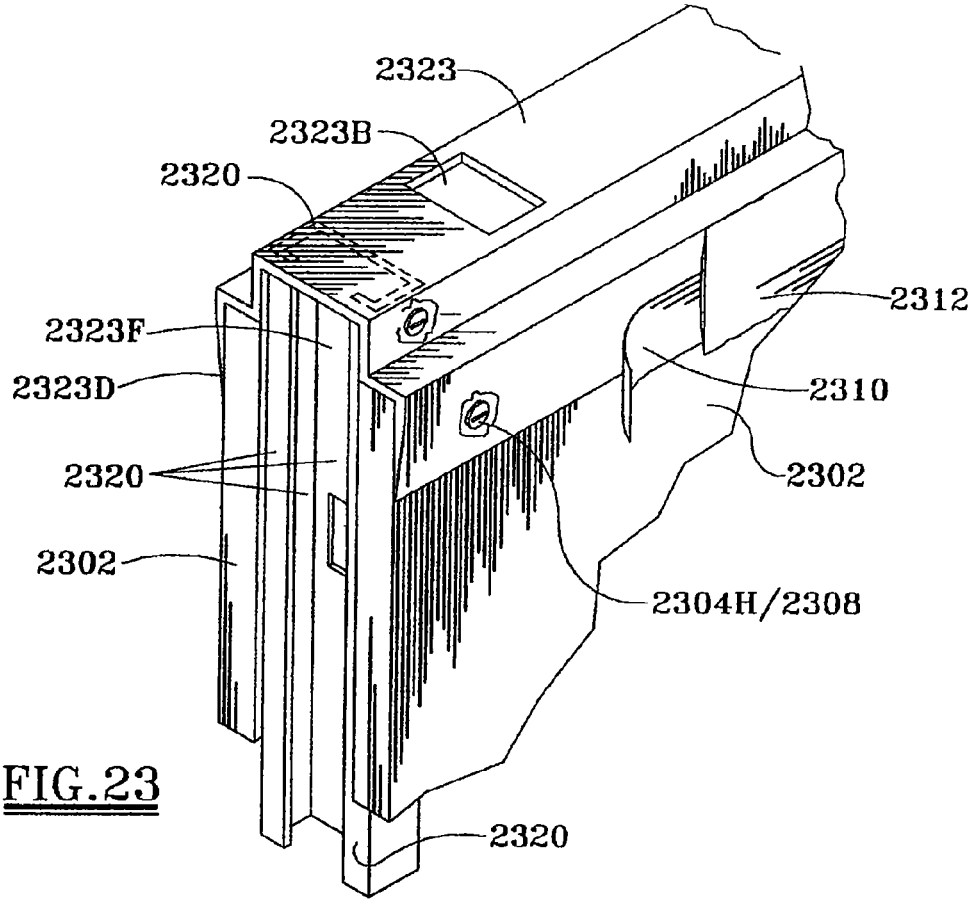

FIG. 23 illustrates a one-piece head track for use with one embodiment of the present invention.

The above general description and the following detailed description are merely illustrative of the generic invention, and system of the present invention having elements that are bendable metal.

DETAILED DESCRIPTION

Reference will now be made in detail to the present preferred embodiments of the invention as described in the accompanying drawings.

PRIOR ART: FIG. P illustrates a prior art wall assembly P00. The prior art wall assembly P00 comprises both sides of one or more panels P02, one or more studs P20, a top track P23, a bottom track P22, a mud compound P05, a porous paper P10, "floating" mud compound P12, a smooth surface P14 which has been sanded and a plurality of non-removable fasteners P04. Typically, the prior art wall assembly P00 has a base board P30, a top track P23, and a bottom track P22. Typically, the studs P20 are aligned vertically using the top track P23 and the bottom track P22. The panels P02 are affixed to the studs P20 using the non-removable fasteners P04. Typically, the panels are fixed to the top track P23 and the bottom track P22 using the non-removable fasteners P04. The non-removable fasteners P04 can be screws, nails, staples, and the like. It is appreciated by those skilled in the art that many different non-removable fasteners P04 can be used in the manufacture of the prior art wall assembly P00. The fasteners P04 are non-removable because of how they are used. For example, typically, the fasteners P04 are used so that they are covered with a mud compound P05, P13. Covering the fastener P04 with the mud compound P05, P13 makes accessing, finding, and removing the fasteners P04 not practical. Adjacent panels P02 form a joint or seam P03 at, for example, a first stud P20A. The non-removable fasteners P04 are used to fixably secure the panels P02 to the first stud P20A. Similarly, a second stud P20C is used to securably affix the panel P02 at its edge using the non-removable fasteners P04. Typically, there is at least one intermediate stud P20B between the first stud P20A and the third stud P20C. The intermediate stud P20B is needed, for example, to prevent the panel P02 from vibrating with normal building use, such as for example, to control panel shape distortion where panels P02 are wide and the opening and closing of doors, heating and air conditioning blowers turning on and off, etc. To prevent the panel P02 from vibrating, a plurality of non-removable fasteners P04 affix the panel P02 to the intermediate stud P20B.

Once the panels P02 are affixed to the stud P20A, the non-removable fasteners P04A and the seam P03A must be concealed to form a continuous smooth wall P14A. The non-removable fasteners P04B affixed to the intermediate stud P20B are covered with the mud compound P13B or "floated" over. Thereafter, the float mud compound P13 is sanded smooth so that it provides a continuous smooth surface P14.

With respect to the studs P20A, P20C at the panel seams P03, a more lengthy process is required. The joint or seam P03A is filled with a mud compound P05A. The mud compound P05A fills and hides the fastener P04A heads. When the fastener P04A heads are filled with the mud compound P05A removal is impractical, if not impossible. Also, the mud compound P05A sticks to the panel P02 making reuse of the panel P02 impractical, if not impossible. Thereafter, a porous paper tape P10A is placed over the mud compound P05A which also covers the non-removable fasteners P04A. A mud compound P12A is applied over or "floated" over the porous paper tape P10A. The porous paper tape P10A helps to hold the panels P02 together. The porous paper tape P10A and the mud compound P05A, P12A adheres to or bonds with the panels P02. The porous paper tape P10A provides structural integrity to the mud compound P05A, P12. After the mud compound P05A, P12 is sufficiently cured, a unitary bond with the porous paper tape P10A, the panel P02 of sheet rock, the fasteners P04A and the mud compound P05A, P12A is formed. The mud compound P05A, P12A has a purpose of adhering to or bonding with the panels P02 and the porous paper tape P10A. Thereafter, the mud P05A, P12A is sanded to a smooth surface P14A. The smooth surface P14A provides that the seam P03A is invisible. The mud compound P05A, P12A has another purpose which is to provide a surface that can be sanded to a floated smooth surface to make the seam P03A invisible. Thereafter, a baseboard P30 is typically placed over the extremity of the panels P02.

With respect to the intermediate stud P20B, the panel P02 is also secured by the non-removable fasteners P04B. Similarly, the non-removable fasteners P04 can be nails, staples, or the like. It is understood by those skilled in the art that the non-removable fasteners P04 can not be easily accessed, found, or removed without damage to the panel P02. The non-removable fasteners P04 are hidden under the covering of the mud compound P13 and are impracticable, if not impossible, to remove.

In the prior art wall assembly P00, the long-term, non-removable fasteners P04 create holes in the panels P02. The holes created by the fasteners P04 are filled with or "floated" over with the mud compound P05, P12, P13. The mud compound P05, P12, P13 hides the fastener P04 screws and fills the holes and screw heads and adheres to the panel P02. The non-removable fasteners P04 are not easily accessed, found and removed without damage to the panel P02. The mud compound P05, P12, P13 cures to form a unitary bond with the porous paper tape P10, the panel P02 of sheet rock, the fasteners P04, and the mud compound P05, P12, P13, thereby inhibiting reuse of any of the components.

FIG. PA is a plan view cross section of the seam P03A illustrating the prior art methodology in concealing and securing the seam P03 between the panels P02 in a conventional wall P00. The panels P02 are abutted at the seam P03A as illustrated in FIG. PA. A base layer of mud compound P05A is applied to the seam P03A. Thereafter, a porous tape P10A is applied over the base layer of mud compound P05A. Thereafter, finish mud P12A is applied over the porous tape P10A. Thus, anything under the porous tape P10A is inaccessible and cannot be removed. The panels P02 are joined so that the joint or seam P03A between the panels P02 is turned into a smooth surface P14A, and the abutting panels P02 form a single, continuous unitary panel P02.

FIG. PB is a flow chart describing a prior art wall P00 as illustrated in FIG. P and FIG. PA. FIG. PA defines the treatment of the seam P03A. FIG. PB illustrates the prior art wall P00 where the supports or studs P20A, P20C are at the panel P02 edges. The seam P03A is treated to form a continuous, unitary panel P02 having a smooth surface P14A. FIG. PB illustrates a prior art wall P00 where a stud P20 is at the panel P02, edge P03, and the seam P03A is rendered invisible.

FIG. PC is a flow chart describing a prior art wall P00 as illustrated in FIG. P.

FIG. PC defines the treatment of the supports or studs P20B not located at the edges of the panel P02. FIG. PB illustrates the prior art wall P00 where the supports or studs P20B are located between the panel P02, edges P03, and is treated to form a smooth surface P14.

FIG. 1: supports or studs 120 at the panel 102 edge and "zip" tape 110A assists to form an invisible seam 114A. FIG. 1 is an illustration of a preferred embodiment of the wall system 100 of the present invention with the supports or studs 120 at the panel 102 edge and the zip tape 110A assists to form an invisible seam 114A. The wall system 100 provides an innovative wall 100 having a support or stud 120A at the edge of a panel 102 so as to form a seam 103A. The wall system 100 of the present invention is different from the prior art wall assemblies in that the wall system 100 can be readily disassembled, relocated, and reassembled. The wall system 100 illustrated in FIG. 1 has the primary elements of one or more panels 102, a plurality of long-term removable fasteners 104, one or more studs 120, a bottom track 122, a "zip" tape 110, and a tab 111 associated with the zip tape 110.

The zip tape 110 used in practicing the present invention may be, for example, a releasable, removable self-adhering fiberglass mesh tape that has a mesh porosity such that the screw heads are not filled with compound 112. Also, the present invention optionally provides that the screws 104 are treated to prevent the compound 112 from adhering to the screws 104. The screws 104 can be treated before being used or after being installed. For example, treatment of the screws 104 before use may be by applying a Teflon® coat to the screw heads, or making the outer surface of the screws 104 of a non-sticking substance, or by making the entire screw 104 from a non-sticking substance. Further by example, treatment of the screws 104 after use may be by applying a spray Teflon® coat to the screw heads, or coating the outer surface of the screws 104 with a non-sticking substance. The non-sticking substance can be in any appropriate form, such as liquid, powder, etc. It can be appreciated by those skilled in the art that various and sundry combinations of the screws 104 and the non-sticking substances may be used depending on the situation.

The wall system 100 of the present invention provides that the studs 120 are engaged for support in the "floor" or bottom track 122 and optionally in a "head" or top track 123, or the like. Optionally, the wall system 100 provides that a top track 123 or the like may not be attached to or reach the ceiling and likewise the bottom track 122 or the like may not be attached to or reach the floor. It can be appreciated by those skilled in the art that the type of studs 120, top track 123, and bottom track 122 can be varied depending on the project need and requirements. The panels 102 are affixed to the studs 120 at the panel edges to form a seam 103. The "long-term, removable" fasteners 104 are used to secure the adjacent panels 102 to the studs 120A, 120C. The long-term, removable fasteners 104H at the head trim 131 and the long-term, removable fasteners 104F at the floor trim 130 are optional, and releasable adhesive can be used in their place. The studs 120 can be of any shape, dimension, or material. Various shapes, dimensions, and materials are readily known to those skilled in the art. When referring to the tab 111, it is any portion of the zip tape used to disengage the zip tape 110 from the panel 102. The panels 102 can be placed on either or both sides of the studs 120. The height of the wall system 100 can by varied and there is no need for the wall system 100 to be full height.

The joint or seam 103A is required to be conditioned so as to be a smooth congruent surface 114A with the adjacent panels 102A. To form the smooth congruent surface 114A, the seam 103A and long-term removable fasteners 104A are covered with the "zip" tape 110A and floated with mud compound 112A. The "zip" tape 110A is sufficiently strong to be removed as a single piece, in unison. Further, the zip tape 110 can be of varying porosity depending on the application of the present invention. The "zip" tape 110A is removed as a single piece in unison by pulling a tab 111A. As the tab 111A is pulled, the "zip" tape 110A and the mud compound 112A disengage from the panels 202 thereby exposing the short term removable fasteners 104A. Once the short term removable fasteners 104 are exposed, the fasteners 104A can be easily removed. Since short term removable fasteners 104A are covered by the zip tape 110A before the mud compound 112A is applied, the heads of the long-term permanent fasteners 104A are kept clean for easy engagement and removal. Also, the "zip" tape 110A is sufficiently unporous to prevent mud compound 112A from penetrating through the tape 110A to fill the heads of the fasteners 104A. As one skilled in the art can appreciate, the "zip" tape 110A can be installed in various ways. The tab 111A is typically at the extremity of the zip tape 110A and normally under a removable trim at the base 130 or under other trim such as removable crown trim at the head or removable chair rail trim.

Another embodiment of the tab 111 of the zip tape 110 is to locate the zip tape 110 so that an "incision" can be made in the smooth sanded surface 114 so as to form a tab 111. The incision can be made without damage to the panel 102. The zip tape 110 can be pried up so as to form a tab (not shown) that can be pulled up so as to disengage the whole length of the zip tape 110 together with the mud compound 112.

FIG. 1A is a plan view cross section of the seam 103A in FIG. 1 illustrating the methodology in concealing and securing the seams 103A between panels 102 in a wall system 100. The panels 102 are abutted at a seam 103A. Thereafter, a zip tape 110A is applied over the seam 103A. Thereafter, finish mud 112A is applied or floated over the zip tape 110A. Thus, anything under the zip tape 110A is accessible by removal of the zip tape 110A. The panels 102 are joined so that the seam 103A between the panels 102 is turned into a smooth surface 114A, and the abutting panels 102 form a single, continuous unitary panel 102, yet demountable.

FIG. 1B is a flow chart describing the wall 100 of the present invention as illustrated in FIG. 1. The flow chart describes the treatment of the seam 103A. FIG. 1B describes the wall 100 where the supports or studs 120A, 120C are at the panel 102 edges. The seam 103A is treated to form a continuous, unitary panel 102 having a smooth surface 114A, yet demountable.

FIG. 1C is an illustration of a preferred embodiment of the wall system 100 of the present invention using releasable adhesive 106 with the supports or studs 120 at the panel edge 103 including an invisible seam 114 and a bottom track 122.

FIG. 1D is an illustration of a preferred embodiment of the wall system 100 of the present invention with the supports or studs 120 at the panel edge 103 including an invisible seam 114.

FIG. 2: releasable adhesive is at intermediate stud or support. FIG. 2 is an alternate embodiment of the wall system 200 of the present invention where the releasable adhesive 206B is used at the intermediate supports or studs 220B. The wall system 200 illustrated in FIG. 2 has the primary elements of one or more panels 202, a plurality of long-term removable fasteners 204, one or more studs 220, a "zip" tape 210, one or more short-term removable fasteners 208, and a tab 211 associated with the zip tape 210.

With respect to the structure of the wall 200 at the seam 203A, all the description of FIG. 1 is applicable for FIG. 2. The long-term removable fasteners 204H, 204F are typically used along the alternate perimeters to secure the upper and lower portion of the panels 202. Preferably, the panels 202 are removably secured to the intermediate stud 220B using a releasable adhesive 206B. An option of the present invention is to omit the intermediate stud 220B altogether. (See FIG. 1). To provide for the removable, although affixed, securement of the panel 202 to the intermediate stud 220B, one or more short-term removable fasteners 208B are used. After the removable adhesive 206B cures so as to secure the panel 202 to the stud 220B, the short-term removable fasteners 208B can be easily removed. To cover the holes left by the short-term removable fasteners 208B, a mud compound 213B is applied or "floated" over the holes and sanded to a smooth surface 214B. The short-term removable fasteners 208B are used to hold the panels 220 in place while the releasable adhesive 206B cures. The short-term removable fasteners 208B are fasteners that only remain in the wall system 200 during the time required for the releasable adhesive 206B to cure.

As described in FIGS. 1, 1A, 1B and also described here for clarity the joint or seam 203A is required to be conditioned so as to be a smooth congruent surface 214A with the adjacent panels 202A. The joint or seam 203A is required to be conditioned so as to be a smooth congruent surface 214A with the adjacent panels 202A. To form the smooth congruent surface 214A, the seam 203A, and long-term removable fasteners 204A are covered with the "zip" tape 210A and floated with mud compound 212A. The "zip" tape 210A is sufficiently strong to be removed as a single piece, in unison. The zip" tape 210A is removed as a single piece in unison by pulling a tab 211A. As the tab 211A is pulled, the "zip" tape 210A and the mud compound 212A disengage from the panels 202 thereby exposing the short term removable fasteners 204A. Once the short term removable fasteners 204 are exposed, the fasteners 204A can be easily removed. Since short term removable fasteners 204A are covered by the zip tape 210A before the mud compound 212A is applied, the heads of the long-term permanent fasteners 204A are kept clean for easy engagement and removal. Also, the "zip" tape 210A is sufficiently unporous to prevent mud compound 212A from penetrating through the tape 210A to fill the heads of the fasteners 204A. As one skilled in the art can appreciate, the "zip" tape 210A can be installed in various ways. The tab 211A is typically at the extremity of the zip tape 210A and normally under a removable trim at the base 230 or under other trim such as removable crown trim at the head or removable chair rail trim.

Another embodiment of the tab 211 of the zip tape 210 is to locate the zip tape 210 so that an "incision" can be made in the smooth sanded surface 214 so as to form a tab 211. The incision can be made without damage to the panel 202. The zip tape 210 can be pried up so as to form a tab (not shown) that can be pulled up so as to disengage the whole length of the zip tape 210 together with the mud compound 212.

To form a smooth congruent surface, the seam 203A and removable fasteners 204A are covered with the zip tape 210A. The zip tape 210A is sufficiently strong to be removed as a single piece, in unison. The zip tape 210A is removed as a single piece in unison by pulling the tab 211A. As the tab 211A is pulled, the zip tape 210A, and the mud compound 212A disengage from the panels 202 thereby exposing the short term removable fasteners 204A. Once the short term removable fasteners 204 are exposed, the fasteners 204A can be easily removed. The short term removable fasteners 204A being covered by the zip tape 210A before the mud compound 212A is applied keeps the heads of the fasteners 204A clean for easy engagement and removal. Also, the zip tape 210A is sufficiently unporous to prevent mud compound 212A from penetrating through the tape 210A to fill the heads of the fasteners 204A. The zip tape 210A can be installed in various ways.

FIG. 2A is illustrated in FIG. 1A and described here for clarity.

FIG. 2A is a plan view cross section of the seam 203A illustrated in FIG. 2 showing the methodology of securing the seams 203A between panels 202 in a wall system 200. The panels 202 are abutted to form the seam 203A. Thereafter, a zip tape 210A is applied over the seam 203A. Also, the zip tape 210A is applied over any long-term removable fastener 204A that may be securing the panels 202. Thereafter, the finish mud 212A is applied or floated over the zip tape 210A. The panels 202 are joined so that the joint 203A between the panels 202 is transformed into a smooth surface 214A, and the abutting panels 202 form a single, continuous unitary panel 202 having a smooth surface 214A, yet demountable. A finishing mud compound 212A is placed over the zip tape 210 at all portions except for a tab 211A. The tab 211A is lifted away from the wall 200 for removing the zip tape 210A from the panels 202. Thus, the zip tape 210A can be accessed and pulled away removing the mud compound 212A and exposing any long-term removable fasteners 204A.

The zip tape 210 used in practicing the present invention may be, for example, a releasable, removable self-adhering fiberglass mesh tape that has a mesh porosity such that the screw heads are not filled with compound 212. Also, the present invention optionally provides that the screws 204 are treated to prevent the compound 212 from adhering to the screws 204. The screws 204 can be treated before being used or after being installed. For example, treatment of the screws 204 before use may be by applying a Teflon® coat to the screw heads, or making the outer surface of the screws 204 of a non-sticking substance, or by making the entire screw 204 from a non-sticking substance. Further by example, treatment of the screws 204 after use may be by applying a spray Teflon® coat to the screw heads, or coating the outer surface of the screws 204 with a non-sticking substance. The non-sticking substance can be in any appropriate form, such as, liquid, powder, etc. It can be appreciated by those skilled in the art that various and sundry combinations of the screws 204 and the non-sticking substances may be used depending on the situation.

FIG. 2B is a flow chart describing the wall 200 of the present invention as illustrated in FIG. 2. The flow chart illustrates the relationship between the panels and supports or studs that are not at the panel edges. FIG. 2B describes the wall 200 illustrated in FIG. 2 where the supports or studs 220A, 220C are not at the panel 202 edges.

FIG. 2C is an illustration of a preferred embodiment of the wall system 200 of the present invention using releasable adhesive 206 with the supports or studs 220 at the panel edge 203 including an invisible seam 214 and a bottom track 222.

FIG. 2D is an illustration of a preferred embodiment of the wall system 200 of the present invention with the supports or studs 220 at the panel edge 203 including an invisible seam 214.

FIG. 3: Zip tape at intermediate studs or supports. FIG. 3 illustrates yet another preferred embodiment of the wall system 300 of the present invention where zip tape is used at intermediate supports or studs 320B. The wall system 300 provides a system similar to the wall systems 100, 200 in FIGS. 1 and 2 with the difference being that the panel 302 is secured to the intermediate stud 320B using long-term removable fasteners 304B in conjunction with the zip tape 310B. The wall system 300 comprises the elements of the earlier discussed wall system 100 including the seam-related parts: the panels 302, the end studs 320A, 320C, the removable fasteners 304A, the zip tape 310A, the mud compound 312A, the smooth sanded surface 314A, as well as the intermediate-panel-related parts: the long-term removable fasteners 304B, the intermediate stud 320B, the zip tape 310B, the floated mud compound 312B and the smooth sanded surface 314B. Also, the wall system 300 uses a tab 311A, 311B which is at an extremity of the zip tape 310A, 310B. While the end studs 320A, 320C are used to affix the panels 302 at the seams 303, the intermediate stud 320B is used to affix to the panels 302 between seams. The panels 302 are removably secured to the intermediate stud 320B using the removable fasteners 304B. The removable fasteners 304B are covered with the zip tape 310A. The zip tape 310B is provided so that it is strong enough and unporous enough to protect the removable fasteners 304B from being held inoperable due to the mud compound 312B. The zip tape 310B is covered with or floated over with the mud compound 312B. When the mud compound 312B dries, it can be sanded. The mud compound 312B can be sanded to a smooth surface 314B. The smooth surface 314B hides the location of the removable fasteners 304B.

With respect to the studs 320, typically at a remote end of each stud 320 is a tab 311 of the zip tape 310. The tab 312 is provided so that it can be pulled to disengage the mud compound 312 from the panel 302 such that the removable fasteners 304 are exposed and readily removed to disengage the panel 302 from the studs 320. Further, the zip tape 310 removes the excess mud compound 312 from the panel 302 so that the panel 302 is essentially pristine.

It can be appreciated that the tab 311 of the zip tape 310 can be utilized in different ways. A first utilization of the tab 311 of the zip tape 310 is to expose the tab 311 in an area that is not covered or floated with mud compound 312. FIG. 1, FIG. 2, and FIG. 3 illustrate a tab 111, 211, 311 being located so as to be covered by the removable base trim 330. The tab 311 can be readily accessed by removing the removable base trim 330. Thereafter, the tab 311 can be lifted from the bottom of the panel 302 expose the removable fasteners 304 by disengaging the mud compound 312 from the panels 302. The tab 311 can be found and pulled so as to disengage the whole length of zip tape 310 which coincides with the dimension of the panel 302 and further removes the mud covering 312.

As described in FIG. 1 and FIG. 2 and also described here for clarity the joint or seam 303A is required to be conditioned so as to be a smooth congruent surface 314A with the adjacent panels 302A. The joint or seam 303A is required to be conditioned so as to be a smooth congruent surface 314A with the adjacent panels 302A. To form the smooth congruent surface 314A, the seam 303A and long-term removable fasteners 304A are covered with the zip tape 310A and floated with mud compound 312A. The zip tape 310A is sufficiently strong to be removed as a single piece in unison. The zip tape 310A is removed as a single piece in unison by pulling a tab 311A. As the tab 311A is pulled, the zip tape 310A and the mud compound 312A disengage from the panels 302 thereby exposing the short term removable fasteners 304A. Once the short term removable fasteners 304 are exposed, the fasteners 304A can be easily removed. Since short term removable fasteners 304A are covered by the zip tape 310A before the mud compound 312A is applied, the heads of the long-term permanent fasteners 304A are kept clean for easy engagement and removal. Also, the zip tape 310A is sufficiently unporous to prevent mud compound 312A from penetrating through the tape 310A to fill the heads of the fasteners 304A. As one skilled in the art can appreciate, the zip tape 310A can be installed in various ways. The tab 311A is typically at the extremity of the zip tape 310A and normally under a removable trim at the base 330 or under other trim such as removable crown trim at the head or removable chair rail trim. Another embodiment of the tab 311 of the zip tape 310 is to locate the zip tape 310 so that an incision can be made in the smooth sanded surface 314 so as to form a tab 311. The incision can be made without damage to the panel 302. The zip tape 310 can be pried up so as to form a tab (not shown) that can be pulled up so as to disengage the whole length of the zip tape 310 together with the mud compound 312. The wall system 300 is a fire rated wall.

As In the other embodiments, the zip tape 310 used in practicing the present invention may be, for example, a releasable, removable self-adhering fiberglass mesh tape that has a mesh porosity such that the screw heads are not filled with compound 312. Also, the present invention optionally provides that the screws 304 are treated to prevent the compound 312 from adhering to the screws 304. The screws 304 can be treated before being used or after being installed. For example, treatment of the screws 304 before use may be by applying a Teflon® coat to the screw heads, or making the outer surface of the screws 304 of a non-sticking substance, or by making the entire screw 304 from a non-sticking substance. Further by example, treatment of the screws 304 after use may be by applying a spray Teflon® coat to the screw heads, or coating the outer surface of the screws 304 with a non-sticking substance. The non-sticking substance can be in any appropriate form, such as, liquid, powder, etc. It can be appreciated by those skilled in the art that various and sundry combinations of the screws 304 and the non-sticking substances may be used depending on the situation.

FIG. 3A is a plan view cross section of the seam 303 illustrated in FIG. 3 showing the methodology of securing the seams 302 between panels 302 in the wall system 300.

FIG. 3B is a flow chart describing the wall system 300 illustrated in FIG. 3 where the support or stud 320 is not at the panel 302 edges and the panel 302 is secured at the extremities by long term fasteners 304 (a fire rated wall). The panel 302 is secured by removable means 304. The zip tape 310 is applied over the removable means 304. The mud 312 is floated over the zip tape 310 and then sanded smooth to form a smooth surface 314.

FIG. 3C is an illustration of a preferred embodiment of the wall system 300 of the present invention using releasable adhesive 306 with the supports or studs 320 at the panel edge 303 including an invisible seam 314 and a bottom track 322. The wall system 300 is a fire rated wall.

FIG. 4: Removable substance at panel edge supports or studs to form an invisible seam. FIG. 4 is an illustration of yet another wall system 400 of the present invention. The wall system 400 uses panels 402, studs 420, long-term removable fasteners 404, short-term removable fasteners 408, and a removable substance 442. The panels 402 are abutted one adjacent the other to form the seam 403. The panels 402 are held using the studs 420A, 420C, and optionally the stud 420B. Typically on alternate sides of the studs 420 are panels 402. The panels 402 are secured to the stud 420A, which is aligned with the seam 403A by a plurality of long-term removable fasteners 404A and short-term removable fasteners 408B. Also, the panels 402 are optionally secured along the upper perimeter using by a plurality of removable fasteners 404H. Similarly, the panel 402 is optionally secured along the lower portion along with the removable fasteners 404F. The panels 402 are typically disposed on alternate sides of a bottom track 422. The studs 420 rest in the bottom track 422 such that the panels 402 are displaced one from the other an equal distance along the surface of the panels 402. The removable substance 442 is applied over the seam 403A and the removable fasteners 404A. As the removable substance 442 dries, it may shrink in size. If the removable substance 442 shrinks, additional layers may be required. Thus, a first layer 442AA of the removable substance 442 is applied, and allowed to cure. Thereafter, a second layer 442AB of the removable substance 442 is applied, and allowed to dry. Thereafter, a third layer 442AC of the removable substance 442 is applied, and allowed to dry. The sequence is continued until such time as the entire gap formed by the seam 403A is filled so as to form a flush surface or concave surface, if so desired. The removable substance 442 may be a composition that can then be sanded to provide a smooth surface 414A with the panel 402.

The intermediate stud 420B is affixed to the panels 402 using a releasable adhesive 406B. The panels 402 are secured to the intermediate stud 420B using the temporary short-term fasteners 408B. After the releasable adhesive 406B secures the panels 402 to the intermediate stud 420B, the temporary fasteners 408B are removed. The holes left by the temporary short-term fasteners wall system 400 where the supports or studs 420A, 420C are at the panel 402 edges. The seam 403A is treated using the removable substance 442 to form a continuous, unitary panel 102 having a smooth surface 114A.

FIG. 4C is a flow chart of the wall system 400 of the present invention as illustrated in FIG. 4 where the support or stud 420 is not at the panel 402 edges. More particularly, FIG. 4C describes the wall system 400 where the supports or studs 420A, 420C are intermediate of the panel 402 edges.

FIG. 4D is an illustration of a preferred embodiment of the wall system 400 of the present invention as illustrated in FIG. 4, but without the extensive bottom track 422. Alternately, a releasable adhesive 406 may be used with the supports or studs 420 at the panel edge 403 in place of the long-term screws 404, but in conjunction with the short-term screws 408.

FIG. 5: Releasable adhesive at panel edge supports or studs; Invisible seam optional. FIG. 5 is yet another embodiment of a wall system 500 of the present invention where releasable adhesive 506A is used at the panel edge supports or studs 520A. The wall system 500 includes the panels 502, the studs 520, the long-term removable fasteners 504H, 504F, the short-term removable fasteners 508A, 508B, the releasable adhesive 506, the float mud compound 516A, 513B or removable substance, and the bottom track 522. The bottom track 522 receives the studs 520. The panels 502 are typically placed on alternate sides of the studs 520 and the bottom track 522. The panels 502 are removable secured to the studs 520 using the releasable adhesive 506. The panels are allowed to engage the releasable adhesive 506 and the studs 520 in a fixed manner by using the removable short-term fasteners 508. After the releasable adhesive 506 cures, the removable short-term fasteners 508 can be removed. Thereafter, a float mud compound 516A, 513B or the removable substance is used to fill the holes created by the removable short-term fasteners 508. In the shown embodiment of the wall system 500 illustrated in FIG. 5, the seam 503A is not filled or treated. Thus, the bevel 505A formed at the seam 503A between the two abutting panels 502 is left unchanged so as to provide a decorative linear effect. Also, the use of the removable fasteners 504H at the top of the panel 502 and the removable fasteners 504F at the bottom of the panel 502 are optional.

FIG. 5A is a perspective, cross section of the seam 503A associated with the two abutting panels 502 as illustrated in FIG. 5. The seam 503A provides that the bevel 505A yields a linear decorative effect. In an alternate embodiment, there may also be a gap between the two panels 502.

FIG. 5B is a flow chart of the wall system 500 of the present invention as illustrated in FIG. 5 where the support or stud 520 is at the panel 502 edges and the seam 503A is visible. More particularly, FIG. 5B describes the wall system 500 where the supports or studs 520A, 520C are at the panel 502 edges. The seam 503A is not treated, but rather left to provide a decorative linear wall design.

FIG. 5C is a flow chart of the wall system 500 of the present invention as illustrated in FIG. 5 where the support or stud 520 is not at the panel 502 edges. More particularly, FIG. 5C describes the wall system 500 where the supports or studs 520A, 520C are intermediate of the panel 502 edges.

FIG. 5D is an illustration of a preferred embodiment of the wall system 500 of the present invention using releasable adhesive 506 with the supports or studs 520 at the panel edge 503 including an invisible seam 514 and a bottom track 522.

FIG. 6: Vertical cross-section of the wall system. FIG. 6 illustrates a cross section of the wall system 600 of the present invention. FIG. 6 illustrates a wall panel 602 removably engaged with a removable floor or bottom track 622 and a removable head track 623. The floor track 622 is removably engaged with a subfloor 665. The wall panels 602 have at one extreme a removable base trim 630 and at the other extreme a removable head trim 631. The removable base trim 630 and the removable head trim 631 typically cover the removable long-term fasteners 604. The removable long-term fasteners 604 removably engage the wall panels 602 and the stud 620 with the floor track 622 and the head track 623. When the wall panels 602 and the studs 620 are secured, one or more cavity 660 is created between the opposing wall panels 602, the studs 620 the top track 623 and the bottom track 622, respectively. The base trim 630 and the subfloor 665 are removably engaged. A floor finish or carpet 666 is typical. The removable top track 623 is typically engaged with a T support 661. The T support 661 is suspended in place by a hanger or support cable 662. The T support 661 is provided for accepting a plurality of ceiling tiles 663. When the ceiling tiles 663 are engaged with the T support 661, a space 664 is created between the ceiling tiles 663 and the head track 662. Preferably, the head trim 631 abuts the ceiling tile 663. A data channel 622A is provided in the floor track 622.

FIG. 7 shows a flow chart for a method of assembling a paneling system. The method includes fastening one or more panels on a support system with one or more mechanical fasteners, applying a tape to substantially cover the one or more mechanical fasteners, placing a layer of compound over the tape, permitting the compound to cure, and then, removing the tape from the paneling system in a manner that sufficiently exposes the one or more mechanical fasteners.

FIG. 8: Top Track. FIG. 8 is a partial cutaway of an upper portion of the wall system 800 of the present invention. Illustrated in FIG. 8 is a head track 823 in association with the wall panels 802. The wall panels 802 are removably affixed to the head track 823 using removable long-term fasteners 804H. The long-term removable fasteners 804H are optional and may be used or not. The removable head trim 831 is typically used to cover the removable long-term fasteners 804, although zip tape may be used in lieu of head trim.

FIG. 9: Bottom track. FIG. 9 is a partial section illustrating a lower portion of the wall system 900 of the present invention. FIG. 9 illustrates a removable bottom track 922 in association with the wall panels 902. The wall panels 902 are removably secured to the removable bottom track 922 and a stud 920 using the removable long-term fasteners 904F. Also, a releasable adhesive 906 may be used to secure the wall panel 902 with the stud 920. The removable long-term fasteners 904F are typically covered using the removable base trim 930, and zip tape may be used in lieu of base trim 930. A floor finish 966 is typically used adjacent the removable base trim 930.

FIG. 10: Alternate bottom track. FIG. 10 illustrates yet another embodiment of a wall system 1000 of the present invention, showing a partial cross-section of a wall panel 1002 in association with a removable bottom track 1022. The wall panel 1002 is typically secured to the removable bottom track 1022 using the removable long-term fasteners 1004F. Similarly as discussed above, a removable base trim 1030 is used to cover the removable long-term fastener 1004F. A floor finish 1066 is typically used adjacent the removable base trim 1030. The bottom track 1022 is removably affixed to the subfloor using various methods; and for the present invention the bottom track 1022 can be secured using the releasable adhesive 1006. Also, the bottom track 1022 can be affixed to a subfloor using a removable fastener or knockoff fasteners 1024.

FIG. 11 is an illustration of a tri-channel head track 1123 for use in association with the wall system of the present invention. The tri-channel head track 1123 provides for accepting wall panels 1102A, 1102B on alternate sides of a stud 1120. The wall panels 1102 are secured to the stud 1120 and the tri-channel head track 1123 using removable long-term fasteners 1104. The tri-channel head track 1123 has a plurality of channels, with the embodiment illustrated having three channels 1123A, 1123B, 1123C. The outermost channels 1123A, 1123B are disposed on alternate sides of the middle channel 1123C. The removable long-term fasteners 1104 can be treated as described herein in other embodiments of the present invention. For example, the removable long-term fasteners 1104 can be taped and floated, covered with caulking, etc.

FIG. 11A is a cut-away illustration of the tri-channel head track 1123 for use in association with the wall system 1100 of the present invention as illustrated in FIG. 11 having an unfeathered extension 1123D and a releasable adhesive 1106.

FIG. 11B is an illustration of the tri-channel head track 1123 for use in association with the wall system 1100 of the present invention as illustrated in FIG. 11 having a feathered extension 1123D and a releasable adhesive 1106.

FIG. 12 is a sectional illustration of a tri-channel bottom track 1222 used in association with the wall system of the present invention. The tri-channel bottom track 1222 has two protrusions 1222D on its upper surface 1222E such that the stud 1204 is accepted into the channel 1222F formed by the two protrusions 1222D in the bottom track 1222. The wall panels 1202A, 1202B are accepted on the outer portion on the upper surface 1222E of the bottom track 1222. The tri-channel bottom track 1222 has knockouts 1222B and an isolated data cavity 1222A. Further, the tri-channel bottom track 1222 has a roughened surface 1222C in which a releasable adhesive can be used to secure the tri-channel bottom track 1222 to a floor or subfloor. Typically, a knock-off 1224 is used to removable secure the track 1222.

FIG. 12A is a sectional illustration of a tri-channel bottom track 1222 used in association with the wall system of the present invention having an enclosed data channel 1222A and using removable adhesive 1206.

FIG. 13 is a sectional view of a quad-channel bottom track 1322 used with the wall system of the present invention. The quad-channel bottom track 1322 comprises an isolated data cavity 1322A, knockouts 1322B, beveled edges 1322D in association with the upper channels, and a roughened surface 1322C. The roughened surface 1322C is used to removably secure the quad-channel bottom track 1322 to a floor or subfloor. The isolated data channel 1322A is used in association with the knockouts 1322B to pull wiring and cable for data, phones, or lights. The three open channels are used for accepting a stud 1320 in the middle channel, and for accepting wall panels 1302 in the outermost channels. Optionally, the quad-channel bottom track 1322 can be secured to the wall panels 1302 using long term removable fasteners 1304. As still a further option, the long term removable fasteners 1304 can be covered with a zip tape 1310 and a mud compound 1316 so that they can be later accessed for easy disassembly of the wall panels 1320 and the quad-channel bottom track 1322. Also a cover plate 1322BB is removably engaged in selected punch outs 1322B. The cover plates 1322BB can be of various shapes, sizes, and affixed in various ways, for example, snap on, glue on, screw on, etc.

FIG. 13A is a sectional illustration of a tri-channel bottom track 1322 used in association with the wall system of the present invention having an enclosed data channel 1322A and using removable adhesive 1306

FIG. 14 is yet another embodiment of the tri-channel bottom track 1422 for use with the wall system of the present invention. The tri-channel bottom track 1422 comprises a bottom track 1422A, one or more knockouts 1422B, and a roughened surface 1422C. The bottom track 1422A, preferably receives a stud 1420. The stud 1420 has one or more knockouts 1420A. The combination of the stud knockouts 1420A and the track knockouts 1422B provide for easy access of wires and cables within a stud cavity 1460 between two wall panels 1420A, 1420B. Also a cover plate 1422BB is removably engaged in selected punch outs 1422B. The cover plates 1422BB can be of various shapes, sizes, and affixed in various ways, for example, snap on, glue on, screw on, etc. Typically, a knock-off 1424 is used to removably secure the track 1422.

FIG. 14A is a sectional illustration of a tri-channel bottom track 1422 used in association with the wall system of the present invention having an enclosed data channel 1422A and using removable adhesive 1406.

FIG. 15 is a sectional illustration of another tri-channel bottom track 1522 used in association with the wall system of the present invention having an enclosed data channel 1522A.

FIG. 15A is a sectional illustration of the tri-channel bottom track 1522 used in association with the wall system of the present invention having an enclosed data channel as illustrated in FIG. 15 and having an unfeathered extension 1522D and releasable adhesive 1506.

FIG. 15B is a sectional illustration of the tri-channel bottom track used in association with the wall system of the present invention having an enclosed data channel as illustrated in FIG. 15 and having a feathered extension 1522D and a releasable adhesive 1506 and a slotted data channel 1522A.

FIG. 16 is yet another embodiment of the tri-channel bottom track 1622 for use with the wall system of the present invention having a slotted data channel 1622A for receiving the studs 1620. The tri-channel bottom track 1622 is adapted for use with load-bearing walls.

FIG. 16A is a sectional illustration of another tri-channel bottom track 1622 used in association with the wall system of the present invention having a slotted data channel 1622 as illustrated in FIG. 16 and having an unfeathered extension 1622D and a releasable adhesive 1606.

FIG. 17 illustrates a cross section of a wall system 1700 of the present invention with a wall panel 1702 removably engaged with a removable electrical fixture 1762 and a plumbing fixture 1764.

FIG. 18 is a sectional illustration of a tri-channel bottom track 1822 used in association with the wall system of the present invention having elements that are of bendable metal.

FIG. 19 is a sectional illustration of another embodiment of a tri-channel bottom track 1922 used in association with the wall system of the present invention having elements that are bendable metal.

FIG. 20 is a sectional illustration of yet another embodiment of a tri-channel bottom track 2022 used in association with the wall system of the present invention having elements that are bendable metal.

FIG. 21A is a sectional illustration of another channeled bottom track 2122 used in association with the wall system of the present invention having a data channel 2122A. The bottom track 2122 has flush base trim 2130 with a raised channel seat for accepting the stud 2120. As in the other embodiments, the base trim 2130 is affixed to the bottom track 2122, but not the panel 2102, for easy remove. As with the other embodiments of the present invention, treated screws 2104F may be used.

FIG. 21AA is a sectional illustration of another channeled bottom track 2122 used in association with the wall system of the present invention having a data channel 2122A. The bottom track 2122 has flush base trim 2130 with a raised channel seat for accepting the stud 2120. As in the other embodiments, the base trim 2130 is affixed to the bottom track 2122, but not the panel 2102, for easy removal. As with the other embodiments of the present invention, treated screws 2104F may be used.

FIG. 21AAA is a sectional illustration of yet another channeled bottom track 2122 used in association with the wall system of the present invention having a data channel 2122A. The bottom track 2122 has flush base trim 2130 with a raised channel seat for accepting the stud 2120. As in the other embodiments, the base trim 2130 is affixed to the bottom track 2122, but not the panel 2102, for easy removal. As with the other embodiments of the present invention, treated screws 2104F may be used.

FIG. 21B is a sectional illustration of another channeled bottom track 2122 used in association with a load-bearing wall system of the present invention having a data channel 2122A. The bottom track 2122 has flush base trim 2130 with a raised channel seat for accepting the stud 2120. As in the other embodiments, the base trim 2130 is affixed to the bottom track 2122, but not the panel 2102, for easy removal. As with the other embodiments of the present invention, treated screws 2104F may be used.

FIG. 22A is a sectional illustration of another channeled bottom track 2222 used in association with a wall system of the present invention having a data channel 2222A. The bottom track 2222 has flush base trim 2230 with a raised channel seat for accepting the stud 2220. As in the other embodiments, the base trim 2230 is affixed to the bottom track 2222, but not the panel 2202, for easy removal. As with the other embodiments of the present invention, treated screws 2204F may be used.

FIG. 22AA is a sectional illustration of an alternate embodiment of the one piece base track with a raised channel-seat for the stud.

FIG. 22B is a sectional illustration of another channeled bottom track 2222 used in association with a wall system of the present invention having a data channel 2222A. The bottom track 2222 has flush base trim 2230 with a raised channel seat for accepting the stud 2220. As in the other embodiments, the base trim 2230 is affixed to the bottom track 2222, but not the panel bottom track 2122 has flush base trim 2130 with a raised channel seat for accepting the stud 2120. As in the other embodiments, the base trim 2130 is affixed to the bottom track 2122, but not the panel 2102, for easy removal. As with the other embodiments of the present invention, treated screws 2104F may be used.

FIG. 21B is a sectional illustration of another channeled bottom track 2122 used in association with a load-bearing wall system of the present invention having a data channel 2122A. The bottom track 2122 has flush base trim 2130 with a raised channel seat for accepting the stud 2120. As in the other embodiments, the base trim 2130 is affixed to the bottom track 2122, but not the panel 2102, for easy removal. As with the other embodiments of the present invention, treated screws 2104F may be used.

FIG. 22A is a sectional illustration of another channeled bottom track 2222 used in association with a wall system of the present invention having a data channel 2222A. The bottom track 2222 has flush base trim 2230 with a raised channel seat for accepting the stud 2220. As in the other embodiments, the base trim 2230 is affixed to the bottom track 2222, but not the panel 2202, for easy removal. As with the other embodiments of the present invention, treated screws 2204F may be used.

FIG. 22B is a sectional illustration of another channeled bottom track 2222 used in association with a wall system of the present invention having a data channel 2222A. The bottom track 2222 has flush base trim 2230 with a raised channel seat for accepting the stud 2220. As in the other embodiments, the base trim 2230 is affixed to the bottom track 2222, but not the panel.

While the foregoing is directed to embodiments of the present invention, other and further embodiments of the invention may be devised without departing from the basic scope thereof, and the scope thereof is determined by the claims that follow.

The invention claimed is:

1. A paneling system, comprising:

two panels located adjacent each other forming a joint between the panels;

one or more fasteners securing the joint to a support element;

a tape covering substantially all of the joint; and a compound covering the tape, wherein a portion of the tape extends beyond the compound and configured to lift the tape from the panels.

2. The system of claim 1, wherein the portion is covered by a material other than the compound.

3. The system of claim 2, wherein the material is a baseboard.

4. The system of claim 2, wherein the material is a crown mold.

5. The paneling system of claim 1, wherein the one or more fasteners are configured to be releasable.

6. The paneling system of claim 1, wherein the one or more fasteners include a non-stick head.

7. The paneling system of claim 1, wherein the tape is detachable from the panels after the compound is fully cured.

8. The paneling system of claim 1, wherein the tape and substantially all of the compound is removable from the fasteners to sufficiently expose the fasteners such that the fasteners are removable and the panels are demountable.

9. The system of claim 1, wherein the tape is an adhesive tape.

10. The system of claim 1, wherein the tape also covers a portion of each panel adjacent the joint.

11. The system of claim 10, wherein the tape is an adhesive tape.

12. The system of claim 1, wherein the portion extending from the compound includes adhesive.

13. The system of claim 1, wherein the portion extending from the compound has a width larger than a seam between two panels.

14. The system of claim 1, wherein the portion of the tape is configured to remove the tape as a single piece.

15. A paneling system, comprising:

two or more panels, configured in an abutting fashion to form a joint;

one or more fasteners for securing the panels to a support element;

a tape for covering at least one of the fasteners;

a compound for covering the tape; and a pull tab integral with the tape and extends beyond the compound and configured to lift the tape from the panel when pulled after the compound has cured.

16. The paneling system of claim 15, wherein the one or more fasteners have a non-stick head configured to facilitate removal of the compound after removal of the tape.

17. The paneling system of claim 16, wherein the non-stick head is created with a coating, including polytetrafluoroethylene.

18. The paneling system of claim 15, wherein the pull tab is at an end of the tape.

19. The paneling system of claim 15, wherein the pull tab is an extended portion of the tape.

20. The paneling system of claim 15, further comprising a material for covering the pull tab.

21. The paneling system of claim 20, wherein the material is a base board.

22. The paneling system of claim 20, wherein the material is a crown trim.

23. The paneling system of claim 15, wherein the paneling system comprises a portion of a substantially horizontal plane.

24. The paneling system of claim 15, wherein the paneling system comprises a portion of a substantially vertical plane.

25. The paneling system of claim 24, further comprising a conduit for wires configured to run substantially parallel to the vertical plane.

26. The paneling system of claim 25, wherein the conduit is configured to support the panels and the support element.

27. The paneling system of claim 26, further comprising a slot on a panel side of the conduit configured to secure the panels.

28. The paneling system of claim 27, further comprising one or more wires running in the conduit, such that the one or more wires travel under at least one support member of the support element.

29. The paneling system of claim 15, wherein the tape and substantially all of the compound is removable from the fasteners to sufficiently expose the fasteners such that the fasteners are removable and the panels are demountable.

30. The paneling system of claim 29, wherein the one or more fasteners include an adhesive fastener.

31. The paneling system of claim 29, wherein the one or more fasteners include a mechanical fastener.

32. The paneling system of claim 29, wherein the one or more fasteners include a combination of adhesive and mechanical fasteners.

33. The system of claim 15, wherein the tape is an adhesive tape.

34. The system of claim 15, wherein the pull tab has a width larger than a seam between two panels.

* * * * *